US005646516A

United States Patent [19]

Tobita

[11] Patent Number: 5,646,516

[45] Date of Patent: Jul. 8, 1997

[54] REFERENCE VOLTAGE GENERATING CIRCUIT

[75] Inventor: Yoichi Tobita, Hyogo, Japan

[73] Assignee: Mitsubishi Denki Kabushiki Kaisha, Tokyo, Japan

[21] Appl. No.: 522,439

[22] Filed: Aug. 31, 1995

[30] Foreign Application Priority Data

Aug. 31, 1994 [JP] Japan ..... 6-206555
May 31, 1995 [JP] Japan ..... 7-133257

[51] Int. Cl.[6] ..... G05F 3/16
[52] U.S. Cl. ..... 323/313; 323/314
[58] Field of Search ..... 323/312, 313, 323/314, 315

[56] References Cited

U.S. PATENT DOCUMENTS 5,369,354 11/1994 Mori ..... 323/313
5,391,979 2/1995 Kajimoto et al. ..... 323/313

FOREIGN PATENT DOCUMENTS 2-67610 3/1990 Japan .
2-245810 10/1990 Japan .

*Primary Examiner*—Peter S. Wong
*Assistant Examiner*—Y. J. Han
*Attorney, Agent, or Firm*—Lowe, Price, LeBlanc & Becker

[57] ABSTRACT

An MOS transistor Q3 operates in a diode mode, and applies a voltage which is lower than a power supply voltage Vcc by an absolute value of its threshold voltage to the gate of an MOS transistor Q1. MOS transistor Q1 operates in a saturation region, and a supplies current which is in proportion to the difference between the threshold voltages of MOS transistors Q3 and Q1 to an output node 2. An MOS transistor Q4 also operates in a diode mode and applies a voltage equal to its threshold voltage to the gate of MOS transistor Q2. MOS transistor Q2 operates in a saturation region, and discharges current which is in proportion to the difference between the gate-source voltage and the threshold voltage. The currents flowing through MOS transistor Q1 and through MOS transistor Q2 are equal to each other. Accordingly, the dependency upon temperature of the threshold voltages is canceled, and thus an output voltage V0 with extremely low dependency upon temperature can be obtained at output node 2. A circuit which generates a reference voltage with no dependency upon power supply voltage and extremely low dependency upon temperature is provided.

21 Claims, 34 Drawing Sheets

REFERENCE VOLTAGE GENERATING CIRCUIT

BACKGROUND OF THE INVENTION

1. Field of the Invention

The present invention relates to a circuit which generates a reference voltage with a prescribed voltage level in a semiconductor device, and particularly to a structure which reduces dependency of the reference voltage upon an external supply voltage and operating temperature.

2. Description of the Background Art

In a semiconductor integrated circuit, a reference voltage at a constant voltage level which has no dependency upon an external supply voltage is frequently required. One of such situations will be described below. For a higher densification and integration of a circuit, semiconductor elements which are the components of the circuit are miniaturized. Since miniaturized semiconductor elements have lower breakdown voltages, a semiconductor integrated circuit comprised of such miniaturized semiconductor elements requires a lower supply voltage (operating supply voltage). In practice, however, there are situations in which an external supply voltage cannot be reduced. For instance, a power supply voltage (operating supply voltage) of a large storage capacity DRAM (Dynamic Random Access Memory) is made lower, considering the breakdown voltage of the elements, the operating speed and power dissipation of DRAM, etc. However, since the components of external devices such as microprocessors and logic LSIs are not miniaturized to the extent of the components of DRAM, the power supply voltage of these external devices cannot be made as low as that of DRAM. Accordingly, when a DRAM, a microprocessor power and the like is utilized to configure a system, a power supply voltage of a high voltage level required by the microprocessor, logic LSI, or the like will be used as the system power source.

When the voltage of the system power supply, that is, the external power supply, is relatively high, a semiconductor device such as DRAM which requires a low operating supply voltage is provided with a circuit which generates an internal supply voltage internally down-converting the external power supply voltage.

FIG. 40 is a schematic diagram showing the entire structure of a semiconductor device such as DRAM which includes an internal voltage down converter circuit as described above. Referring to FIG. 40, a semiconductor device 900 includes an external power supply line 902 which conducts an external supply voltage EXV applied to a power supply terminal 901, another power supply line (hereinafter referred to as a ground line) 904 which conducts the other power supply voltage (hereinafter referred to as a ground voltage) Vss applied to another power supply node (hereinafter referred to as a ground line) 903, and an internal voltage down converter circuit 905 which operates with voltages EXV and Vss on external power supply line 902 and ground line 904 as its both operating power supply voltages and internally down converts external power supply voltage EXV so as to generate an internal power supply voltage VCI on an internal power supply line 906. The structure of this down converter circuit 905, as will be described later, has a function of generating stable internal power supply voltage VCI which is not affected by the variation of external power supply voltage EXV within a predetermined range of external supply voltage EXV.

Semiconductor device 900 further includes an internal power supply utilizing circuit 907 which operates with utilizing voltages VCI and Vss on internal power supply line 906 and ground line 904 as both operating supply voltages, and an external power supply utilizing circuit 908 which operates with external supply voltage EXV on external power supply line 902 and ground voltage Vss on ground line 904 as its both operating supply voltage. This external power supply utilizing circuit 908 is connected to an input/output terminal 909 and serves as an interface with an external device. By utilizing internal voltage down converter circuit 905 to produce internal supply voltage VCI of a prescribed voltage level within semiconductor device 900, the breakdown voltage of elements included in internal power supply utilizing circuit 907 which is the main component of semiconductor device 900 is ensured, and at the same time, improvement in operating speed and reduction in power dissipation by reduction of a signal amplitude are intended.

FIG. 41 is a schematic diagram showing the structure of internal voltage down converter circuit 905 of FIG. 40. Referring to FIG. 41, internal voltage down converter circuit 905 includes a reference voltage generating circuit 910 which generates a reference voltage Vref of a constant voltage level from external supply voltage EXV applied to an external power supply terminal 901, a comparator circuit 912 which compares internal supply voltage VCI on internal power supply line 906 and reference voltage Vref, and a driving element 914 formed of a p channel MOS transistor (insulating gate type field effect transistor) 914 which supplies current from external power supply terminal 901 to internal power supply line 906 in accordance with the output of comparator circuit 912.

Comparator circuit 912 receives external supply voltage VCI at its positive input and reference voltage Vref at its negative input. Comparator circuit 912 is generally constituted of a differential amplifying circuit and differentially amplifies internal supply voltage VCI and reference voltage Vref. The operation of internal voltage down converting circuit 905 will now be outlined hereinbelow.

From reference voltage generating circuit 910, reference voltage Vref of a constant voltage level with no dependency upon external supply voltage EXV is generated. If internal supply voltage VCI on internal power supply line 906 is higher than this reference voltage Vref, the output of comparator circuit 912 will be at H (high) level and driving element 914 is turned off. In this situation, current is not supplied from external power supply terminal 901 to internal power supply line 906.

On the other hand, when internal supply voltage VCI is lower than reference voltage Vref, the output of comparator circuit 912 is at L (low) level and driving element 914 is turned on, so that current is supplied from external power supply terminal 901 to internal power supply line 906, thereby increasing the voltage level of internal supply voltage VCI. Internal supply voltage VCI is maintained at the voltage level of reference voltage Vref by a feedback loop of comparator circuit 912, driving element 914, and internal power supply line 906.

As descried above, since the voltage level of internal supply voltage is decided by reference voltage Vref, it is required that reference voltage Vref has little dependency upon temperature as well as little dependency upon external supply voltage EXV within a prescribed range of external supply voltage EXV when the stability of operation of internal power supply utilizing circuit 907 (see FIG. 25) is taken into consideration.

Such a reference voltage is used in various components other than the internal voltage down converter circuit described above. In an input circuit which inputs an external signal and generates an internal binary signal, a reference voltage is utilized for discrimination between H and L logic levels of this external signal. In a memory device such as a read only memory (ROM) in which data is not read out in a form of a true and complementary read data, a reference voltage is utilized in a circuit for reading and amplifying memory cell data for discrimination between H level and L level of the memory cell data.

In addition, such a reference voltage is also used as a bias voltage of a constant current element included in a differential amplifying circuit. Thus, reference voltage is employed both in a digital integrated circuit and in an analog integrated circuit.

FIG. 42 is a diagram showing a structure of a conventional reference voltage generating circuit shown in, for example, Japanese Patent Laying-Open No. 2-67610. Since the reference voltage may be generated from either an external supply voltage or an internal supply voltage, the power supply voltage is denoted by Vcc in FIG. 42 so that it can cover both external supply voltage and internal supply voltage.

Referring to FIG. 42, the reference voltage generating circuit includes: an enhancement type p channel MOS transistor Q1 connected between a power supply node 1 and an output node 2, and supplying current from power supply node 1 to output node 2 in accordance with voltage on a node 3; an enhancement type p channel MOS transistor Q2 connected between output node 2 and ground line Vss, and having a gate connected to the ground line; an enhancement type p channel MOS transistor Q3 connected between power supply node 1 and node 3, and clamping the voltage of node 3 to a prescribed voltage level; and a resistance element R1 connected between node 3 and ground line Vss and having a resistance value R1.

MOS transistors Q1, Q2, and Q3 have threshold voltages VTP1, VTP2, and VTP3, respectively. MOS transistor Q3 has its gate and drain connected with each other and its back-gate connected to power supply node 1. MOS transistor Q1 has its back-gate connected to power supply node 1, and MOS transistor Q2 has its back-gate connected to output node 2. By setting the potential of source and back-gate of MOS transistor Q2 to an identical value, influence of the back-gate effect is eliminated. Description will now be made of the operation of the circuit.

Conductance coefficients β of MOS transistors Q1, Q2, and Q3 are represented by β1, β2, and β3, respectively. Voltage of node 3 is represented by V3. Assuming that all of MOS transistors Q1 to Q3 are operated in a saturation region, and when voltage of power supply node 1 is expressed Vcc, drain current IDS of MOS transistors Q1 and Q2 can be obtained by:

$$IDS = (\beta 1/2)\ (V3 - Vcc - VTP1)^2 \quad (1)$$
$$= (\beta 2/2)\ (-V0 - VTP2)^2$$

where V0 is an output voltage of output node 2. If resistance value R1 of resistance element R1 is sufficiently larger than equivalent resistance value of MOS transistor Q3, MOS transistor Q3 functions as a diode and the voltage V3 of node 3 is given by the following equation:

$$V3 = Vcc + VTP3 \quad (2)$$

From equations (1) and (2), voltage V0 which is generated at output node 2 is given by the following equation (3).

$$V0 = (\beta 1/\beta 2)^{1/2}(VTP1 - VTP3) - VTP2 \quad (3)$$

As can be seen from the above equation (3), output voltage V0 is decided by threshold voltages VTP1 to VTP3 of MOS transistors Q1 to Q3 and conductance coefficients β1 and β2 of MOS transistors Q1 and Q2, and has no dependency upon power supply voltage Vcc.

Threshold voltage of an MOS transistor has a dependency upon temperature. In particular, as shown in FIG. 43, a threshold voltage VTN of an n channel MOS transistor is made lower as temperature T is elevated, while a threshold voltage VTP of a p channel MOS transistor is made higher as temperature T is elevated. Referring now to FIG. 43, the axis of abscissas indicates temperature T, and the axis of ordinates indicates voltage value V. When the above equation (3) is considered in terms of this dependency on temperature of the threshold voltages, the difference between the threshold voltages VTP1 and VTP3 is taken in the first term at the right side and thus the temperature dependency of these threshold voltages VTP1 and VTP3 are canceled. Accordingly, this first term at the right side can be deemed a constant having no dependency upon temperature.

However, the second term at the right side is directly influenced by the dependency of threshold voltage VTP2 on temperature. Therefore, output voltage V0 has a dependency upon temperature owing to the dependency of this threshold voltage VTP2 upon temperature. Thus, this output voltage V0 from the reference voltage generating circuit varies according to the change of an operating environmental temperature, and there will be a problem that stable generation of a reference voltage which is always maintained at a constant level cannot be attained.

SUMMARY OF THE INVENTION

It is an object of the present invention to provide a reference voltage generating circuit in which a reference voltage is generated such that its voltage level is always constant regardless of the change in an operating environmental temperature.

It is another object of the present invention to provide a reference voltage generating circuit in which a reference voltage of a constant voltage level is generated stably without being influenced by the dependency upon temperature of the threshold voltage of an MOS transistor included in the circuit.

It is a still another object of the present invention to provide a method for easily manufacturing a semiconductor device including MOS transistors having a plurality of threshold voltages which in turn differ from one another, without increasing the number of manufacturing steps.

It is a further object of the present invention to provide a method for manufacturing a reference voltage generating circuit which in turn makes use of the difference between threshold voltages, without increasing the number of manufacturing steps.

The reference voltage generating circuit in accordance with a first aspect includes a current supplying unit including an MOS transistor coupled to a first potential node for supplying current to an output node, a current setting unit including an MOS transistor for adjusting the gate potential of the MOS transistor of the current supplying unit such that the current supplied by the current supplying unit would have a constant value with no dependency upon the voltage of the first potential node, and a voltage generating unit which includes an MOS transistor and a unit for discharging the current supplied by the current supplying unit to a second potential node to generate to the output node a constant reference voltage with no dependency upon the voltage of this first potential node. This voltage generating unit includes a unit to cancel the dependency of the reference voltage at output node owing to the dependency of the threshold voltage of the MOS transistor on temperature.

In the reference voltage generating circuit of the first aspect, the value of the current supplied by the current supplying unit is set by the current setting unit to a value having no dependency on the voltage of the first node. The voltage generating unit cancels the dependency on temperature of the reference voltage caused by the dependency of the threshold voltage of the MOS transistor on temperature, and generates a reference voltage which has no dependency on neither the voltage of the first node or the temperature.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiment 1

Figure 1:
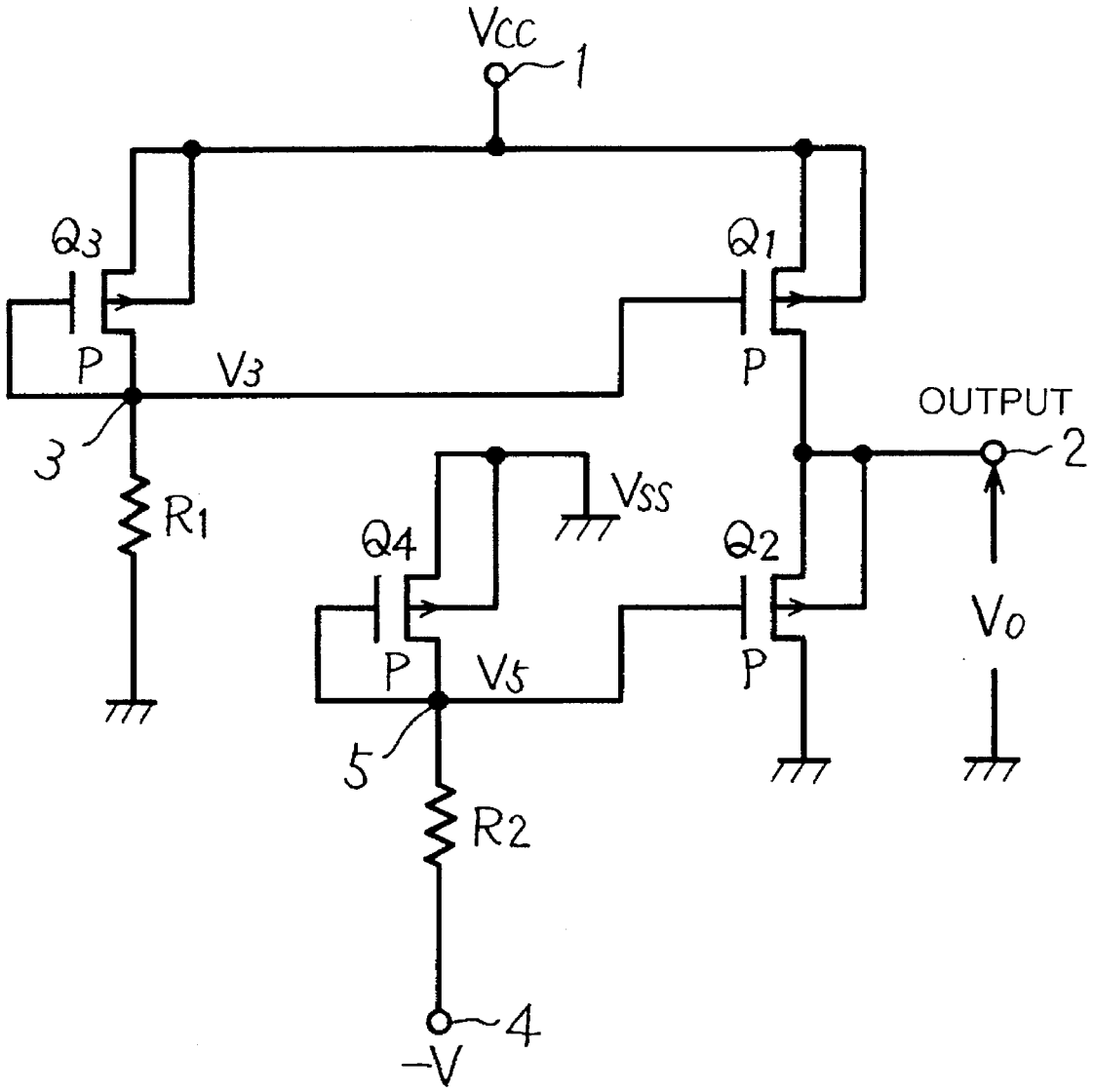
FIG. 1 is a diagram showing a structure of a reference voltage generating circuit in accordance with a first embodiment of the present invention.

FIG. 1 is a diagram showing a structure of a reference voltage generating circuit in accordance with a first embodiment of the present invention. Referring to FIG. 1, the reference voltage generating circuit includes: an enhancement type p channel MOS transistor Q1 connected between a power supply node 1 and an output node 2 for supplying current from the power supply node 1 to output node 2 according to a voltage V3 of a node 3; an enhancement type p channel MOS transistor Q3 connected between power supply node 1 and node 3; and a resistance element R1 connected between node 3 and a ground line, and having a resistance value R1. MOS transistor Q3 has its gate and drain both connected to node 3. Resistance value R1 of resistance element R1 is set sufficiently larger than an equivalent resistance of MOS transistor Q3. Accordingly, the gate-source voltage of MOS transistor Q3 becomes threshold voltage VTP3, and voltage V3 of node 3 becomes Vcc+VTP3. Here, VTP3 is the threshold voltage of MOS transistor Q3. Similarly, MOS transistor Q1 has a threshold voltage VTP1.

The reference voltage generating circuit further has an enhancement type p channel MOS transistor Q4 connected between the ground line and a node 5, a resistance element R2 which is connected between node 5 and a power supply node 4 receiving a negative potential and has a resistance value R2, and an enhancement type p channel MOS transistor Q2 connected between output node 2 and the ground line for drawing out current from the output node to the ground line according to a voltage V5 of node 5. MOS transistor Q4 has its gate and drain both connected to node 5. Threshold voltages of MOS transistors Q2 and Q4 are VTP2 and VTP4, respectively. Resistance value R2 of resistance element R2 is set sufficiently higher than an equivalent resistance value of MOS transistor Q4. Accordingly, MOS transistor Q4 functions as a diode (i.e., operates in a diode mode), and voltage V5 of node 5 becomes Vss+VTP4=VTP4. Here, ground voltage Vss is 0 V. The operation of the circuit will now be described.

Conductance coefficients of MOS transistors Q1 to Q4 are provided as β1 to β4, respectively. Assumption is made that MOS transistors Q1 to Q4 operate in a saturation region. When power supply node 1 is applied with supply voltage Vcc, drain current IDS of MOS transistors Q1 and Q2 is given by the following equation:

$$IDS = (\beta 1/2)\ (V3 - Vcc - VTP1)^2 = (\beta 2/2)\ (V5 - V0 - VTP2)^2 \quad (4)$$

Here, V0 is a voltage which appears at output node 2, based on the ground potential Vss. Since the resistance values of resistance elements R1 and R2 are sufficiently larger than respective equivalent resistance values of MOS transistors Q3 and Q4 voltages V3 and V5 of nodes 3 and 5 are obtained by the following equations.

$$V3=Vcc+VTP3 \quad (5)$$

$$V5=VTP4 \quad (6)$$

From equations (4) to (6), the following equation is obtained for voltage V0 generated at output node 2.

$$V0=(\beta 1/\beta 2)^{1/2}(VTP1-VTP3)-(VTP2-VTP4) \quad (7)$$

As can be seen from equation (7), output voltage V0 is decided by threshold voltages VTP1 to VTP4 of MOS transistors Q1 to Q4 and conductance coefficients β1 and β2 of MOS transistors Q1 and Q2, and has no dependency on supply voltage Vcc applied to power supply node 1. In addition, since the difference between threshold voltages is taken in both first and second terms at the right side of equation (7), the dependency of the threshold voltages upon temperature is canceled, and the dependency of output voltage V0 upon temperature can be reduced.

Furthermore, in order to set the gate-source voltages of MOS transistors Q3 and Q4, respectively, at threshold voltages VTP3 and VTP4, it is preferred that the current flowing through resistance elements R1 and R2 is made as small as possible. Accordingly, the resistance values of resistance elements R1 and R2 can be increased to arbitrary, sufficiently large values, and voltages V3 and V5 of nodes 3 and 5 can be set at a prescribed voltage level accurately, without being influenced by the variation of resistance values R1 and R2 due to the variation of the manufacturing parameters of resistance elements R1 and R2.

In addition, since output voltage V0 is decided by the ratio of conductance coefficients β1 and β2, these conductance coefficients β1 and β2 can be reduced as desired, as long as the ratio β1/β2 has a constant value. By reducing conductance coefficients β1 and β2, respectively, the value of current flowing through MOS transistors Q1 and Q2 can be reduced. Accordingly, reduction of the current dissipated by the entire of the reference voltage generating circuit can be implemented easily and thus a reference voltage generating circuit with low power dissipation can be realized.

In addition, when threshold voltages VTP2 and VTP4 of MOS transistors Q2 and Q4 are made equal to each other, output voltage V0 can be decided only by threshold voltages VTP1 and VTP3 of MOS transistors Q1 and Q3 and conductance coefficients β1 and β2 of MOS transistors Q1 and Q2, as can be seen from the following equation (7)'

$$V0=(\beta 1/\beta 2)^{1/2}(VTP1-VTP3) \quad (7)'$$

A method of changing the threshold voltage of an MOS transistor may include (i) changing the thickness of the gate insulating film, (ii) changing the material for the gate electrode (for example, using aluminum and polycrystalline silicon), and (iii) changing impurity concentration of a surface (channel region) of a semiconductor substrate under the gate region. In the practical manufacturing of the circuit, the manufacturing process can be simplified if the number of kinds of the threshold voltages is reduced as far as possible, and it would be easier to manufacture the circuit. Assuming that two kinds of threshold voltages VTP3=−1.2 V and VTP1=VTP2=VTP4=−0.7 V are employed, and assuming that $(\beta 1/\beta 2)^{1/2}=7$, the resulting output voltage V0 can be expressed as follows.

$$V0=7\cdot\{-0.7-(-1.2)\}=3.5\ V$$

Conductance coefficient β of an MOS transistor is in proportion to the ratio W/L of gate width W to gate length L. In order to reduce the variation of conductance coefficients β1 and β2 of MOS transistors Q1 and Q2 due to the size effect during the manufacturing processes, it is preferred that unit MOS transistors are employed which are identical in shapes and are arranged in an identical orientation to form MOS transistors Q1 and Q2, as shown in FIGS. 2A to 2D.

Figure 2A:
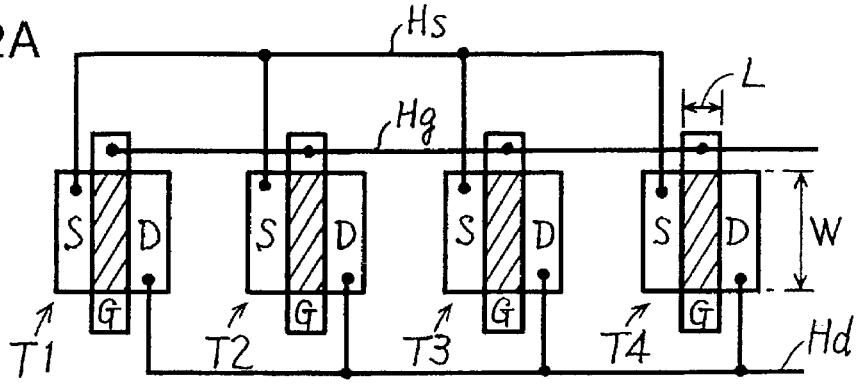
FIGS. 2A to 2D are diagrams showing structures of MOS transistors utilized in the present invention.

Layout for increasing W/L is shown in FIG. 2A. Referring to FIG. 2A, unit MOS transistors T1 to T4 with identical shapes and same W/L are arranged in a horizontal direction. Each of MOS transistors T1 to T4 has a source region S, a gate electrode G, and a drain region D. In FIG. 2A, the shaded regions indicate channel regions. Unit MOS transistors T1 to T4 have their respective source regions S connected with each other by an interconnection Hs, and drain regions D connected with each other by an interconnection Hd. Respective gate electrodes G of unit MOS transistors T1 to T4 are connected with one another by an interconnection Hg. In this configuration, unit MOS transistors T1 to T4 are connected with one another in parallel to be equivalent to an MOS transistor having a channel width 4 W.

Figure 2B:
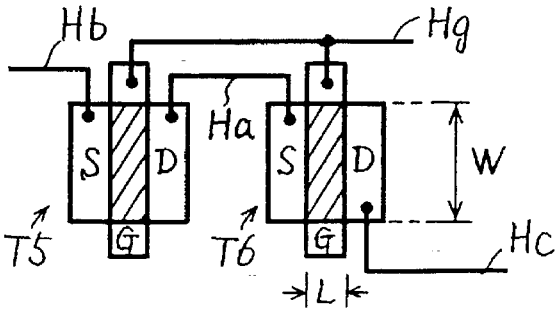

A structure for reducing W/L is shown in FIG. 2B. Referring to FIG. 2B, unit MOS transistors T5 and T6 are arranged in parallel to each other. Unit MOS transistors T5 and T6 are identical in shapes, and has a same W/L value. Drain region D of unit MOS transistor T5 and source region S of unit MOS transistor T6 are connected with each other by an interconnection Ha. Gate electrodes G of unit MOS transistors T5 and T6 are connected with each other by an interconnection Hg. Source region S of unit MOS transistor T5 is in connection with an interconnection Hb, and drain region D of unit MOS transistor T6 is in connection with an interconnection Hc. In the structure of this FIGS. 2B, unit MOS transistors T5 and T6 are connected in series. Accordingly, the resultant arrangement is equal to an MOS transistor in which the channel length is equivalently doubled.

Figure 2C:
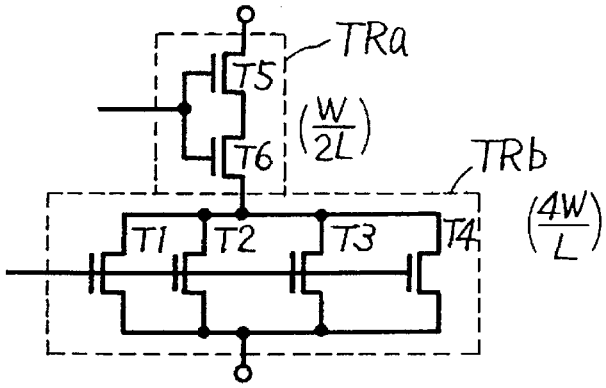

FIG. 2C is a diagram showing an electrically equivalent circuit where unit MOS transistors of FIG. 2A and FIG. 2B are interconnected. Referring to FIG. 2C, MOS transistors TRa and TRb are connected in series. MOS transistor TRa includes the structure shown in FIG. 2B, and is formed by serial connection of unit MOS transistors T5 and T6. MOS transistor TRb has the structure shown in FIG. 2A and includes a parallel connection of unit MOS transistors T1 to T4. MOS transistor TRa has the same gate width as that of an unit MOS transistor and a channel length which is twice as long as that of an unit MOS transistor.

MOS transistor TRb has a gate width which is four times as large as that of an unit MOS transistor and a channel length which is equal to that of an unit MOS transistor. That is, the ratio between the gate width (channel width) and channel length (gate length) of MOS transistor TRa is given by W/2L while the ratio between the channel width (gate width) and channel length (gate length) of MOS transistor TRb is given by 4 W/L.

As described above, by forming an MOS transistor with a plurality of unit MOS transistors, the variation of conductance coefficients β1 and β2 due to the variation of manufacturing parameters can be reduced, as compared to the example using one MOS transistor. Also, this structure for implementing an MOS transistor by using unit MOS transistors leads to a following advantage.

In an MOS transistor, effects such as the narrow channel effect and the short channel effect depending on the gate width and gate length are known. The short channel effect lessens the absolute value of the threshold voltage, and the narrow channel effect increases the absolute value of threshold voltage. Accordingly, when channel length is made shorter or gate width is made narrower in order to achieve a desired ratio of gate width to gate length, the effects as described above are encountered and thus the desired threshold voltage cannot be achieved. By using unit MOS transistors, however, influence of such size effects of MOS transistor such as the short channel effect and the narrow channel effect can be eliminated so as to attain a desired threshold voltage with accuracy.

Figure 2D:
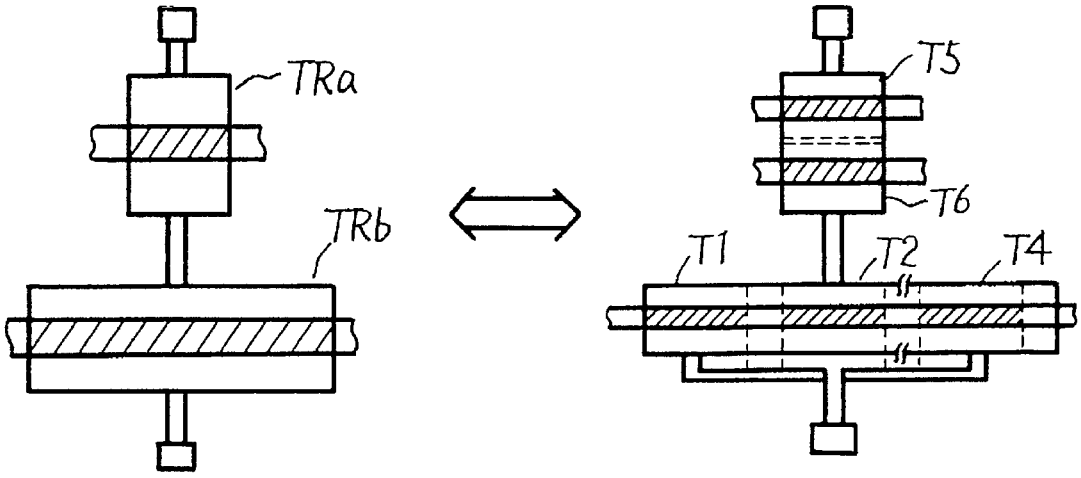

FIG. 2D is a diagram showing another layout unit MOS transistors. Referring to FIG. 2D, an MOS transistor TRa is formed by two unit MOS transistors T5 and T6 arranged in a vertical direction and an MOS transistor TRb is formed by unit MOS transistors T1 to T4 arranged in parallel in a horizontal direction. A similar effect can be obtained also in the structure shown in this FIG. 2D. In particular, by utilizing unit MOS transistors having identical shapes and arranged in an identical orientation to each other as MOS transistors Q1 and Q2, the size effects can be suppressed, and in addition, the variation of conductance coefficients β1 and β2 due to manufacturing parameters variation can be reduced for the following reasons.

When channel width and channel length are varied owing to a mask misalignment or the like during manufacturing thereof, conductance coefficient β is largely influenced if a single MOS transistor is used. For example, when W/L is 40, conductance coefficients β is significantly changed if there is a slight change in channel length L. Meanwhile, if W/L of an unit MOS transistor is set at a small value, the mask misalignment is small and thus is substantially negligible. Accordingly, by using a plurality of unit MOS transistors, influence of the parameter variations during manufacturing thereof can be eliminated so as to suppress the variation of conductance coefficients β1 and β2.

In addition, according to Japanese Patent Laying-Open No. 2-245810, the MOS transistors used in the reference voltage generating circuit as shown in FIG. 1 preferably have a large channel length to a certain extent for the following reasons. For instance, even when the MOS transistors used at other circuit portions of the semiconductor device have a channel width of about 1 μm, the MOS transistors used in the reference voltage generating circuit shown in FIG. 1 may preferably have a longer channel length of, for example, 5 μm or more. It is assumed that the drain current IDS of the saturation region in MOS transistors depends only on gate-source voltage in the above equations (4) to (7), for simplification of the description. Actually, however, this drain current IDS would also be changed more or less by the drain-source voltage. Generally, where a width of depletion layer between channel and drain is LD, drain current IDS would be found by:

$$IDS=IDsat\cdot L/(L-LD)$$

where IDsat represents a saturation drain current and L represents a channel length. The parameter LD depends on drain voltage VD of an MOS transistor. Accordingly, the longer the channel length L is, the smaller the influence of this parameter LD so that drain current IDS can be constant, as can be seen from the above equation. In general, it is known that drain conductance gd (=dIDS/dVD (where VG: constant)) is increased correspondingly to the reduction of the channel length. Therefore, drain conductance gd can be made smaller by increasing this channel lengths and thus reference voltage V0 will be more stable. In addition, longer channel length L is preferred also for suppression of variation in the threshold voltage caused by the short channel effect.

In the circuit shown in FIG. 1, MOS transistors Q1 to Q4 have their back-gates connected to the respective sources, but these back-gates may also be configured so as to be in connection with a common substrate terminal. However, since the threshold voltage of an MOS transistor varies in accordance with the voltage between the back-gate and the source, the respective back-gates of MOS transistors Q1 to Q4 should preferably be connected to corresponding sources in order to avoid influence of such back-gate effect.

Although end of resistance element R1 is in connection with the ground line, it may alternatively be connected to a reference potential node which provides a constant voltage level lower than the voltage V3 at node 3.

Furthermore, power supply node 4 is provided with a voltage −V of negative polarity. This minus voltage −V may be applied externally, or a negative voltage generated internally within the semiconductor device may be utilized.

Figure 3:
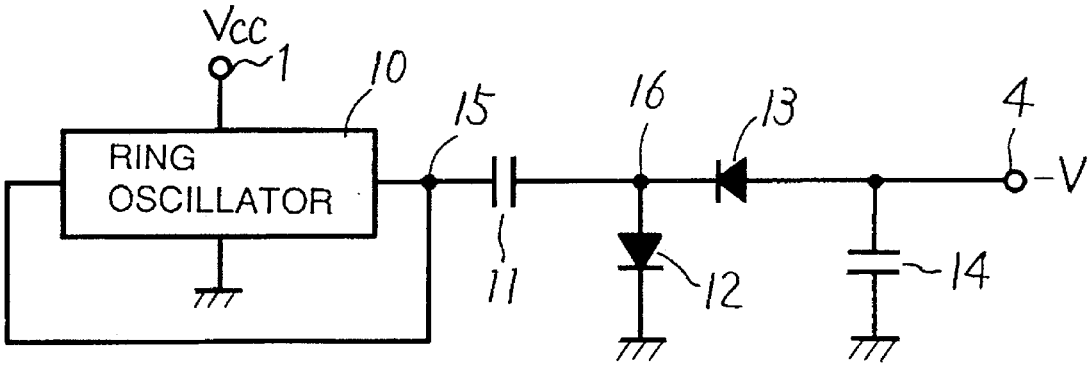
FIG. 3 is a diagram showing an example of a structure for generating a negative voltage shown in FIG. 1.

FIG. 3 is a diagram showing a structure of a negative voltage generating circuit which generates negative voltage −V internally within the semiconductor device. In general, the negative voltage generating circuit shown in FIG. 3 is commonly used as a circuit for generating a substrate bias VBB of a dynamic type RAM.

Referring to FIG. 3, the negative voltage generating circuit operates with supply voltage Vcc provided at power supply node 1 and a ground voltage Vss provided at a ground line as its two operating supply voltages, and includes a ring oscillator 10 which generates a pulse signal having a constant period and a constant pulse width, a capacitor 11 provided between an output node 15 of the ring oscillator 10 and a node 16 for performing a charge pump operation according to the pulse signal from the ring oscillator 10, a diode element 12 provided between node 16 and the ground line for clamping the potential of node 16 to a prescribed potential, a diode element 13 connected in an inverse direction between node 16 and the negative voltage node 4, and a stabilizing capacitor 14 for stabilizing the potential of node 4.

Diode elements 12 and 13 may be formed of MOS transistors having their respective drains and gates connected together. Ring oscillator 10 is formed, for example, by odd number of stages of cascaded inverter circuits. The operation of the negative voltage generating circuit will now be described in brief.

Node 15 is supplied with a pulse signal from ring oscillator 10. Changes in signal level at this node 15 are transmitted to node 16 via capacitor 11. When the potential of node 15 is increased and thus the potential of node 16 is increased correspondingly, diode element 12 discharges the potential of this node 16 and the potential level of node 16 is clamped to forward drop voltage VS of diode element 12. The voltage level of node 4 is not higher than 0 V and diode element 13 is turned off.

When the pulse signal from ring oscillator 10 falls to pull down the potential of node 15 from H level to L level, the potential change at this node 15 in the negative direction is transmitted to node 16 via capacitor 11 to decrease the potential of node 16. As a result, diode element 12 is turned off and diode element 13 is turned on. Negative charge is conveyed from node 16 to node 4 (that is, one electrode of stabilizing capacitor 14). Diode element 13 is turned off when the potential V (4) of node 4 becomes higher than at least the level of forward drop voltage VS of diode element 13. Within a single oscillation cycle of ring oscillator 10, the voltage level of negative potential node 4 is made lower by the voltage corresponding to the ratio of capacitors 11 and 14 (which is usually 10 to 100). By repeating the operation described above, the final voltage level of negative potential node 4 will be a constant negative voltage as shown in the following equation (8).

$$-V=-(Vcc-2\cdot VS) \tag{8}$$

As described, in the reference voltage generating circuit of the present invention, the current flowing through resistance element R2 is small (in order to achieve a clamping operation of MOS transistor Q4 shown in FIG. 1, only slight current flows into this MOS transistor Q4). Accordingly, the negative voltage generating circuit of FIG. 3 does not need a high current supplying capability and thus it can be made in a small area. When this reference voltage generating circuit is applied to a dynamic type RAM, the negative voltage from the negative voltage generating circuit used in the dynamic type RAM for generating a substrate bias can be utilized. Not only negative voltage of dynamic type RAM but a negative voltage of other devices can also be employed as long as the device includes a circuit for generating a negative voltage on a same substrate.

Modification 1

Figure 4:
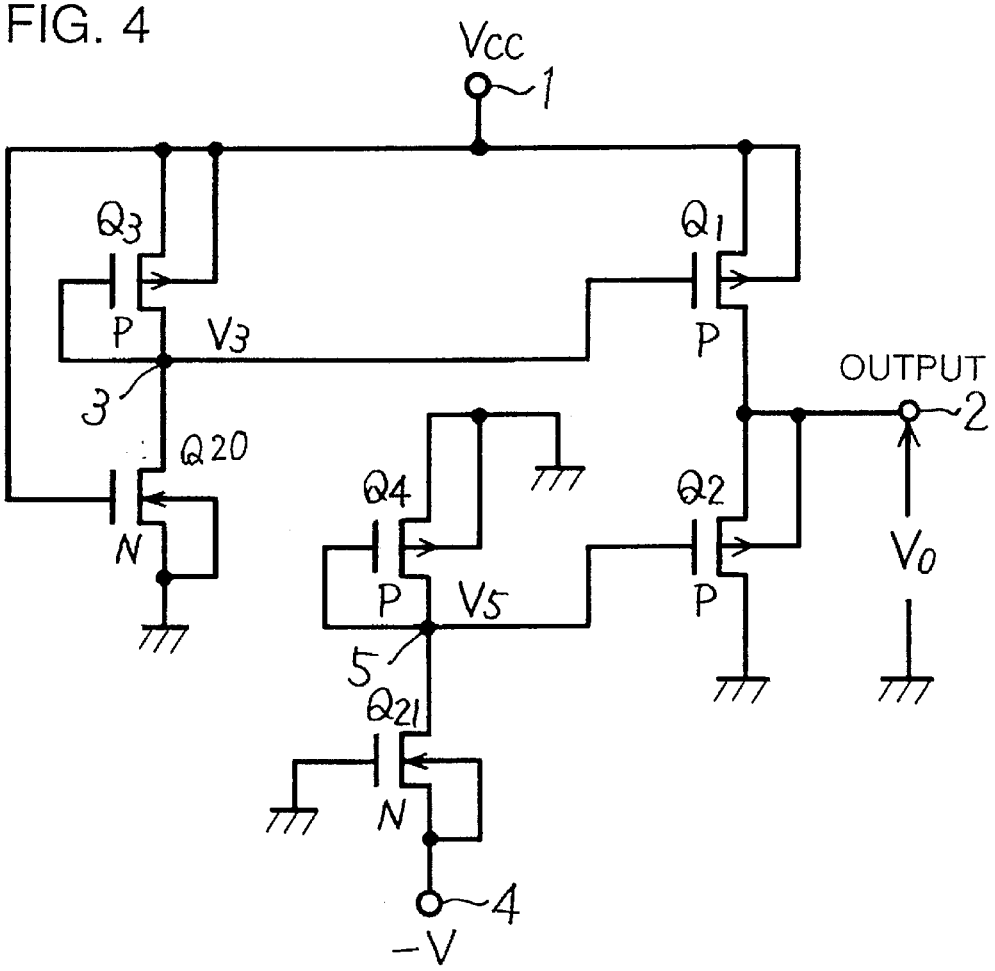
FIG. 4 shows a first modification of the reference voltage generating circuit in accordance with the first embodiment of the present invention.

FIG. 4 shows a first modification of the reference voltage generating circuit according to the first embodiment of the present invention. In the reference voltage generating circuit shown in FIG. 4, enhancement type n channel MOS transistors Q20 and Q21 are provided instead of resistance elements R1 and R2. Other portions are identical to those of the structure shown in FIG. 1 and corresponding components are denoted by identical reference numerals.

MOS transistor Q20 has its gate connected to a power supply node 1, its drain to a node 3, and its back-gate and source to a ground line. MOS transistor Q21 has its gate connected to the ground line, its drain to a node 5, and its back-gate and source to a negative potential node 4. When conductance coefficients β20 and β21 of MOS transistors Q20 and Q21 sufficiently smaller than conductance coefficients β3 and β4 of MOS transistors Q3 and Q4, respectively, MOS transistors Q3 and Q4 operate as a diode, and the respective voltages V3 and V5 of nodes 3 and 5 are as follows.

$$V3=Vcc+VTP3 \tag{9}$$

$$V5=VTP4 \tag{10}$$

Voltages V3 and V5 of node 3 and 5 are the same as those of the embodiment shown in FIG. 1. As in the reference voltage generating circuit of FIG. 1, a reference voltage V0 having a constant voltage level with no dependency upon supply voltage Vcc and temperature can be produced.

In the reference voltage generating circuit of FIG. 4, resistance elements are formed by MOS transistors. Accordingly, the area occupied by the elements can be made smaller, and accordingly, the area of the semiconductor substrate occupied by reference voltage generating circuit can be significantly reduced.

Modification 2

Figure 5:
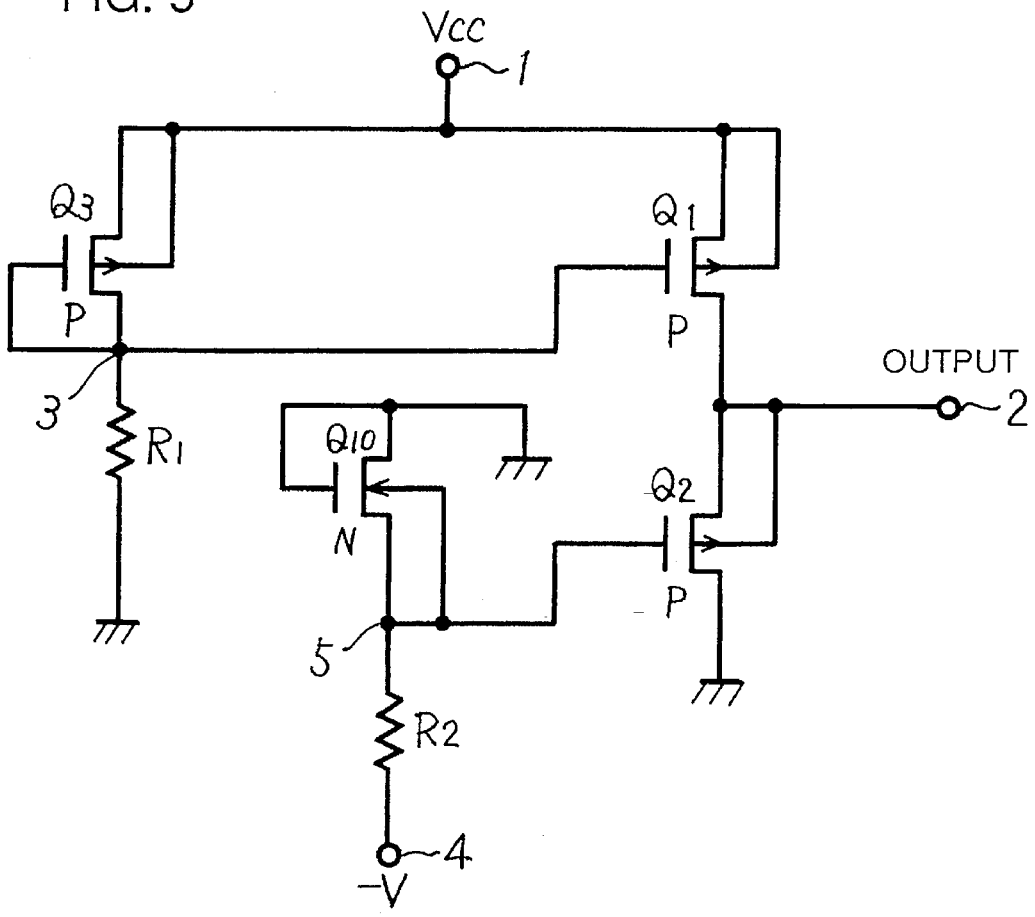
FIG. 5 shows a second modification of the reference voltage generating circuit in accordance with the first embodiment of the present invention.

FIG. 5 shows a second modification of the reference voltage generating circuit according to the first embodiment of the present invention. In the reference voltage generating circuit of FIG. 5, an enhancement type n channel MOS transistor Q10 is employed as the MOS transistor defining the gate voltage of an MOS transistor Q2 which discharges an output node 2. Other portions are the same as those shown in FIG. 1, and the corresponding components are denoted by identical reference numerals. MOS transistor Q10 has its gate and drain connected to a ground line, and its back-gate and source connected to a node 5. A resistance element R2 is provided between node 5 and a negative potential node 4. When equivalent resistance value of MOS transistor Q10 is sufficiently less than the resistance value of resistance element R2, voltage V5 of node 5 is given by the following equation (11).

$$V5=-VTN10 \tag{11}$$

Here, the drain current IDS flowing into MOS transistor Q2 is provided by the following equation.

$$IDS=(\beta 2/2)\,(-VTN10-V0-VTP2)^2 \tag{12}$$

Since this drain current flowing into MOS transistor Q2 is equal to the drain current flowing into MOS transistor Q1, the following equations (13) and (14) are obtained.

$$(\beta 2/2)\,(-VTN10-V0-VTP2)^2=(\beta 1/2)\,(VTP3-VTP1)^2 \tag{13}$$

$$V0=(\beta 1/\beta 2)^{1/2}(VTP1-VTP3)-(VTP2+VTN10) \tag{14}$$

Figure 43:
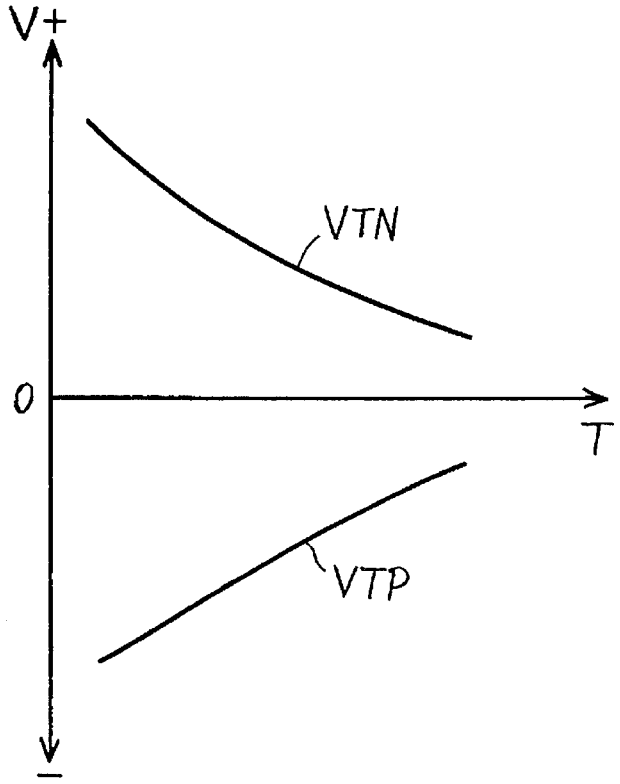
FIG. 43 is a graph showing a dependency upon temperature of threshold voltage of an MOS transistor.

In the equation (14), the second term at the right side includes the arithmetic sum of threshold voltage VTP2 of p channel MOS transistor Q2 and threshold voltage VTN10 of n channel MOS transistor Q10. These threshold voltages VTP2 and VTN10 are of opposite polarities and their temperature dependent characteristics are in opposite directions (see FIG. 43). Accordingly, dependency of the output voltage (reference voltage) V0 upon temperature can be made small as in the case where p channel MOS transistor Q4 is employed as shown in FIG. 1, since the temperature dependent of characteristic is canceled also in the second term at the right side of equation (14).

Embodiment 2

Figure 6:
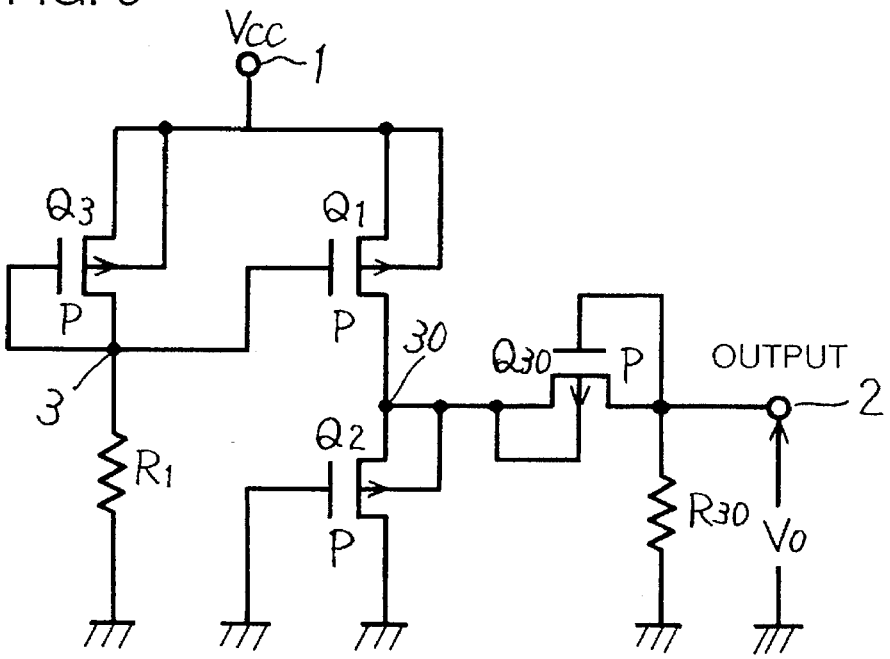
FIG. 6 is a diagram showing a structure of a reference voltage generating circuit in accordance with a second embodiment of the present invention.
Figure 42:
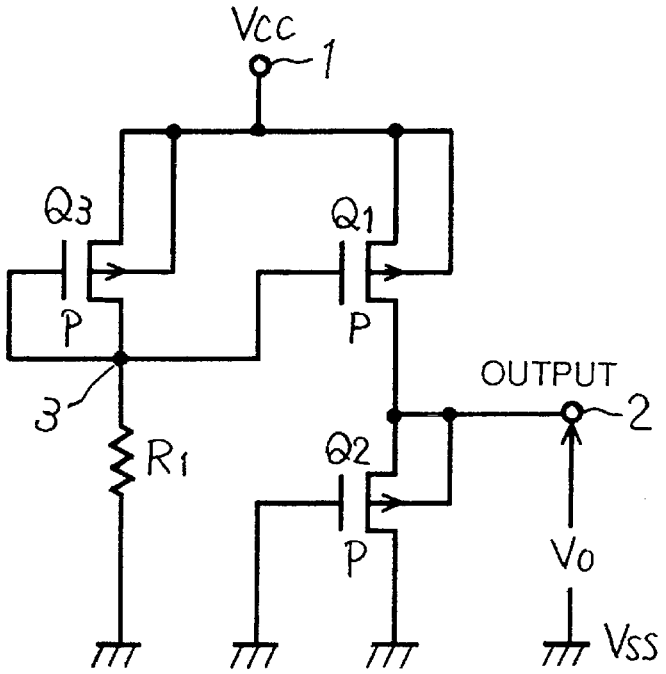
FIG. 42 is a diagram showing a structure of a conventional reference voltage generating circuit.

FIG. 6 is a diagram showing a structure of a reference voltage generating circuit in accordance with a second embodiment of the present invention. Referring to FIG. 6, the reference voltage generating circuit includes a p channel MOS transistor Q3 connected between a power supply node 1 and a node 3, a resistance element R1 connected between node 3 and a ground line, a p channel MOS transistor Q1 connected between power supply node 1 and a node 30, and a p channel MOS transistor Q2 connected between node 30 and the ground line. The structure including these MOS transistors Q1 to Q3 and resistance element R1 is the same as that of the conventional reference voltage generating circuit shown in FIG. 42. That is, the equivalent resistance value of MOS transistor Q3 is sufficiently smaller than the resistance value R1 of resistance element R1, and a voltage Vcc+VTP3 appears at node 3. At node 30, drain current IDS of MOS transistor Q1 and Q2 causes generation of voltage V30 represented by previous equations (3) to (14) and the following equation (15).

$$V30=(\beta 1/\beta 2)^{1/2}(VTP1-VTP3)-VTP2 \quad (15)$$

The reference voltage generating circuit further includes an enhancement type p channel MOS transistor Q30 connected between node 30 and an output node 2, and a resistance element R30 connected between output node 2 and a ground line having a resistance R30. MOS transistor Q30 has its back-gate and source connected to node 30 and its gate and drain connected to output node 2. Resistance value R30 of resistance element R30 is set sufficiently larger than equivalent resistance value of MOS transistor Q30, and MOS transistor Q30 performs a diode operation. If the resistance value of resistance R30 is sufficiently high and the current flowing through these MOS transistor Q30 and resistance element R30 can be neglected as compared to the current flowing through MOS transistor Q2, a voltage V0 is generated to output node 2, which is expressed by the following equation (16).

$$\begin{aligned} V0 &= V30+VTP30 \\ &= (\beta 1/\beta 2)^{1/2}(VTP1-VTP3)-(VTP2-VTP30) \end{aligned} \quad (16)$$

Here, VTP30 represents the threshold voltage of MOS transistor Q30.

In equation (16), the second term at the right side is the difference between the threshold voltages of p channel MOS transistors Q2 and Q30. Accordingly, dependency of threshold voltages VTP2 and VTP30 of these MOS transistors Q2 and Q30 upon temperature is canceled, so that the dependency of output voltage V0 upon temperature can be reduced correspondingly.

In addition, in the structure shown in FIG. 6, resistance element R1 and/or resistance element R30 can be replaced by an MOS transistor which operates in a resistance mode (see FIG. 4).

Modification

Figure 7:
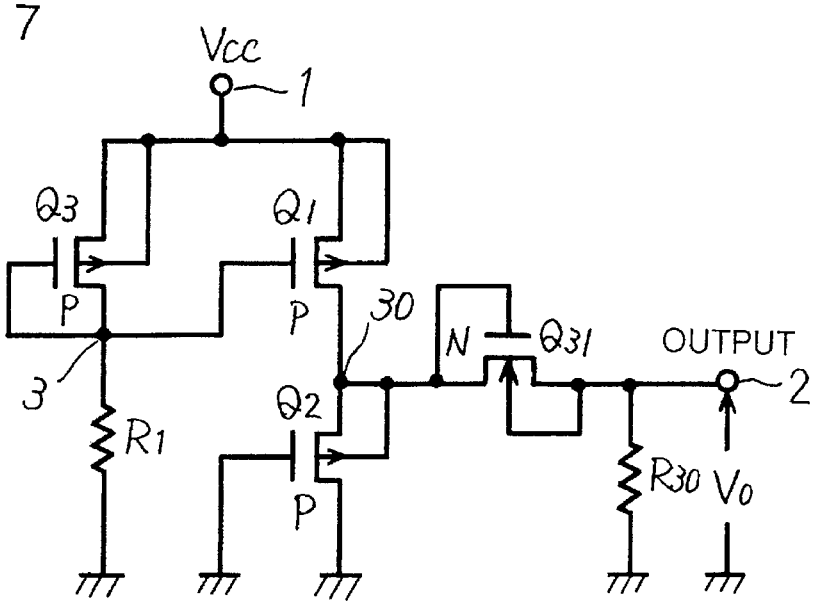
FIG. 7 shows a modification of the second embodiment of the present invention.

FIG. 7 shows a modification of the second embodiment according to the present invention. In a reference voltage generating circuit of FIG. 7, an enhancement type n channel MOS transistor Q31 is provided instead of p channel MOS transistor Q30 for cancellation of the dependency upon temperature shown in FIG. 6. This MOS transistor Q31 has its gate and drain connected to a node 30 and its back-gate and source connected to an output node 2. Other portions of the structure is the same as those shown in FIG. 6, and the corresponding parts are denoted by identical reference numerals. In the structure shown in FIG. 7, voltage V0 represented by the following equation (17) is generated to output node 2.

$$\begin{aligned} V0 &= V30-VTN31 \\ &= (\beta 1/\beta 2)^{1/2}(VTP1-VTP3)-(VTP2+VTN31) \end{aligned} \quad (17)$$

Here, VTN31 represents the threshold voltage of MOS transistor Q31. The second term at the right side of equation (17) is the algebraic sum of the threshold voltage VTP2 of p channel MOS transistor Q2 and the threshold voltage VTN31 of n channel MOS transistor Q31. Accordingly, the dependency of the threshold voltages upon temperature is canceled and the dependency of output voltage V0 upon temperature can be reduced correspondingly.

In the structure shown in FIG. 7, a resistance element R1 and/or a resistance element R30 may be formed of resistance-connected MOS transistors (see FIG. 4).

As shown in FIGS. 6 and 7, by connecting a diode connected MOS transistor and resistance element in parallel with Q2 MOS transistor between output node 2 and a ground line and taking out an output voltage from the connection point of this diode connected MOS transistor and the resistance element, output voltage V0 having the dependency upon temperature reduced and no dependency upon supply voltage Vcc can be generated.

Embodiment 3

Figure 8:
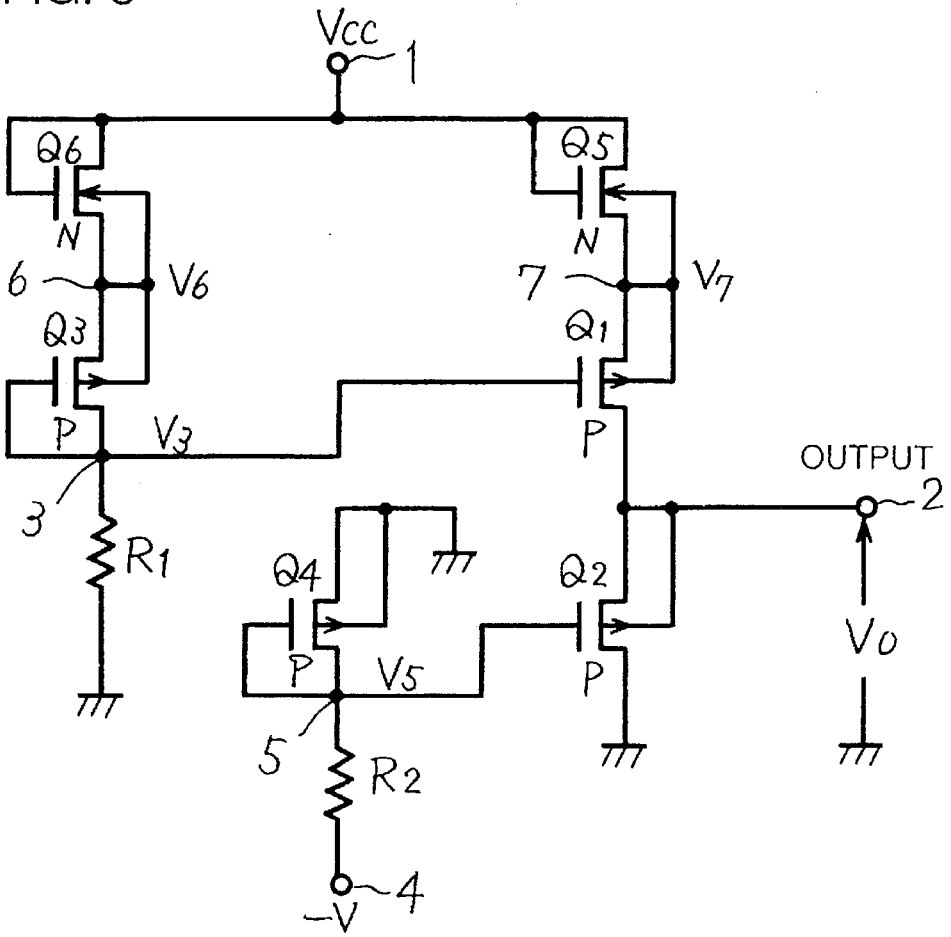
FIG. 8 is a diagram showing a structure of a reference voltage generating circuit in accordance with a third embodiment of the present invention.

FIG. 8 is a diagram showing a structure of a third embodiment of the reference voltage generating circuit in accordance with the present invention. Referring to FIG. 8, the reference voltage generating circuit includes a p channel MOS transistor Q1 connected between a node 7 and an output node 2, a p channel MOS transistor Q3 connected between a node 6 and a node 3 for setting the gate voltage of MOS transistor Q1, a resistance element R1 connected between node 3 and a ground line, a p channel MOS transistor Q2 connected between output node 2 and the ground line, a p channel MOS transistor Q4 connected between the ground line and node 5 for setting the gate potential of MOS transistor Q2, and a resistance element R2 connected between node 5 and a negative potential node 4. The structure including these MOS transistors Q1 to Q4 and resistance elements R1 and R2 is the same as that shown in FIG. 1.

The reference voltage generating circuit shown in FIG. 8 further includes an enhancement type n channel MOS transistor Q6 connected between node 6 and a power supply node 1, and an enhancement type n channel MOS transistor Q5 connected between power supply node 1 and node 7. MOS transistors Q5 and Q6 have threshold voltages VTN5 and VTN6, respectively. Conductance coefficient β5 of MOS transistor Q5 is set sufficiently larger than conductance coefficients β1 and β2 of MOS transistors Q1 and Q2. In addition, resistance value of resistance element R1 is set sufficiently larger than respective equivalent resistance value of MOS transistors Q3 and Q6. The operation of the circuit will now be described.

With the conditions described above, MOS transistors Q5 and Q6 operate in a diode mode, and voltages V6 and V7 of nodes 6 and 7 are expressed in the following equations (18) and (19), respectively.

$$V6=Vcc-VTN6 \quad (18)$$

$$V7=Vcc-VTN5 \quad (19)$$

Thus, voltage V3 of node 3 is provided by the following equation (20).

$$V3=Vcc-VTN6+VTP3 \quad (20)$$

When MOS transistors Q1 and Q2 operate in a saturation region, values of drain current IDS at MOS transistors Q1 and Q2 are obtained by the following equations (21) and (22), respectively.

$$IDS = (\beta 1/2)\ \{V3 - (Vcc - VTN5) - VTP1\}^2 \quad (21)$$

$$= (\beta 1/2)\ \{(VTN5 - VTN6) + (VTP3 - VTP1)\}^2$$

$$= (\beta 2/2)\ (VTP4 - V0 - VTP2)^2 \quad (22)$$

In view of equations (21) and (22), output voltage V0 is obtained by the following equation (23).

$$V0=(\beta 1/\beta 2)^{1/2}\{(VTN6-VTN5)+(VTP1-VTP3)\}-(VTP2-VTP4) \quad (23)$$

Since the first, second, and third terms at the right side of equation (23) each are expressed by the difference between the threshold voltages, the dependency of output voltage V0 on temperature is significantly reduced.

In particular, when threshold voltages VTP1, VTP2, VTP3, and VTP4 of p channel MOS transistors Q1, Q2, Q3, and Q4 are all equal to each other and threshold voltages VTN5 and VTN6 of n channel MOS transistors Q5 and Q6 are different from each other, output voltage V0 is expressed by the following equation (24).

$$V0=(\beta 1/\beta 2)^{1/2}(VTN6-VTN5) \quad (24)$$

Accordingly, in a semiconductor device having one threshold voltage for p channel MOS transistors and two threshold voltages for n channel MOS transistors, it is possible to implement a circuit generating a reference voltage in which the dependency upon both temperature and supply voltage is reduced due to the difference between the threshold voltages of n channel MOS transistors.

In the structure shown in FIG. 8, a similar effect can also be obtained even when the locations of MOS transistor Q3 and MOS transistor Q6 are exchanged. Back-gates of MOS transistors Q1 and Q3 are connected to node 7 and 6, respectively, in order to eliminate the influence by the back-gate effect of MOS transistors so that respective threshold voltages VTP1 and VTP3 of MOS transistors Q1 and Q3 are maintained at a stable constant value.

Modification

Figure 9:
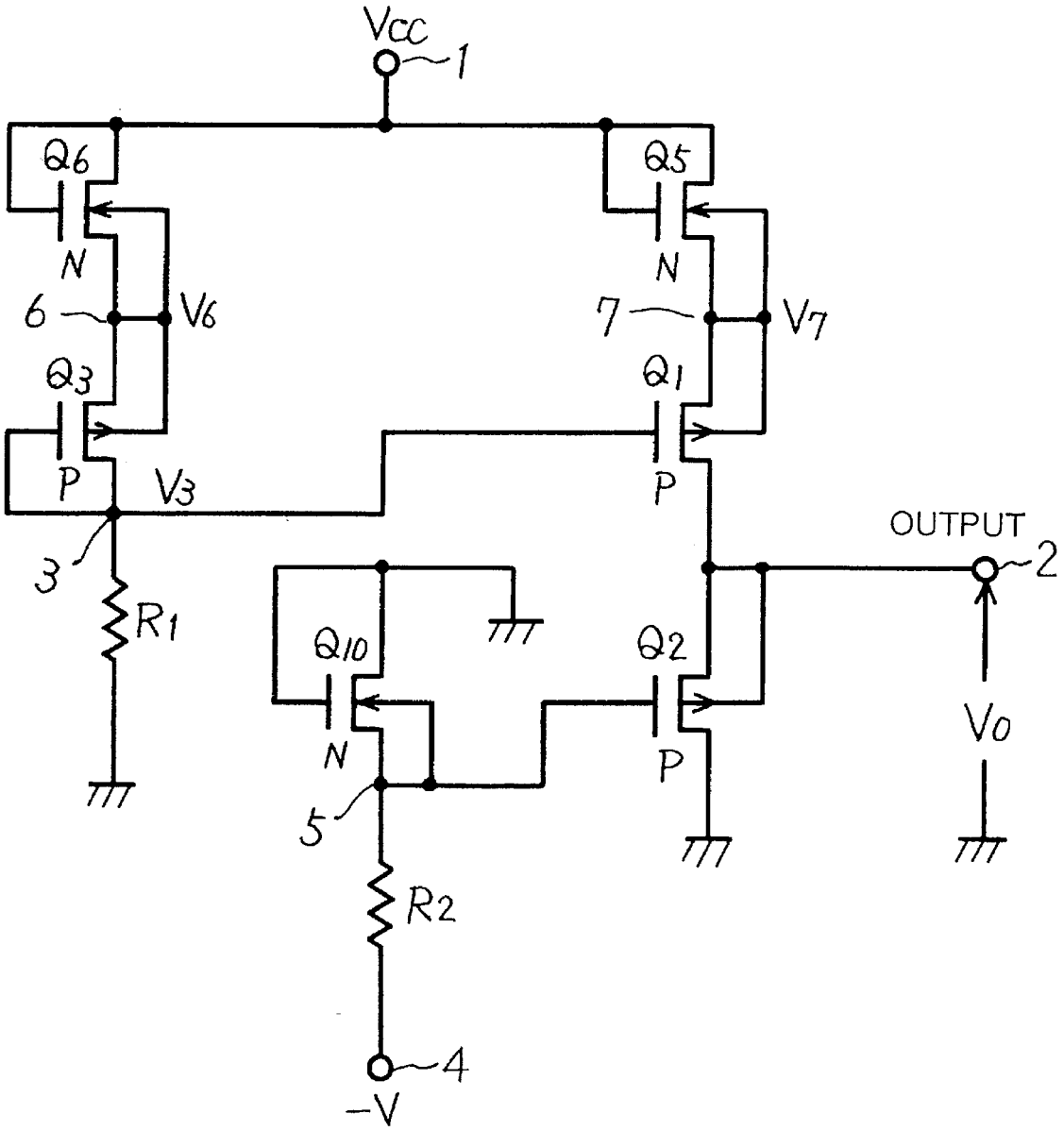
FIG. 9 shows a modification of the reference voltage generating circuit in accordance with the third embodiment of the present invention.

FIG. 9 shows a modification of the reference voltage generating circuit according to the third embodiment of the present invention. In the reference voltage generating circuit of FIG. 9, an enhancement type n channel MOS transistor Q10 having a threshold voltage VTN10 is employed in place of p channel MOS transistor Q4 of the reference voltage generating circuit shown in FIG. 8. Other portions are the same as those in the structure of the reference voltage generating circuit shown in FIG. 8. MOS transistor Q10 has its gate and drain connected to a ground line, and its source and back-gate to a node 5.

Resistance value R2 of a resistance element R2 is set to be sufficiently higher than the equivalent resistance value of MOS transistor Q10. At this time, MOS transistor Q10 operates in a diode mode and voltage V5 of node 5 is obtained by −VTN5. Accordingly, by replacing −VTN10 by VTP4 in equation (23), an output voltage V0 expressed by the following equation (25) is generated at an output node 2.

$$V0=(\beta 1/\beta 2)^{1/2}\{(VTN6-VTN5)+(VTP1-VTP3)\}-(VTP2+VTN10) \quad (25)$$

In all first, second and third terms at the right side of equation (25), the dependency of threshold voltage on temperature is canceled so that the dependency of the output voltage V0 upon temperature is significantly reduced.

Embodiment 4

Figure 10:
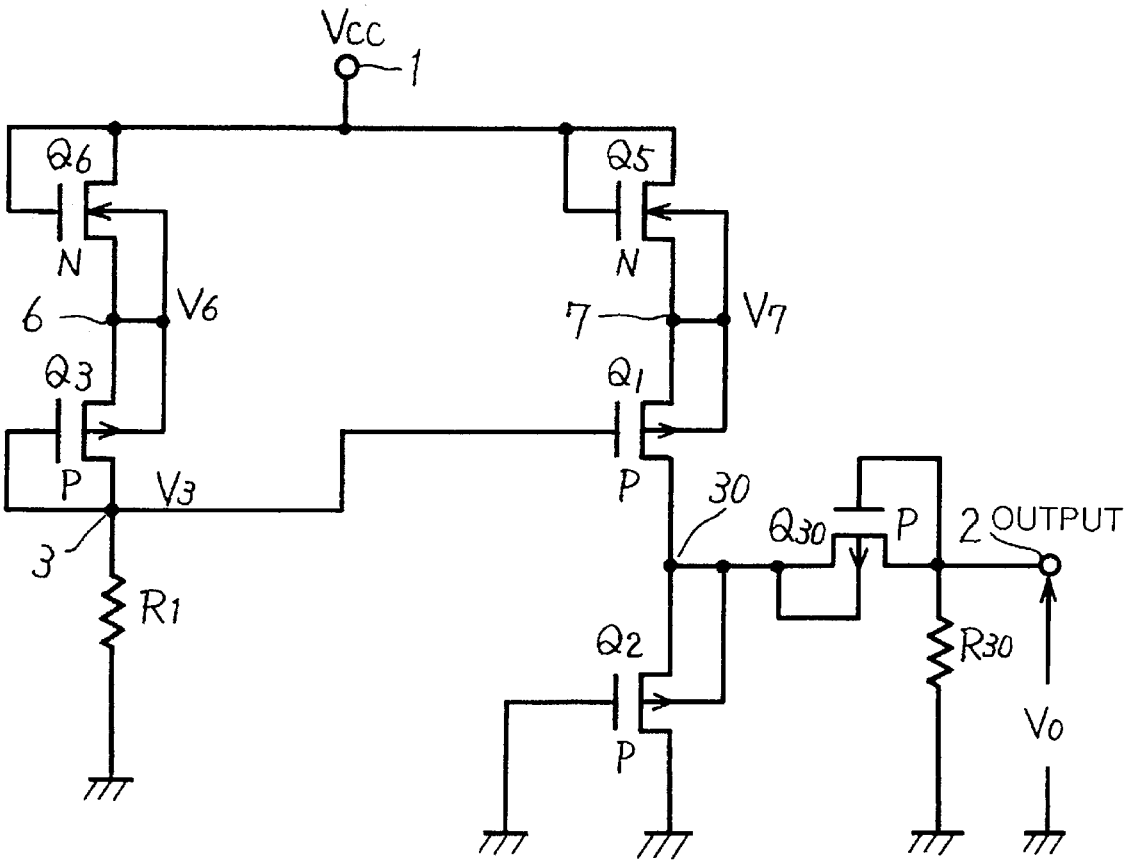
FIG. 10 is a diagram showing a structure of a reference voltage generating circuit in accordance with a fourth embodiment of the present invention.

FIG. 10 is a diagram showing a structure of a reference voltage generating circuit in accordance with a fourth embodiment of the present invention. Referring to FIG. 10, the reference voltage generating circuit includes a p channel MOS transistor Q3 connected between a node 6 and a node 3 and operating in a diode mode, a p channel MOS transistor Q1 connected between a node 7 and a node 30 and supplying current from node 7 to node 30 according to a voltage V3 on node 3, a p channel MOS transistor Q2 connected between node 30 and a ground line having its gate connected to the ground line and discharging current from node 30 to the ground line, and a resistance element R1 connected between node 3 and the ground line having a resistance value R1.

MOS transistor Q3 has its gate and drain connected to node 3. MOS transistors Q1 to Q3 have their back-gates connected to their respective sources so as to eliminate the back-gate effect.

The reference voltage generating circuit further includes an enhancement type n channel MOS transistor Q6 connected between a power supply node 1 and node 6, an enhancement type n channel MOS transistor Q5 connected between power supply node 1 and node 7, an enhancement type p channel MOS transistor Q30 connected between node 30 and an output put node 2, and a resistance element R30 connected between output node 2 and the ground line. MOS transistors Q5 and Q6 have their respective gates and drains both connected to power supply node 1. MOS transistor Q30 has its gate and drain connected to output node 2, and its back-gate and source to node 30.

Conductance coefficient β5 of MOS transistor Q5 is set sufficiently larger than conductance coefficients β1 and β2 of MOS transistors Q1 and Q2. Resistance value R1 of resistance element R1 is set sufficiently higher than respective equivalent resistance values of MOS transistors Q3 and Q6. In addition, resistance value R30 of resistance element R30 is set sufficiently higher than the equivalent resistance value of MOS transistor Q30. Under these conditions, all of MOS transistors Q3, Q5, Q6, and Q30 operate in a diode mode. The operation of the reference voltage generating circuit will now be described.

Due to clamp operation of MOS transistor Q30, output voltage V0 of output node 2 is given by the following equation (26):

$$V0=V30+VTP30 \quad (26)$$

where V30 represents the voltage of node 30 and VTP30 represents threshold voltage of MOS transistor Q30. Voltage V30 at node 30 is provided by the following equation (27), by deleting the term which indicates threshold voltage VTP4 of MOS transistor Q4 in equation (23).

$$V30=(\beta 1/\beta 2)^{1/2}\{(VTN6-VTN5)+(VTP1-VTP3)\}-VTP2 \quad (27)$$

Thus, from equations (26) and (27), output voltage V0 can be obtained which is expressed by the following equation (28).

$$V0=(\beta 1/\beta 2)^{1/2}\{(VTN6-VTN5)+(VTP1-VTP3)\}-(VTP2-VTP30) \quad (28)$$

The first, second and third terms at the right side of equation (28) each are expressed by the difference between the threshold voltages having the same polarity and therefore their dependency upon temperature is canceled. Thus, the dependency of output voltage V0 on temperature is sufficiently reduced. Also, in this structure shown in FIG. 10, when threshold voltages of p channel MOS transistors Q1, Q2, Q3 and Q30 are all equal to each other and only threshold voltages of MOS transistors Q5 and Q6 are different from each other, output voltage V0 is obtained which is provided in the following equation (28').

$$V0=(\beta 1/\beta 2)^{1/2}(VTN6-VTN5) \quad (28')$$

Also, in this structure shown in FIG. 10, resistance element R1 and/or resistance element R30 may be replaced by MOS transistors operating in a resistance mode.

Modification

Figure 11:
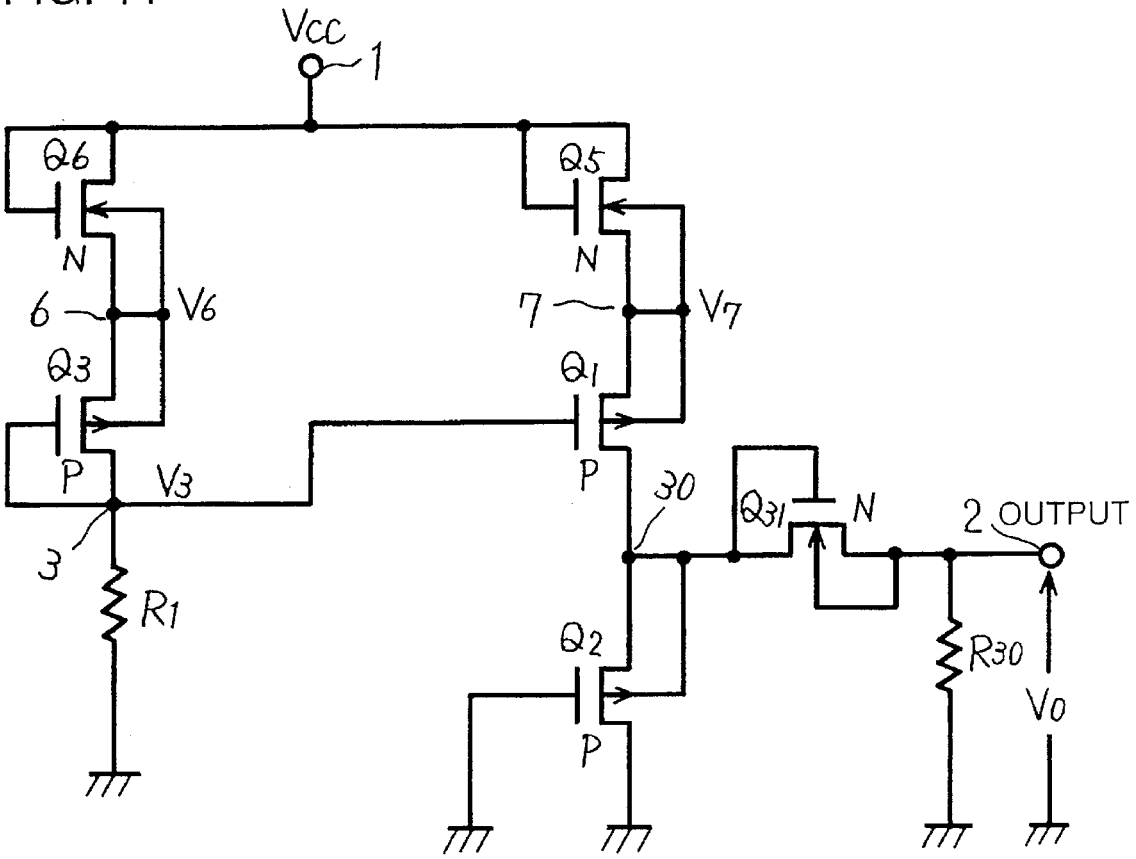
FIG. 11 shows a modification of the reference voltage generating circuit in accordance with the fourth embodiment of the present invention.

FIG. 11 shows a modification of the reference voltage generating circuit according to the fourth embodiment of the present invention. In the reference voltage generating circuit shown in FIG. 11, an enhancement type n channel MOS transistor Q31 is employed instead of p channel MOS transistor Q30 connected to output node 2 in FIG. 10. MOS transistor Q31 has its gate and drain connected to a node 30, and its back-gate and source connected to an output node 2. Other portions are identical to those of the structure shown in FIG. 10 and corresponding portions are denoted by the same reference numerals.

Resistance value R30 of a resistance element R30 is set sufficiently higher than the equivalent resistance value of MOS transistor Q31. In this case, only a slight current flows into MOS transistor Q31, and MOS transistor Q31 operates in a diode mode. Then, output voltage V0 of output node 2 is provided by the following equation (29).

$$V0=V30-VTN31 \quad (29)$$

Here, VTN31 indicates threshold voltage of MOS transistor Q31 and V30 indicates voltage of node 30. Voltage V30 of node 30 is provided by the equation (27) described previously. Accordingly, output voltage V0 appearing at output node 2 is expressed in the following equation (30).

$$V0=(\beta 1/\beta 2)^{1/2}\{(VTN6-VTN5)+(VTP1-VTP3)\}-(VTP2+VTN31) \quad (30)$$

In equation (30), the first and second terms at the right side are the difference between the threshold voltages having the same polarity and thus the dependency of the threshold voltages upon temperature is canceled. In addition, in the third term of equation (30), threshold voltages VTP2 and VTN31 are of different polarities and thus the dependency of the threshold voltages upon temperature is canceled. Therefore, the dependency of output voltage V0 on temperature can be sufficiently reduced also in the structure shown in this FIG. 11.

In the structure shown in FIG. 11, resistance element R1 and/or resistance element R30 may also be replaced by an MOS transistor operating in resistance mode.

Based upon the foregoing, in accordance with the fourth embodiment, output voltage V0 can be generated of which dependency upon temperature and supply voltage is sufficiently reduced. In particular, by setting all of the threshold voltages of p channel MOS transistors equal, the value of output voltage V0 can be set according to the difference between the threshold voltages of n channel MOS transistors connected to the power supply node, so that reference voltage V0 of a desired voltage level can be generated.

Embodiment 5

Figure 12:
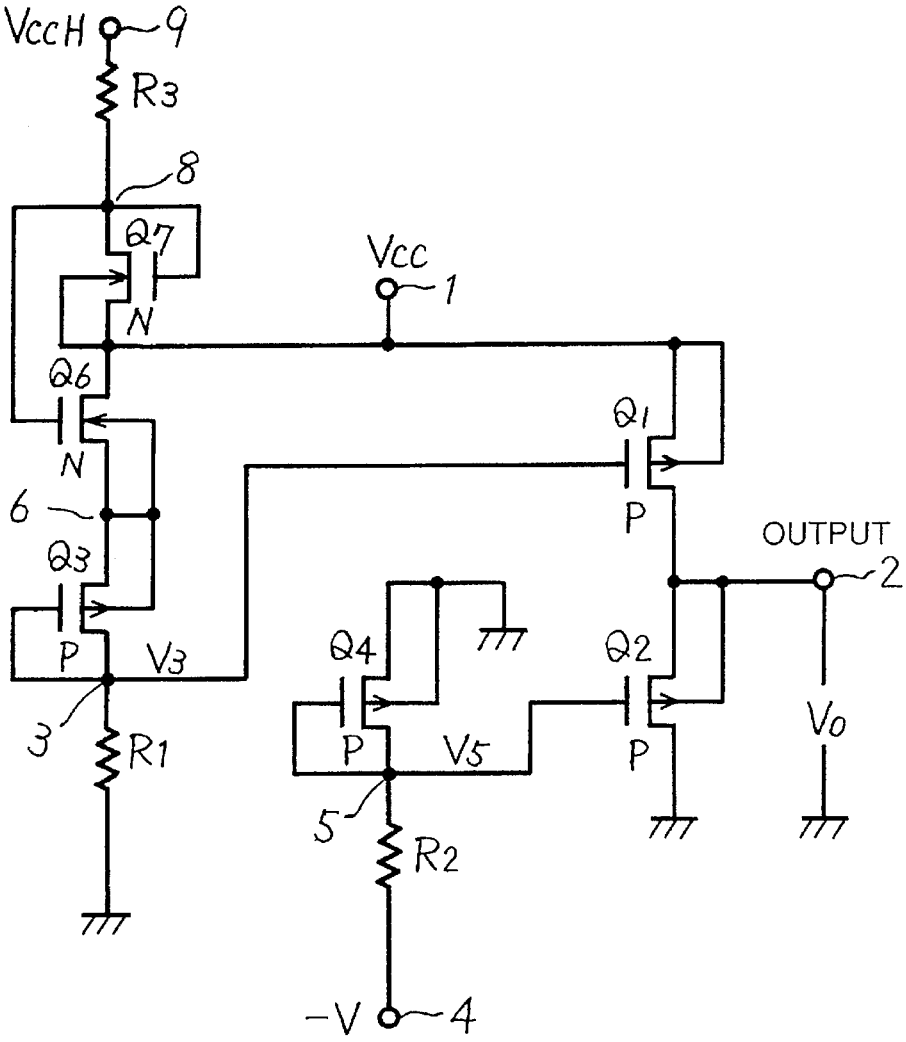
FIG. 12 is a diagram showing a structure of a reference voltage generating circuit in accordance with a fifth embodiment of the present invention.

FIG. 12 is a diagram showing a structure of a reference voltage generating circuit in accordance with a fifth embodiment of the present invention. Referring to FIG. 12, the reference voltage generating circuit includes an n channel MOS transistor Q3 connected between a node 6 and a node 3, a resistance element R1 connected between node 3 and a ground line, a p channel MOS transistor Q1 connected between a power supply node 1 and an output node 2 and supplying current from power supply node 1 to output node 2 according to a voltage V3 on node 3, a p channel MOS transistor Q4 connected between the ground line and a node 5, a resistance element R2 connected between node 5 and node 4 receiving negative potential −V, for example, and a p channel MOS transistor Q2 discharging current from output node 2 to the ground line according to potential V5 on node 5. MOS transistors Q3 and Q4 operate in a diode mode, and when conductive, cause voltage drops of the absolute values of their threshold voltages.

The reference voltage generating circuit further includes a resistance element R3 connected between a high power supply node receiving a high voltage VccH higher than supply voltage Vcc and a node 8, an enhancement type n channel MOS transistor Q7 connected between node 8 and power supply node 1, and an enhancement type n channel MOS transistor Q6 connected between power supply node 1 and node 6.

MOS transistor Q7 has its gate and drain connected to node 8 and its source and back-gate connected to power supply node 1. MOS transistor Q6 has its gate connected to node 8, its drain to power supply node 1, and its back-gate and source to node 6. The equivalent resistance value of MOS transistor Q7 is set sufficiently lower than the resistance value R3 of resistance element R3. Similarly, equivalent resistance value of MOS transistor Q6 is set to be sufficiently lower than resistance value R1 of resistance element R1. Operation of the reference voltage generating circuit will now be described.

Since equivalent resistance value of MOS transistor Q7 is sufficiently lower than resistance value R3 of resistance element R3, MOS transistor Q7 operates in a diode mode. Accordingly, voltage V8 of node 8 is provided by the following equation (31):

$$V8=Vcc+VTN7 \quad (31)$$

where VTN7 indicates the threshold voltage of MOS transistor Q7. Since equivalent resistance value of MOS transistor Q6 is sufficiently smaller than resistance value R1 of resistance element R1, MOS transistor Q6 has its gate-source voltage maintained at threshold voltage VTN6. Thus, voltage V6 of node 6 is given by the following equation (32).

$$\begin{aligned} V6 &= V8 - VTN6 \\ &= Vcc + VTN7 - VTN6 \end{aligned} \quad (32)$$

Similarly, since the equivalent resistance value of MOS transistor Q3 is sufficiently smaller than resistance value R1 of resistance element R1, this MOS transistor Q3 operates in a diode mode, and voltage V3 of node 3 is provided by the following equation (33).

$$V3 = V6 + VTP3 \quad (33)$$
$$= Vcc + VTN7 - VTN6 + VTP3$$

Voltage V5 of node 5 is equal to VTP4. Accordingly, values of drain current IDS flowing through MOS transistors Q1 and Q2 are provided respectively by following equations (34) and (35).

$$IDS = (\beta 1/2)\,(V3 - Vcc - VTP1)^2 \quad (34)$$
$$= (\beta 1/2)\,\{(VTN7 - VTN6) + (VTP3 - VTP1)\}^2$$
$$= (\beta 2/2)\,(VTP4 - V0 - VTP2)^2 \quad (35)$$

Thus, from equations (34) and (35), output voltage V0 can be obtained by the following equation (36).

$$V0=(\beta 1/\beta 2)^{1/2}\{(VTN7-VTN6)+(VTP1-VTP3)\}-(VTP2-VTP4) \quad (36)$$

The first, second and third terms at the right side of equation (36) each are represented by the difference between the threshold voltages, and thus, the dependency of the threshold voltage upon temperature is canceled, so that output voltage V0 having a less dependency on temperature is obtained.

In the structure shown in FIG. 12, a similar effect can also be obtained even when positions of MOS transistor Q3 and MOS transistor Q6 are exchanged.

In particular, when threshold voltages VTP1 to VTP4 of p channel MOS transistors Q1 to Q4 are all equal in value and threshold voltages of n channel MOS transistors Q6 and Q7 are different from each other, output voltage V0 is provided by the following equation (37).

$$V0=(\beta 1/\beta 2)^{1/2}(VTN7-VTN6) \quad (37)$$

In a semiconductor device having one threshold voltage for p channel MOS transistors and two threshold voltages for n channel MOS transistors, a reference voltage generating circuit with less dependencies upon temperature and upon power supply voltage can be implemented without increasing any manufacturing steps, by utilizing two threshold voltages of n channel MOS transistors.

In the structure shown in FIG. 12, resistance elements R1 and R2 may be replaced by MOS transistors operating in resistance mode.

High voltage VccH may be provided externally to node 9, but a circuit provided in the same semiconductor device may also be used to apply high voltage VccH to node 9.

Figure 13:
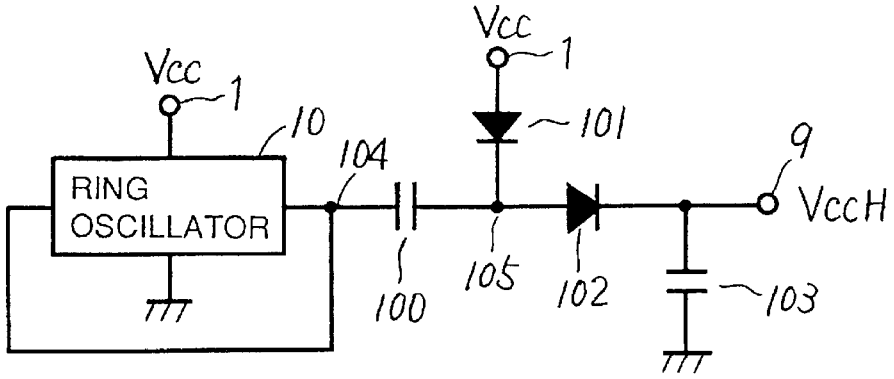
FIG. 13 shows an example of a circuit for generating a high voltage shown in FIG. 12.

FIG. 13 is a diagram showing an example of a structure of a circuit generating high voltage VccH within the semiconductor device. This high voltage generating circuit shown in FIG. 13 is generally employed when a high voltage which is higher than the power supply voltage is generated by using a charge pump operation of a capacitor.

Referring to FIG. 13, the high voltage generating circuit includes a ring oscillator 10 which operates with power supply voltage Vcc of power supply node 1 and ground voltage Vss of the ground line as its operating supply voltages so as to generate a pulse signal having a prescribed pulse width and period, a capacitor 100 connected between nodes 104 and 105 and conducting a potential change of node 104 to node 105 by capacitive coupling, a diode element 101 connected between a power supply node 1 and node 105, a diode element 102 connected between node 105 and node 9, and a stabilizing capacitor 103 for stabilization of the voltage at node 9.

Diode element 101 has its anode connected to power supply node 1, and its cathode connected to node 105. Diode element 102 has its anode connected to node 105 and cathode to node 9. Ring oscillator 10 includes a structure of an odd number of stages of cascaded inverter circuits. Diode elements 101 and 102 may be formed of MOS transistors. Operation of the high voltage generating circuit will now be described in brief.

When the pulse signal output from ring oscillator 10 is lowered from H level to L level, this potential change of the signal at node 104 is conducted to node 105. The potential of node 105 is thus lowered, but it is charged by diode element 101 to a voltage level of Vcc-VS. Here, VS represents a forward drop voltage of diode element 101. At this time, diode element 102 is turned off since voltage of node 9 is higher than that of node 105.

When the pulse signal transmitted from ring oscillator 10 to node 104 rises from L level to H level, potential of node 105 rises further by the value of Vcc due to the pulse at node 104. By this rise in voltage of node 105, diode element 102 is turned on and current flows from node 105 to node 9 (that is, one electrode node of capacitor 103), and the voltage level of this node 9 rises in accordance with the capacitance ratio of capacitor 100 to capacitor 103 (which ratio is usually 10 to 100). When voltage difference between node 105 and node 9 is VS, diode element 102 is turned off. By repeating this operation, the voltage level of high voltage VccH at node 9 finally reaches a voltage level expressed in the following equation (38).

$$VccH=2\cdot Vcc-2\cdot VS \quad (38)$$

If Vcc=5 V and VS=0.7 V, then high voltage VccH is 8.6 V which is a voltage level sufficiently higher than power supply voltage Vcc. The current flowing through resistance R3 connected to node 9 to which this high voltage VccH is applied is made extremely low (in order to implement a diode operation of MOS transistor Q7). Accordingly, current driving capability of this high voltage generating circuit can be sufficiently small, to sufficiently reduce the area occupied by the high voltage generating circuit shown in FIG. 13.

Also, a boosted circuit used for generating a boosted word line signal or the like in a dynamic type semiconductor device may also be used as a circuit for generating this high voltage VccH. More specifically, if a circuit which internally generates a high voltage is provided in a semiconductor device, that circuit can be utilized.

Modification

Figure 14:
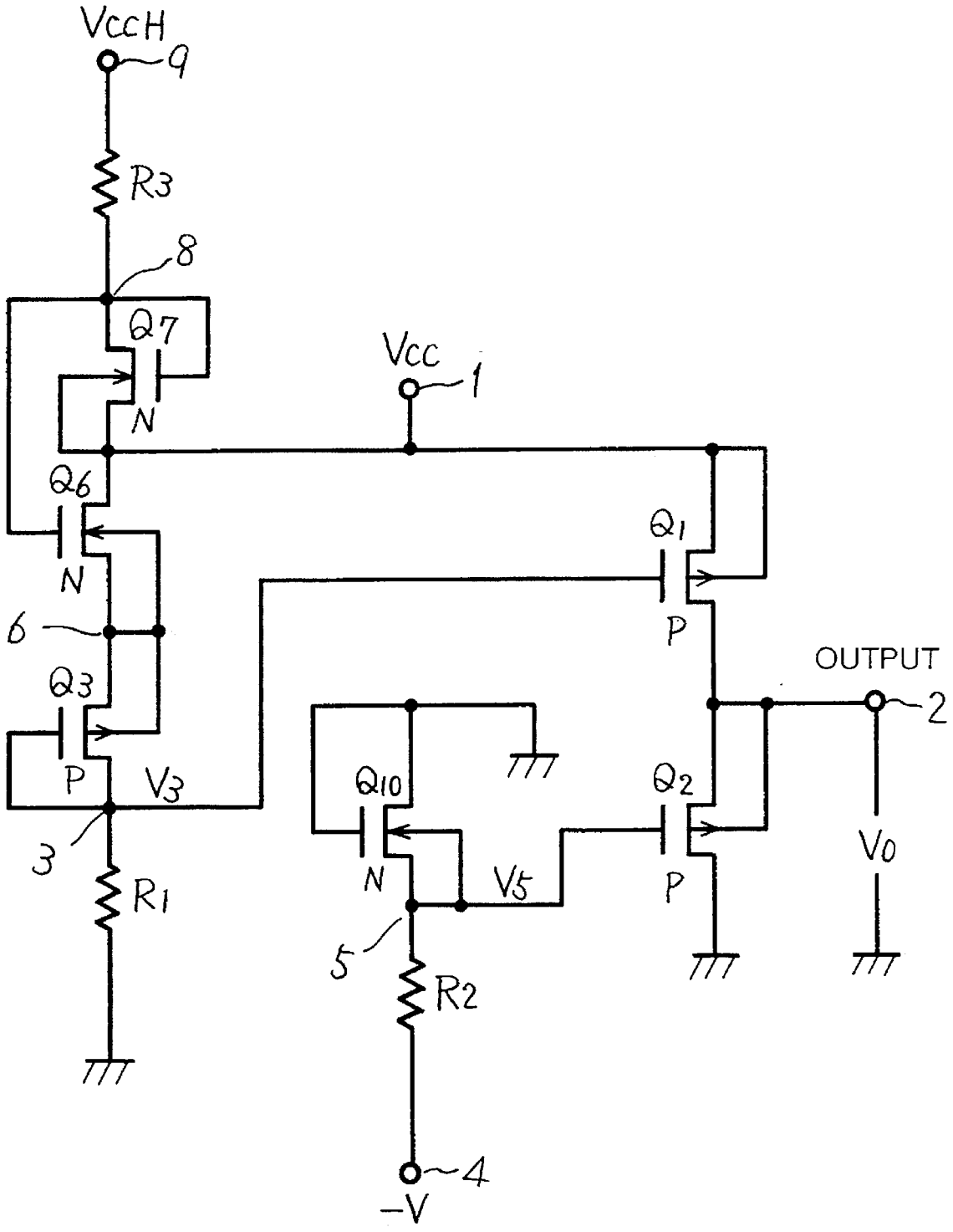
FIG. 14 shows a modification of the fifth embodiment in accordance with the present invention.

FIG. 14 shows a structure of a modification of the reference voltage generating circuit according to the fifth embodiment of the present invention. In the reference voltage generating circuit of FIG. 14, an n channel MOS transistor Q10 is employed instead of p channel MOS transistor Q4 in the reference voltage generating circuit shown in FIG. 12. Other portions are the same as those in the structure shown in FIG. 12 and the corresponding portions are denoted by identical reference numerals.

MOS transistor Q10 has its gate and drain connected to a ground line, and its back-gate and source connected to a node 5. MOS transistor Q10 has a threshold voltage VTN10 and an equivalent resistance value sufficiently smaller than resistance value R2 of a resistance element R2.

When reference voltage generating circuit of FIG. 14 is used, voltage V0 appearing at output node 2 can be obtained by replacing VTP4 in equation (36) by −VTN10. Thus, output voltage V0 is provided by the following equation.

$$V0=(\beta1/\beta2)^{1/2}\{(VTN7-VTN6)+(VTP1-VTP3)\}-(VTP2+VTN10) \quad (39)$$

As can be seen from the above equation (39), employment of this reference voltage generating circuit shown in FIG. 14 can also lead to a sufficient reduction in dependencies of output voltage V0 upon power supply voltage and on temperature.

In the structure shown in FIG. 14, resistance elements R1 and R2 may also be replaced by MOS transistors operating in a resistance mode.

Based upon the foregoing, use of the structure of this fifth embodiment can also result in the generation of a stable voltage V0 with reduced dependency on temperature and no dependency on power supply voltage Vcc.

Embodiment 6

Figure 15:
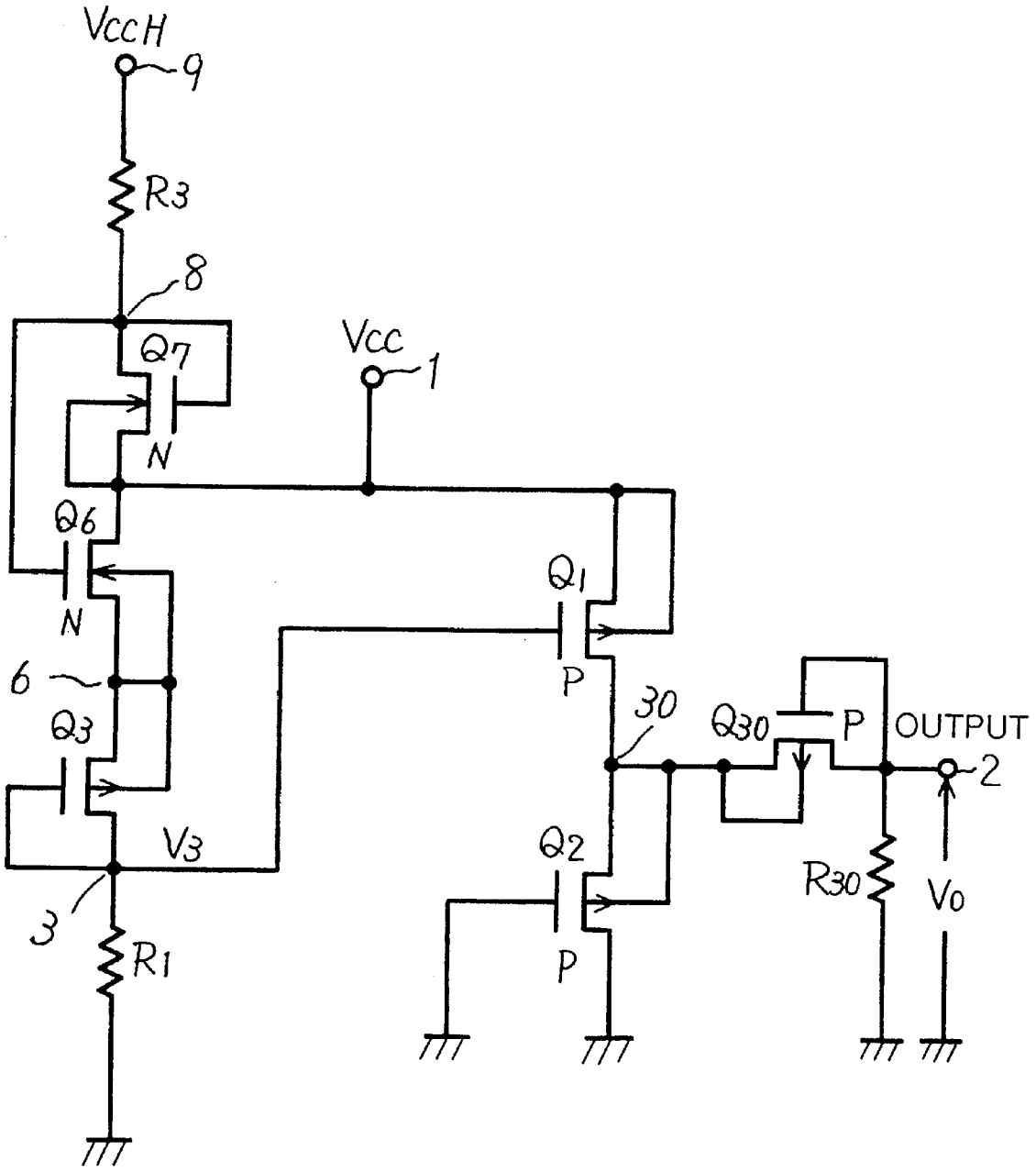
FIG. 15 is a diagram showing a structure of a sixth embodiment of the present invention.

FIG. 15 is a diagram showing a structure of a reference voltage generating circuit in accordance with a sixth embodiment of the present invention. In the reference voltage generating circuit shown in FIG. 15, an MOS transistor Q2 has its gate connected to a ground line. In order to compensate for the dependency upon temperature of the voltage at a node 30, which depending occurs owing to this connection between the gate of MOS transistor Q2 and the ground line, a p channel MOS transistor Q30 is connected between node 30 and an output node 2, and a resistance element R30 is connected between output node 2 and the ground line. MOS transistor Q30 has its back-gate and source connected to node 30 and its gate and drain connected to output node 2. Equivalent resistance value of MOS transistor Q30 is made sufficiently smaller than the resistance value R30 of resistance element R30. Other portions are the same as those in the structure of the reference voltage generating circuit shown in FIG. 14, and the corresponding parts are denoted by identical reference numerals. The operation of the circuit will be described next.

Since MOS transistor Q30 operates in a diode mode, voltage V0 of output node 2 is provided by the following equation (40).

$$V0=V30+VTP30 \quad (40)$$

Voltage V30 of node 30 is obtained by omitting the term of threshold voltage VTP4 in equation (36).

$$V30=(\beta1/\beta2)^{1/2}\{(VTN6-VTN5)+(VTP1-VTP3)\}-VTP2 \quad (41)$$

Thus, output voltage V0 expressed by equations from (40) and (41) to the following equation (42) is generated at output node 2.

$$V0=(\beta1/\beta2)^{1/2}\{(VTN6-VTN5)+(VTP1-VTP3)\}-(VTP2-VTP30) \quad (42)$$

As can be seen from equation (42), the first, second and third terms at the right side each are shown by the difference between the threshold voltages of the MOS transistors and thus the dependency of the threshold voltage upon temperature is canceled in each term. Therefore, the dependency of output voltage V0 upon temperature can be reduced sufficiently.

In the structure shown in FIG. 15, resistance element R30 may also be replaced by an MOS transistor operating in a resistance mode.

Modification

Figure 16:
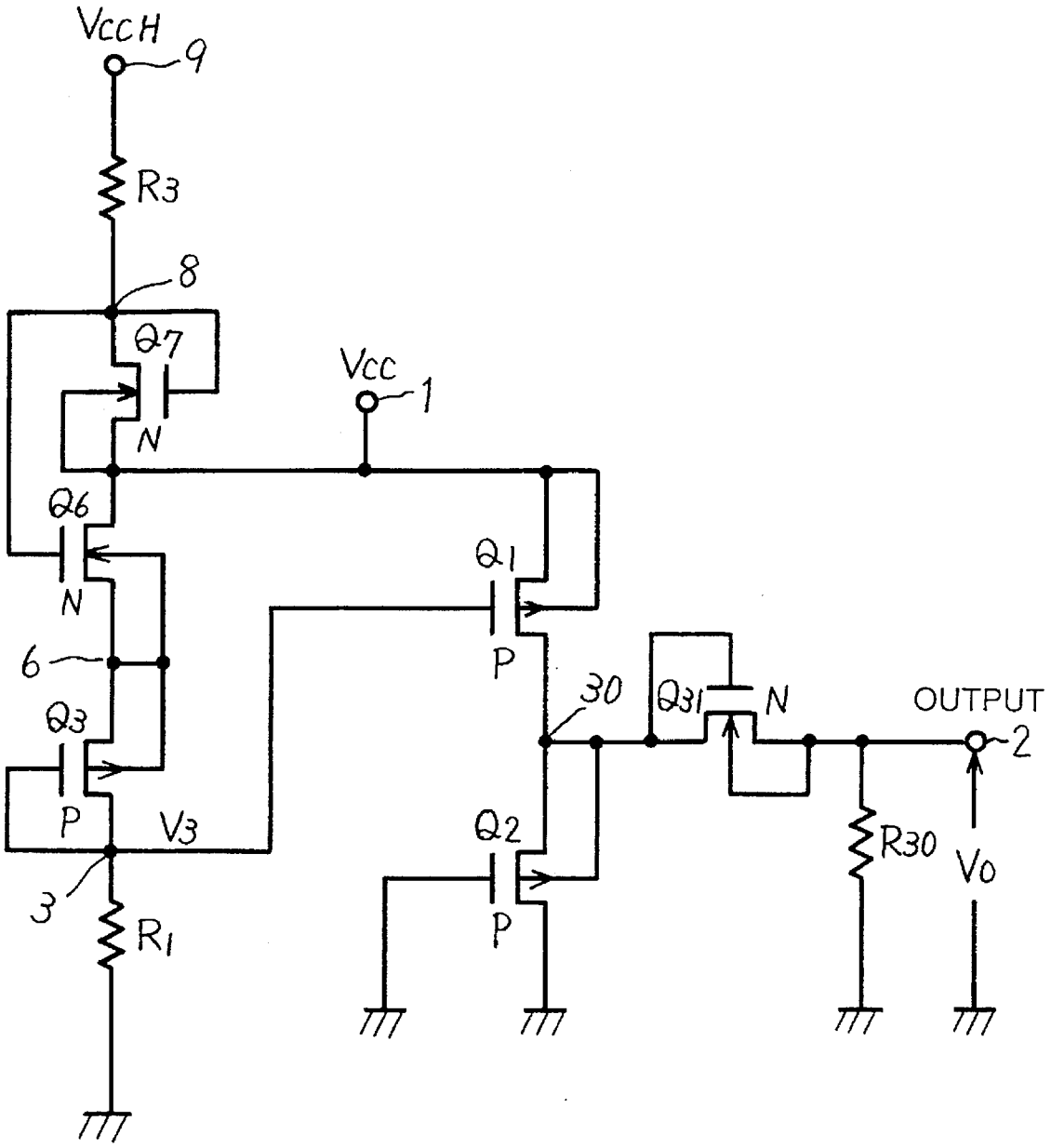
FIG. 16 shows a modification of the sixth embodiment of the present invention.

FIG. 16 shows a structure of a modification of the sixth embodiment of the present invention. In the reference voltage generating circuit shown in FIG. 16, p channel MOS transistor Q30 connected to output node 2 in the structure of FIG. 15 is replaced by an n channel MOS transistor Q31. Other portions are the same as those in the structure shown in FIG. 15, and the corresponding parts are denoted by identical reference numerals. The n channel MOS transistor Q31 has its gate and drain connected to a node 30 and its back-gate and source connected to output node 2. Equivalent resistance value of MOS transistor Q31 is made sufficiently lower than the resistance value of a resistance element R30. Thus, in this situation, a relationship indicated by the following equation (43) holds for output voltage V0 appearing at output node 2 and voltage V30 at node 30.

$$V0=V30-VTN31 \quad (43)$$

Voltage V30 is obtained by deleting the term of threshold voltage VTP4 of MOS transistor Q4 from equation (36).

$$V30=(\beta1/\beta2)^{1/2}\{(VTN7-VTN6)+(VTP1-VTP3)\}-VTP2 \quad (44)$$

From equations (43) and (44), the following equation (45) is obtained.

$$V0=(\beta1/\beta2)^{1/2}\{(VTN7-VTN6)+(VTP1-VTP3)\}-(VTP2+VTN31) \quad (45)$$

As can be seen from the above equation (45), the dependency of the threshold voltages upon temperature is canceled in all of the first, second and third terms at the right side and thus the dependency of output voltage V0 upon temperature can be reduced.

In the structure shown in FIG. 16, resistance elements R1 and R30 may also be replaced by MOS transistors operating in a resistance mode.

Thus, a stable reference voltage with less dependency upon temperature and no dependency upon the power supply voltage can be produced also in the reference voltage generating circuit in accordance with this sixth embodiment.

Embodiment 7

Figure 17:
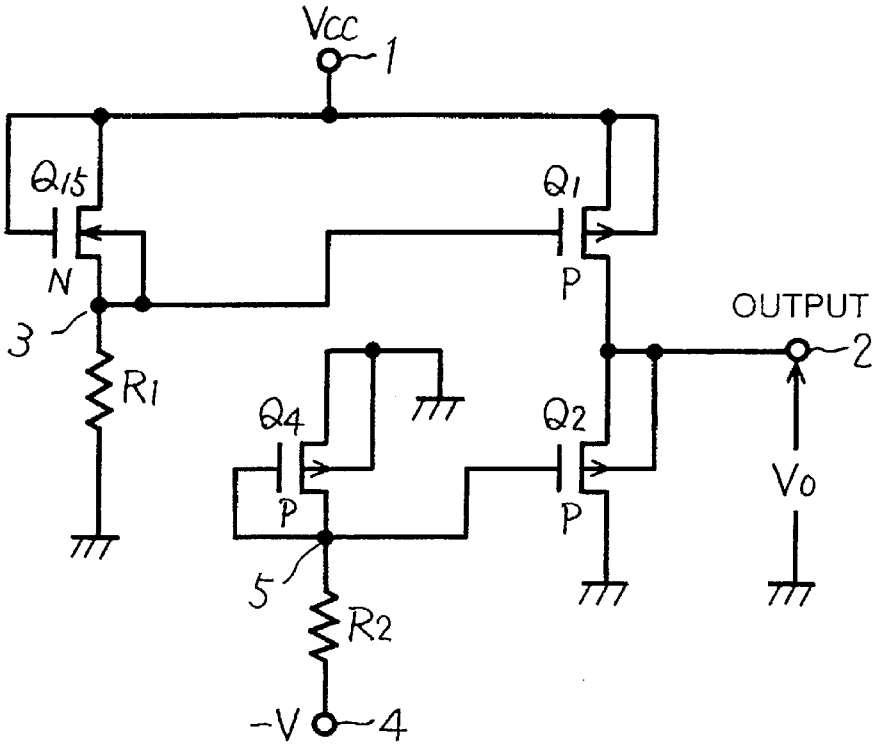
FIG. 17 is a diagram showing a structure of a reference voltage generating circuit in accordance with the seventh embodiment of the present invention.

FIG. 17 is a diagram showing a structure of a reference voltage generating circuit in accordance with a seventh embodiment of the present invention. In the reference voltage generating circuit shown in FIG. 17, an n channel MOS transistor Q15 is employed instead of p channel MOS transistor Q3 in the reference voltage generating circuit of FIG. 1. MOS transistor Q15 has its gate and drain connected to a power supply node 1 and its back-gate and source connected to a node 3. Other portions are the same as those in the structure of the reference voltage generating circuit shown in FIG. 2 and the corresponding parts are denoted by identical reference numerals.

Equivalent resistance value of MOS transistor Q15 is made sufficiently smaller than resistance value of a resistance element R1. Accordingly, MOS transistor Q15 operates in a diode mode and voltage V3 of node 3 is given by the following equation (46).

$$V3=Vcc-VTN15 \quad (46)$$

Meanwhile, voltage V5 of a node 5 is equal to threshold voltage VTP4 of an MOS transistor Q4. Accordingly, values of drain current IDS flowing through MOS transistors Q1 and Q2 are provided by the following equations (47) and (48), respectively.

$$IDS = (\beta1/2)\,(V3 - Vcc - VTP1)^2 \quad (47)$$

-continued $$= (\beta 2/2)\,(V5 - V0 - VTP2)^2 \quad (48)$$

From the equations (47) and (48), $$IDS = (\beta 1/2)\,(-VTN15 - VTP1)^2 \quad (49)$$

$$= (\beta 2/2)\,(VTP4 - V0 - VTP2)^2 \quad (50)$$

are obtained.

From equations (49) and (50), output voltage V0 is provided by the following equation (51).

$$V0=(\beta 1/\beta 2)^{1/2}(VTN15+VTP1)-(VTP2-VTP4) \quad (51)$$

In equation (51), the first term at the right side is the algebraic sum of the threshold voltages of an n channel MOS transistor and a p channel MOS transistor, and the second term is the difference between the threshold voltages of p channel MOS transistors, and in both of the terms the dependency of the threshold voltages upon temperature is canceled and the dependency upon temperature of output voltage V0 is reduced.

In particular, if an n channel MOS transistor is used for setting the gate voltage of MOS transistor Q1 which in turn supplies current to this output node, an advantage is obtained as described below. That is, a desired output voltage can be obtained even when p channel MOS transistors and n channel MOS transistors each have one kind of threshold voltage. For example, if the respective threshold voltages of p channel MOS transistors and n channel MOS transistors are VTP and VTN, in accordance with equation (51), the expression of output voltage V0 is converted to the following equation (52).

$$V0=(\beta 1/\beta 2)^{1/2}(VTN+VTP) \quad (52)$$

In a semiconductor device, it is more advantageous if the number of the manufacturing steps is reduced as many as possible, from the view point of the cost. If there are many kinds of threshold voltages, there would be additional steps in the process of ion implantation and formation of gate insulating film, and correspondingly, the number of manufacturing steps is increased, which leads to higher cost. However, as shown in equation (51), according to the structure in which a stable output voltage V0 is generated by using only one threshold voltage for p channel MOS transistors and for n channel MOS transistors, respectively, additional steps for changing the threshold voltages in the usual CMOS circuit (that is, a circuit in which both p channel MOS transistors and n channel MOS transistors are employed) become unnecessary, and correspondingly, the cost is reduced. Therefore, this structure of the seventh embodiment shown in FIG. 17 is quite advantageous in that the number of manufacturing steps can be reduced and the cost of semiconductor device including this reference voltage generating circuit can be suppressed.

Modification

Figure 18:
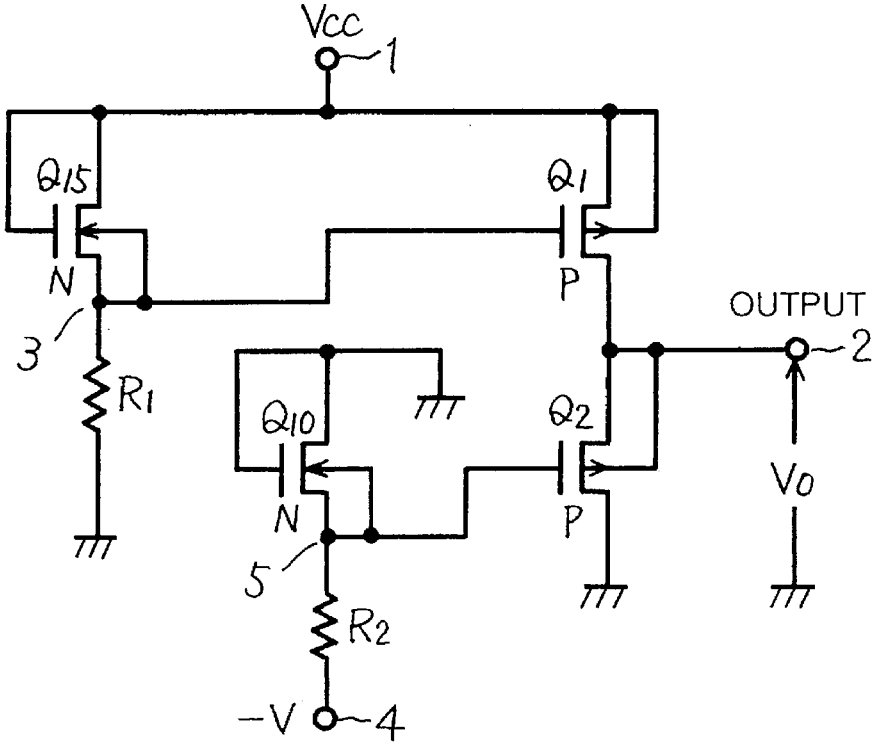
FIG. 18 shows a modification of the seventh embodiment of the present invention.

FIG. 18 shows a modification of the reference voltage generating circuit according to the seventh embodiment of the present invention. The reference voltage generating circuit shown in FIG. 18 employs an n channel MOS transistor Q10 instead of p channel MOS transistor Q4 (for setting the gate voltage of MOS transistor Q2) in the structure of the reference voltage generating circuit shown in FIG. 17. MOS transistor Q10 has its gate and drain connected to a ground line and its back-gate and source to a node 5. Equivalent resistance value of MOS transistor Q10 is set at a value which in turn is sufficiently smaller than the resistance value of a resistance element R2. Other portions are the same as those in the structure of the reference voltage generating circuit shown in FIG. 17, and corresponding parts are denoted by identical reference numerals. The operation of the circuit will be described next.

Voltages V3 and V5 of nodes 3 and 5 are provided by the following equations (52) and (53).

$$V3=Vcc-VTN15 \quad (52)$$

$$V5=-VTN10 \quad (53)$$

Accordingly, drain currents IDS flowing through MOS transistors Q1 and Q2, respectively, are given by the following equations (54) and (55).

$$IDS = (\beta 1/2)\,(V3 - Vcc - VTP1)^2 \quad (54)$$

$$= (\beta 2/2)\,(V5 - V0 - VTP2)^2 \quad (55)$$

From equations (52) to (55), the following equations (56) and (57) are obtained.

$$IDS = (\beta 1/2)\,(-VTN15 - VTP1)^2 \quad (56)$$

$$= (\beta 2/2)\,(-VTN10 - V0 - VTP2)^2 \quad (57)$$

From equations (56) and (57), output voltage V0 is expressed by the following equation (58).

$$V0=(\beta 1/\beta 2)^{1/2}(VTN15+VTP1)-(VTP2+VTN10) \quad (58)$$

In equation (58), the first and second terms at the right side are both expressed by the algebraic sum of the threshold voltage of n channel MOS transistor and the threshold voltage of p channel MOS transistor such that their dependency upon temperature is respectively canceled. Accordingly, dependency of the output voltage V0 upon temperature is sufficiently reduced.

As can be seen from equation (58), when there are one threshold voltage for p channel MOS transistors and one threshold voltage for n channel MOS transistors, output voltage V0 at a desired level is obtained. More particularly, if the threshold voltage of n channel MOS transistor is represented by VTN and the threshold voltage of p channel MOS transistor is represented by VTP, output voltage V0 is obtained which is shown by the following equation (59).

$$V0=\{(\beta 1/\beta 2)^{1/2}-1\}(VTN+VTP) \quad (59)$$

Accordingly, a reference voltage generating circuit with high cost performance can be implemented also in this structure shown in FIG. 18.

Embodiment 8

Figure 19:
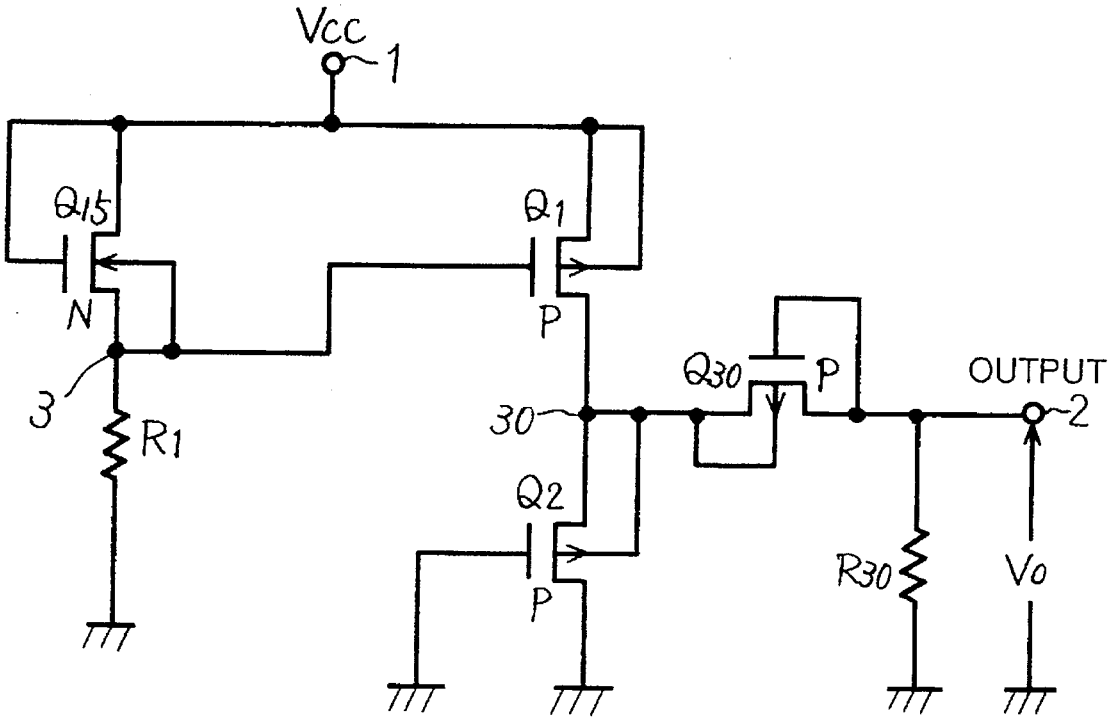
FIG. 19 is a diagram showing an eighth embodiment of the present invention.

FIG. 19 is a diagram showing a structure of a reference voltage generating circuit in accordance with an eighth embodiment of the present invention. Referring to FIG. 19, the reference voltage generating circuit includes a p channel MOS transistor Q1 connected between a power supply node 1 and an internal node 30, a p channel MOS transistor Q2 discharging the potential of internal node 30, an n channel MOS transistor Q15 for setting the potential of the gate of MOS transistor Q1, and a resistance element R1 for operating MOS transistor Q15 at a diode mode.

MOS transistor Q15 has its gate and drain connected to power supply node 1, and its back-gate and source connected to node 3. Resistance element R1 is connected between node 3 and the ground line. MOS transistor Q2 has its back-gate and source connected to node 30 and its gate and drain connected to the ground line.

The reference voltage generating circuit further includes a p channel MOS transistor Q30 connected between node 30 and an output node 2, and a resistance element R30 connected between output node 2 and a ground line. MOS transistor Q30 has its back-gate and source connected to node 30 and its gate and drain connected to output node 2. MOS transistor Q30 has a threshold voltage VTP30 and its equivalent resistance value is set sufficiently lower than resistance value of resistance element R30. In addition, equivalent resistance value of MOS transistor Q15 is made sufficiently lower than resistance value of resistance element R1. The operation of the reference voltage generating circuit will now be described.

Voltage V3 of node 3 is provided by the following equation (60).

$$V3=Vcc-VTN15 \quad (60)$$

Drain currents IDS flowing through MOS transistors Q1 and Q2 are given by the following equations (61) and (62), respectively.

$$IDS = (\beta 1/2)\,(V3 - Vcc - VTP1)^2 \quad (61)$$

$$= (\beta 2/2)\,(-V30 - VTP2)^2 \quad (62)$$

From equations (60) and (61), drain current IDS flowing through MOS transistor Q1 is obtained by the following equation (63).

$$IDS=(\beta 1/2)^{1/2}(-VTN5-VTP2)^2 \quad (63)$$

From equations (62) and (63), voltage V30 at node 30 is obtained by the following equation (64).

$$V30=(\beta 1/\beta 2)^{1/2}(VTN15+VTP1)^2-VTP2 \quad (64)$$

MOS transistor Q30 operates in a diode mode, and output voltage V0 at output node 2 is higher than voltage V30 at node 30 by the amount of threshold voltage VTP30. Thus, in view of equation (64), output voltage V0 is provided by the following equation (65).

$$\begin{aligned} V0 &= V30 + VTP30 \quad (65) \\ &= (\beta 1/\beta 2)^{1/2}\,(VTN15 + VTP1) - (VTP2 - VTP30) \end{aligned}$$

In equation (65), the first term at the right side is the algebraic sum of the threshold voltage of n channel MOS transistor and the threshold voltage of p channel MOS transistor, while the second term thereat is the difference between the threshold voltages of p channel MOS transistors. In each term, the dependency upon temperature is canceled so that the dependency of output voltage V0 upon temperature is significantly reduced. Also in this structure, when the threshold voltages of p channel MOS transistors are all equal to VTP, equation (65) is converted to the following equation (66).

$$V0=(\beta 1/\beta 2)^{1/2}(VTN+VTP) \quad (66)$$

Thus, a circuit with high cost performance and extremely low dependency upon temperature can be obtained also in this structure shown in FIG. 19.

Modification

Figure 20:
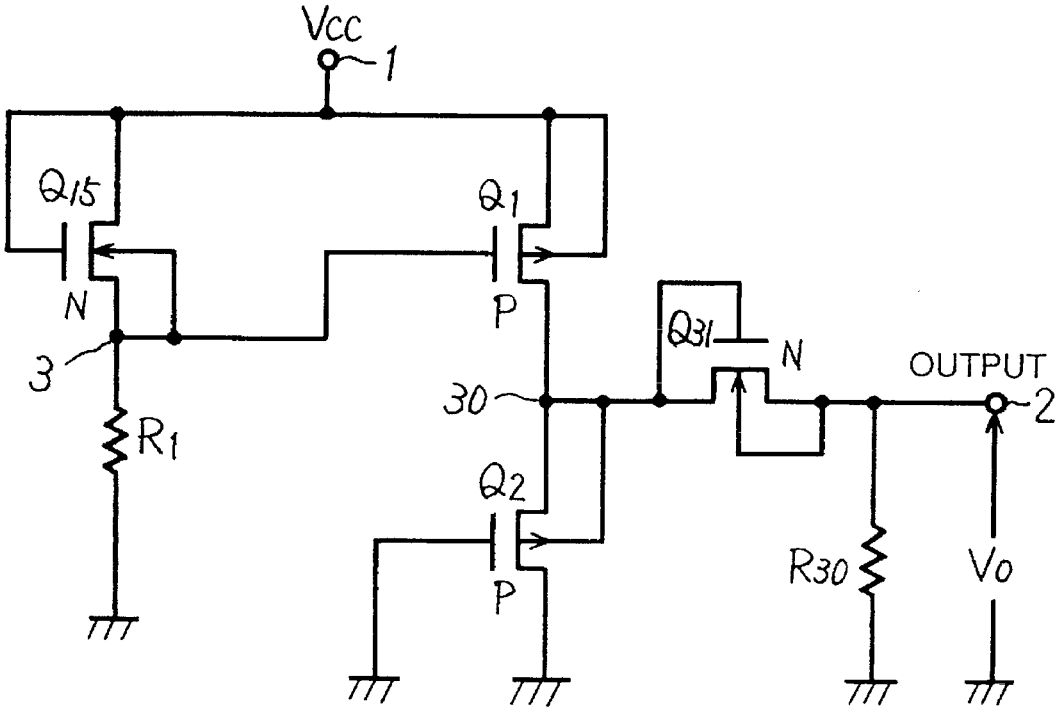
FIG. 20 shows a modification of the eighth embodiment according to the present invention.

FIG. 20 shows a modification of the reference voltage generating circuit according to the eighth embodiment of the present invention. In the reference voltage generating circuit shown in FIG. 20, p channel MOS transistor Q30 of the reference voltage generating circuit in FIG. 19 is replaced by an enhancement type n channel MOS transistor Q31. Other portions are the same as those in the structure of the reference voltage generating circuit shown in FIG. 19 and corresponding portions are denoted by identical reference numerals.

The n channel MOS transistor Q31 has its gate and drain connected to node 30 and its back-gate and source connected to output node 2. Equivalent resistance value of MOS transistor Q31 is set sufficiently lower than the resistance value of a resistance element R30. In the structure of the reference voltage generating circuit in FIG. 20, MOS transistor Q31 lowers voltage v30 at node 30 by the amount of its threshold voltage VTN31 for transmission to output node 2. Then accordingly, output voltage V0 is found by replacing VTP30 in equation (65) by −VTN31.

$$V0=(\beta 1/\beta 2)^{1/2}(VTN15+VTP1)-(VTP2+VTN31) \quad (67)$$

In equation (67), both of the first and second terms at the right side each are also represented by the algebraic sum of the threshold voltage of p channel MOS transistor and the threshold voltage of n channel MOS transistor, so that the dependency of the threshold voltages upon temperature is canceled, and correspondingly, the dependency of output voltage V0 upon temperature can be reduced sufficiently. Also, in the structure of the reference voltage generating circuit shown in FIG. 29, reference voltage V0 of a prescribed voltage level can be produced when threshold voltages of n channel MOS transistors are all equal to VTN and the threshold voltages of p channel MOS transistors are all equal to VTP. In other words, the following equation (68) is derived from equation (67).

$$V0=\{(B1/\beta 2)^{1/2}-1\}(VTN+VTP) \quad (68)$$

Thus, according to this eighth embodiment, a reference voltage generating circuit with high cost performance can be obtained which can generate a stable reference voltage at a desired voltage level, even when there are only one threshold voltage for p channel MOS transistors and one threshold voltage for n channel MOS transistors.

Embodiment 9

Figure 21:
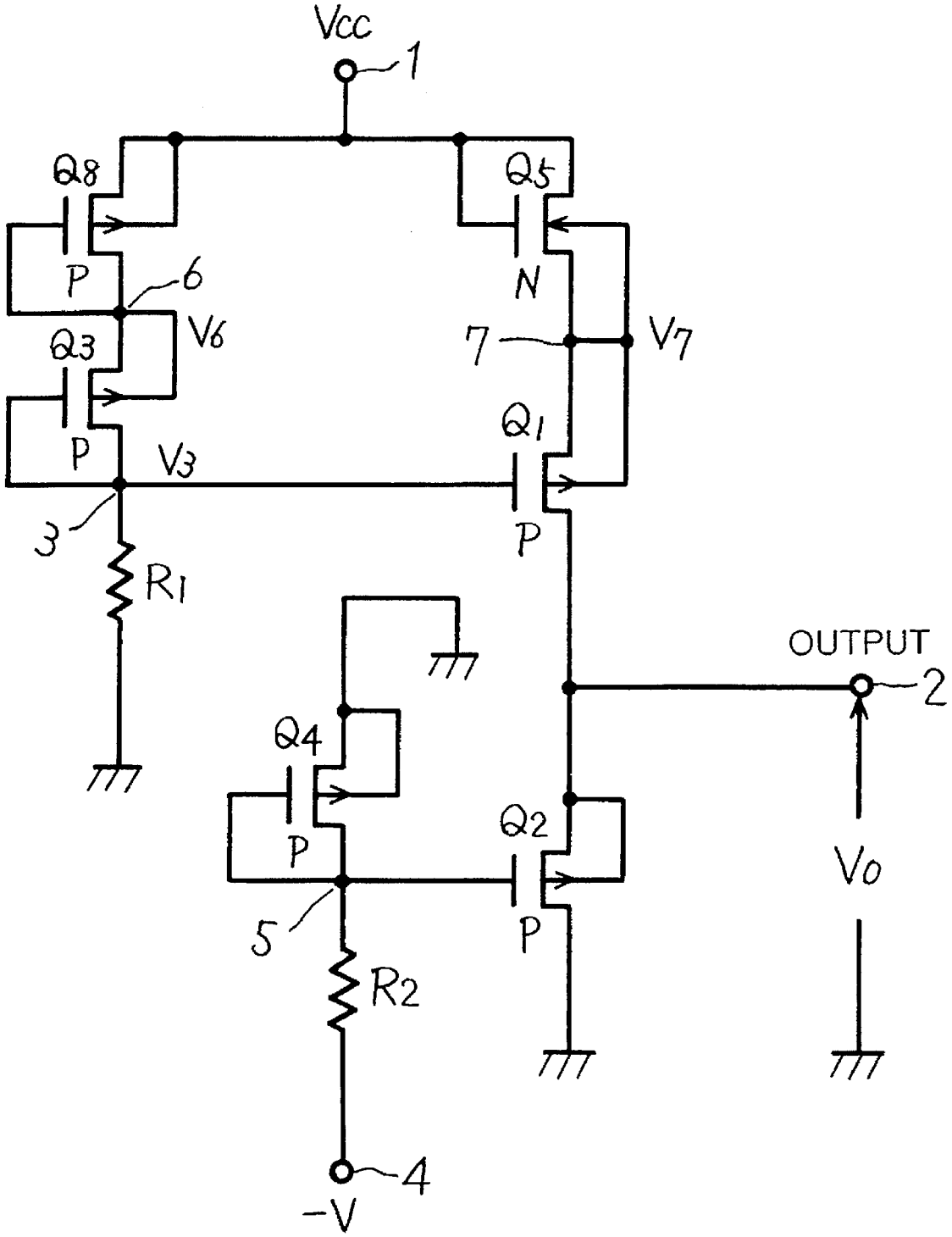
FIG. 21 is a diagram showing a structure of a reference voltage generating circuit in accordance with a ninth embodiment of the present invention.

FIG. 21 is a diagram showing a structure of a reference voltage generating circuit in accordance with a ninth embodiment of the present invention. The reference voltage generating circuit shown in this FIG. 21 is provided with the same structure as that of the reference voltage generating circuit shown in FIG. 8 except for n channel MOS transistor Q6 connected to power supply node 1, which transistor Q6 is replaced by a p channel MOS transistor Q8. Other portions are the same as those in the structure of the reference voltage generating circuit shown in FIG. 8, and the corresponding portions are denoted by identical reference numerals.

MOS transistor Q8 has its source and back-gate connected to a power supply node 1, and its gate and drain to a node 6. MOS transistor Q8 has a threshold voltage VTP8 and has an equivalent resistance value sufficiently lower than resistance value of a resistance element R1. The operation of the circuit will now be described.

Since MOS transistors Q3 and Q8 both operates at a diode mode, voltage V3 of node 3 is provided by the following equation (69).

$$V3=Vcc+VTP3+VTP7 \quad (69)$$

Conductance coefficient β5 of MOS transistor Q5 is set sufficiently larger than conductance coefficients β1 and β2 of MOS transistors Q1 and Q2, and MOS transistor Q5 operates in a diode mode. Accordingly, voltage V7 at a node 7 is provided by the following equation (70).

$$V7=Vcc-VTN5 \quad (70)$$

Equivalent resistance value of an MOS transistor Q4 is made sufficiently lower than the resistance value of resistance element R2, and voltage V5 at node 5 is equal to the threshold voltage VTP4 of MOS transistor Q4. Therefore, drain currents IDS flowing through MOS transistors Q1 and Q2, respectively, are provided by the following equations (71) and (72).

$$IDS = (\beta 1/2)\,(V3 - V8 - VTP1)^2 \quad (71)$$

$$= (\beta 2/2)\,(V5 - V0 - VTP2)^2 \quad (72)$$

From equations (67) to (72), the following equation (73) is obtained.

$$\beta 1\{(Vcc+VTP3+VTP8)-(Vcc-VTN5)-VTP1\}^2=\beta 2\,(VTP4-V0-VTP2)^2 \quad (73)$$

If equation (73) is rearranged with respect to output voltage V0, the following equation (74) is obtained.

$$V0=-(\beta 1/\beta 2)^{1/2}(VTP3-VTP1+VTP8+VTN5)-(VTP2-VTP4) \quad (74)$$

In equation (74), VTP3−VTP1 in the first term at the right side is the difference between the threshold voltages of p channel MOS transistors, while VTP8+VTN5 is the algebraic sum of the threshold voltages of p channel MOS transistor and n channel MOS transistor. Accordingly, the dependency of the threshold voltages upon temperature is canceled in this first term at the right side.

Similarly, the difference between the threshold voltages of p channel MOS transistors is taken also in the second term at the right side of equation (74), and thus the dependency upon temperature of the threshold voltages is likewise canceled. Accordingly, the dependency upon temperature of output voltage V0 which appears at node 2 is sufficiently reduced also by the use of the structure shown in FIG. 21.

The reference voltage generating circuit shown in FIG. 21 also provides the following advantage. Assumption is made that threshold voltages of p channel MOS transistors Q1, Q2, Q3, Q4 and Q8 are all equal to one another. This condition can be implemented easily in a usual CMOS circuit. In this situation, equation (74) is converted to the following equation (75).

$$V0=-(\beta 1/\beta 2)^{1/2}(VTN+VTP) \quad (75)$$

This equation (75) is identical to equation (51) derived previously in the reference voltage generating circuit of FIG. 11 except for the reference characters. Output voltage V0 is always positive. Accordingly, the physical meaning of the above equation (75) is that the absolute value |VTP| of the threshold voltage of a p channel MOS transistor exceeds the absolute value |VTN| of the threshold voltage of a n channel MOS transistor (which can be understood by VTN+VTP<0).

On the contrary, in order that equation (51) holds in the reference voltage generating circuit of FIG. 11, it is required that the absolute value |VTP| of the threshold voltage of the p channel MOS transistor is lower than the absolute value |VTN| of the threshold voltage of the n channel MOS transistor (which can be understood by VTN+VTP>0).

Usually, in a semiconductor device of a CMOS type, positive charge is trapped in a gate insulating film. This storage of charge on the channel surface is caused due to surface levels at the surface of the substrate, and is caused in both p channel MOS transistor and n channel MOS transistor. The positive charge trapped in the gate insulating film acts on n channel MOS transistor so as to lower its threshold voltage (because of attraction of negative charge (electron) to the surface of the substrate), and functions to increase the absolute value of the threshold voltage of p channel MOS transistor (due to repulsion of positive charge). Accordingly, there is generally a tendency of |VTP|>|VTN| and thus the reference voltage generating circuit shown in FIG. 21 is easier to put into implementation as compared to the reference voltage generating circuit in FIG. 17. More particularly, an extra manufacturing process (for example, process of ion implantation) for adjusting the threshold voltage of the MOS transistor is not required for the generation of the reference voltage, and accordingly, a reference voltage generating circuit with higher cost performance can be implemented.

Modification

Figure 22:
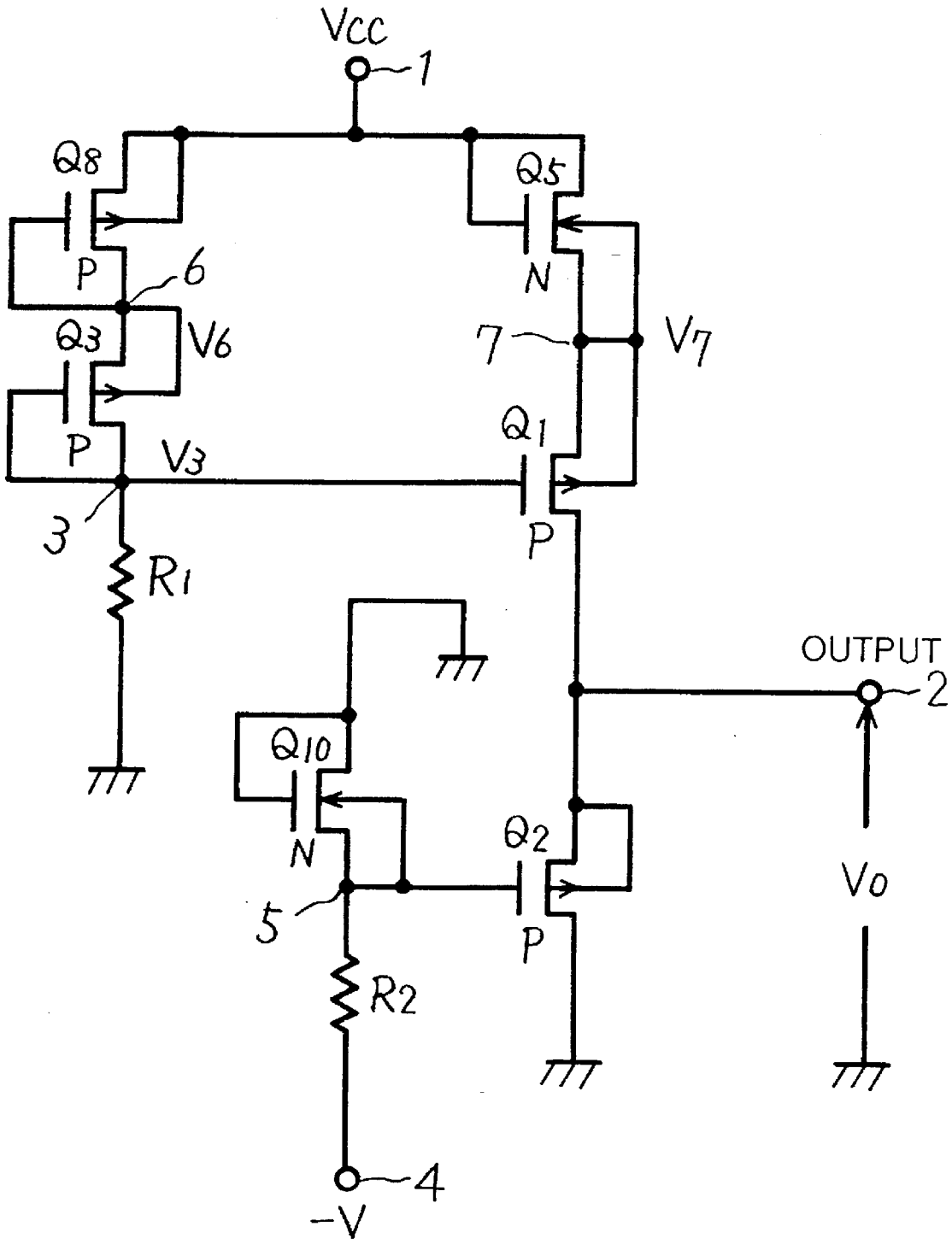
FIG. 22 shows a modification of the ninth embodiment of the present invention.

FIG. 22 shows a first modification of the reference voltage generating circuit according to the ninth embodiment of the present invention. The reference voltage generating circuit shown in FIG. 22 is equivalent to a circuit in which p channel MOS transistor Q4 in the reference voltage generating circuit of FIG. 21 is replaced by an n channel MOS transistor Q10. In the structure of the reference voltage generating circuit shown in FIG. 22, portions corresponding to the structure of the reference voltage generating circuit of FIG. 21 are denoted by identical reference numerals. MOS transistor Q10 has its gate and drain connected to the ground line, and its back-gate and source connected to node 5. In the structure of the reference voltage generating circuit shown in FIG. 22, output voltage V0 appearing at output node 2 is obtained by replacing the threshold voltage VTP4 in equation (76) by −VTN10.

$$V0=-(\beta 1/\beta 2)^{1/2}(VTP3-VTP1+VTP8+VTN5)-(VTP2+VTN10) \quad (76)$$

As can be seen in this equation (76), the dependency upon temperature of threshold voltages are canceled in both first and second terms at the right side, and correspondingly, the dependency upon temperature of output voltage V0 is sufficiently reduced. Assuming that the threshold voltages of p channel MOS transistors are all equal to VTP and threshold voltages of n channel MOS transistors are all equal to VTN, equation (74) can be converted into the following equation (77).

$$V0=-\{(\beta 1/\beta 2)^{1/2}+1\}(VTP+VTN) \quad (77)$$

As can be understood by equation (77), a characteristic similar to that of equation (75) is provided also in this circuit arrangement, that is, it condition is easily implemented with a usual CMOS circuit technology.

Embodiment 10

Figure 23:
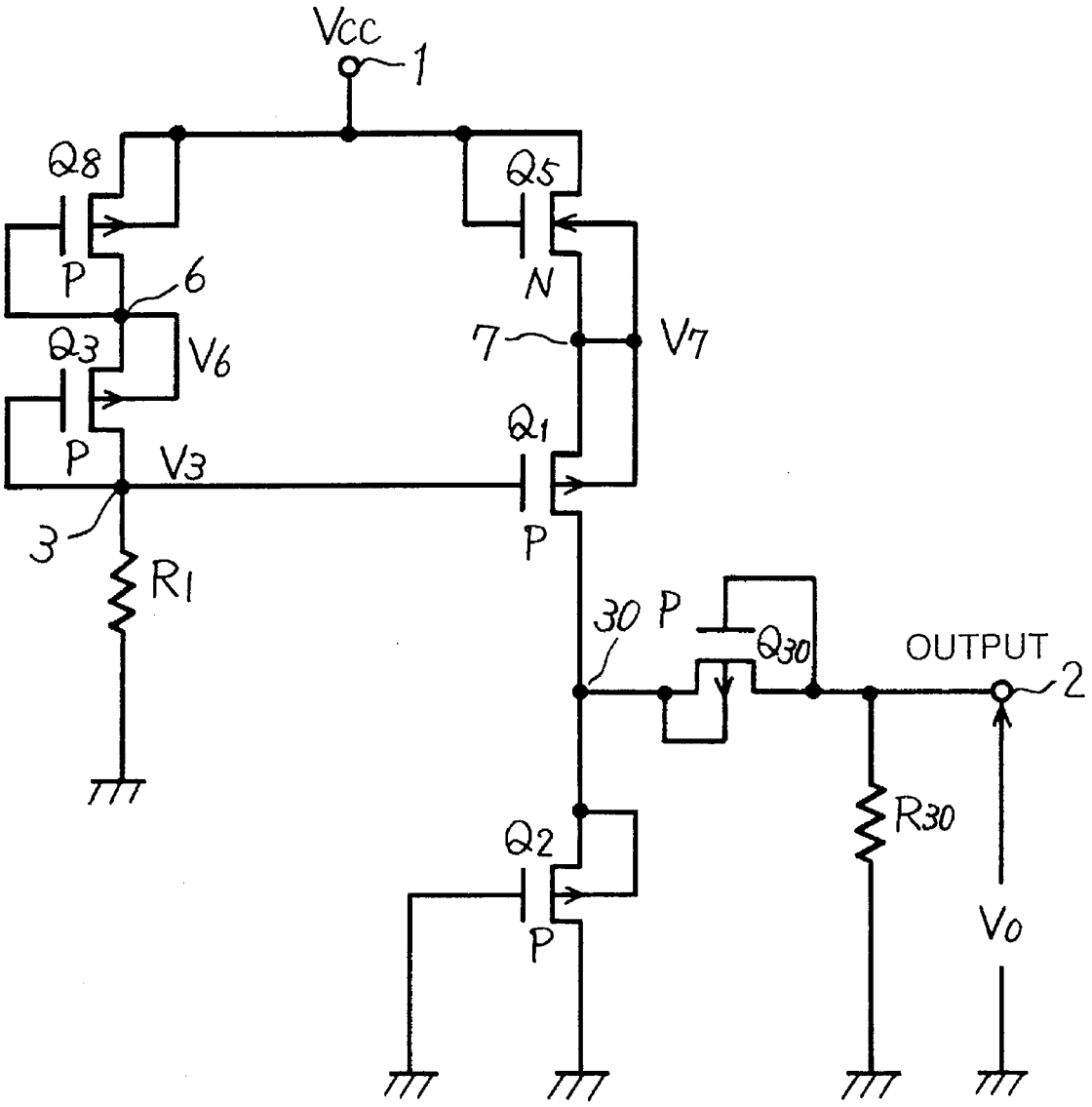
FIG. 23 is a diagram showing a structure of a tenth embodiment in accordance with the present invention.

FIG. 23 is a diagram showing a structure of a reference voltage generating circuit in accordance with a tenth embodiment of the present invention. In the structure of the reference voltage generating circuit shown in FIG. 23, an MOS transistor Q2 has its gate connected to the ground line, while MOS transistor Q10 and resistance element R2 are removed off. Instead, a p channel MOS transistor Q30 is connected between an output node 2 and an internal node 30, and a resistance element R30 is connected between output node 2 and the ground line. Other portions are the same as those in the structure of the reference voltage generating circuit shown in FIGS. 21 and 22, and the corresponding parts are denoted by identical reference numerals.

MOS transistor Q30 has an equivalent resistance value which is sufficiently smaller than the resistance value of resistance element R30, and operates in a diode mode. Voltage V30 at node 30 is obtained by deleting the term of the threshold voltage VTP4 in the previously described equation (72). In other words, voltage V30 at node 30 is provided by the following equation (78).

$$V0=-(\beta 1/\beta 2)^{1/2}(VTP3-VTP1+VTP8+VTN5)-VTP2 \quad (78)$$

MOS transistor Q30 operates in a diode mode, and output voltage V0 is obtained by V30+VTP30. Accordingly, output voltage V0 is found by the following equation (79).

$$V0=-(\beta 1/\beta 2)^{1/2}(VTP3-VTP1+VTP8+VTN5)-(VTP2-VTP30) \quad (79)$$

In addition, if the threshold voltages of p channel MOS transistors are all provided by VTP, the following equation (80) is obtained.

$$V0=-(\beta 1/\beta 2)^{1/2}(VTP+VTN) \quad (80)$$

From equations (79) and (80), the dependency upon temperature of the threshold voltages is all canceled and the dependency upon temperature of output voltage V0 can be sufficiently reduced also in the reference voltage generating circuit shown in FIG. 23. Furthermore, as shown in equation (80), a reference voltage generating circuit can be implemented easily in a usual CMOS type semiconductor device, resulting in high cost performance.

Modification

Figure 24:
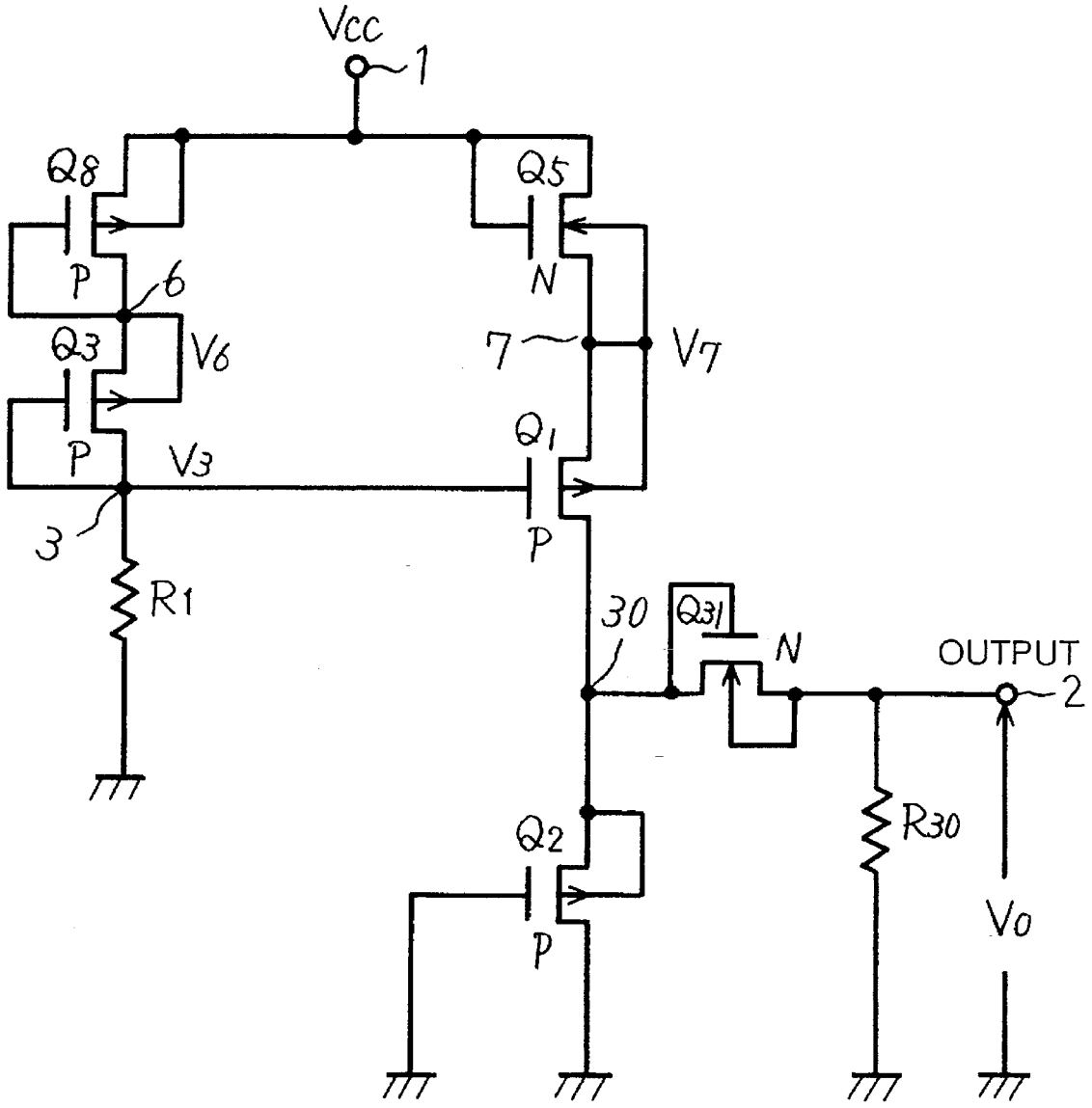
FIG. 24 shows a modification of the tenth embodiment of the present invention.

FIG. 24 shows a structure of a modification of the reference voltage generating circuit according to the tenth embodiment of the present invention. The reference voltage generating circuit shown in this FIG. 24 is equivalent to the circuit in which p channel MOS transistor Q30 connected to the output node in the reference voltage generating circuit shown in FIG. 23 is replaced by an n channel MOS transistor Q31.

MOS transistor Q31 has its gate and drain connected to a node 30 and its back-gate and source connected to an output node 2. MOS transistor Q31 has a threshold voltage VTP31 has an equivalent resistance value which is sufficiently smaller than the resistance value of a resistance element R30 so as to operate in a diode mode. In the reference voltage generating circuit of FIG. 24, an output voltage V0 is obtained from V0=V30−VTN31, which is expressed as the following equation (81).

$$V0=-(\beta 1/\beta 2)^{1/2}(VTP3-VTP1+VTP8+VTN5)-(VTP2+VTN31) \quad (81)$$

In the above equation (81), the dependency upon temperature of the threshold voltages is canceled both in first and second terms at the right side, and accordingly, the dependency upon temperature of output voltage V0 is sufficiently reduced.

In addition, if the threshold voltages of p channel MOS transistors are all VTP and the threshold voltages of n channel MOS transistors are all VTN in the structure of this reference voltage generating circuit shown in FIG. 24, the following equation (82) is obtained.

$$V0=-\{(\beta 1/\beta 2)^{1/2}+1\}(VTP+VTN) \quad (82)$$

Accordingly, a reference voltage generating circuit which is easily implemented in a usual CMOS semiconductor device is also obtained by the reference voltage generating circuit shown in FIG. 24.

In each of the reference voltage generating circuits shown in FIGS. 21 to 24, a similar effect can be obtained even when MOS transistor Q3 and MOS transistor Q8 are replaced with each other. Also, a similar effect can be obtained even when MOS transistors operating in a resistance mode are used as resistance elements R1, R2 and R30.

Embodiment 11

Description is now made for a method of causing difference between the threshold voltages of an output MOS transistor Q1 at an output portion of the reference voltage generating circuit and a control MOS transistor Q3 for setting the gate potential of this MOS transistor Q1.

Figure 25:
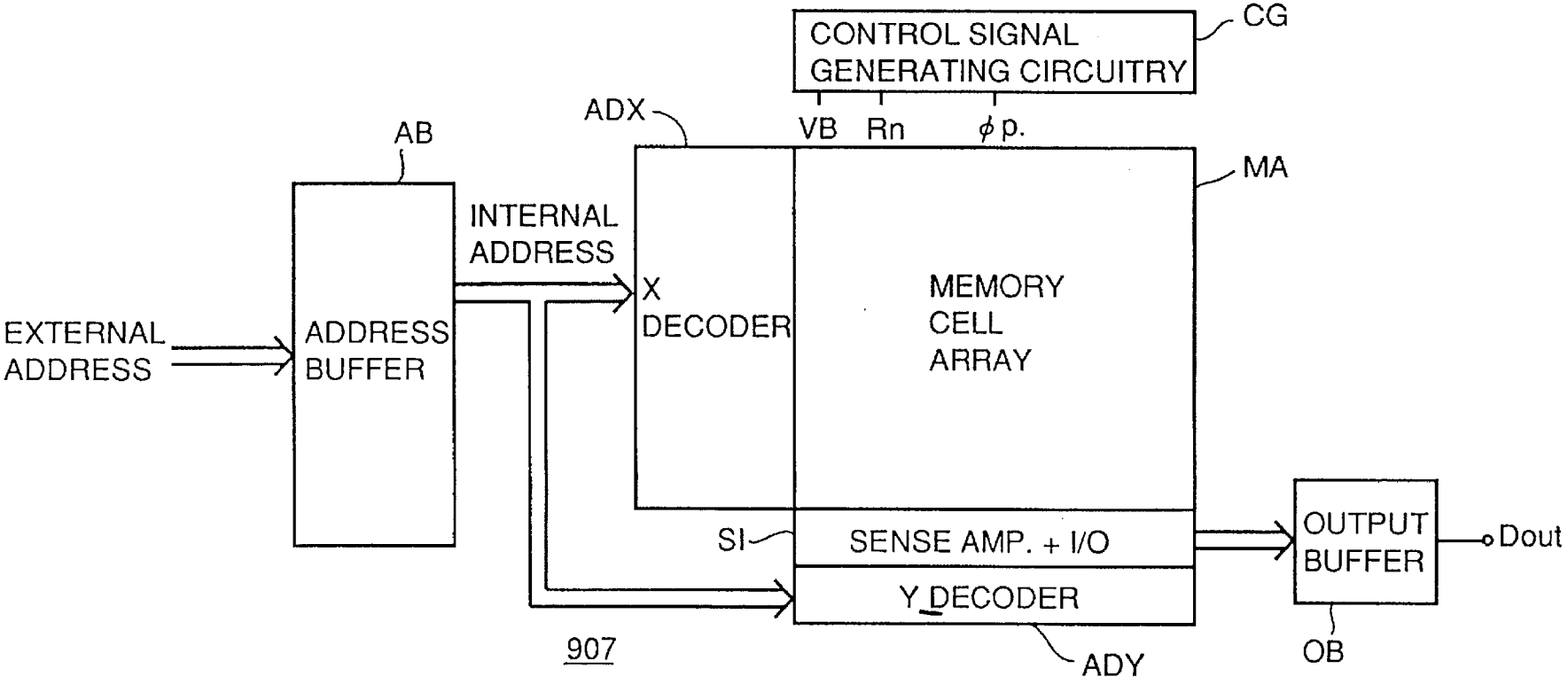
FIG. 25 is a diagram showing an example of a structure of internal power supply utilizing circuit shown in FIG. 40.
Figure 40:
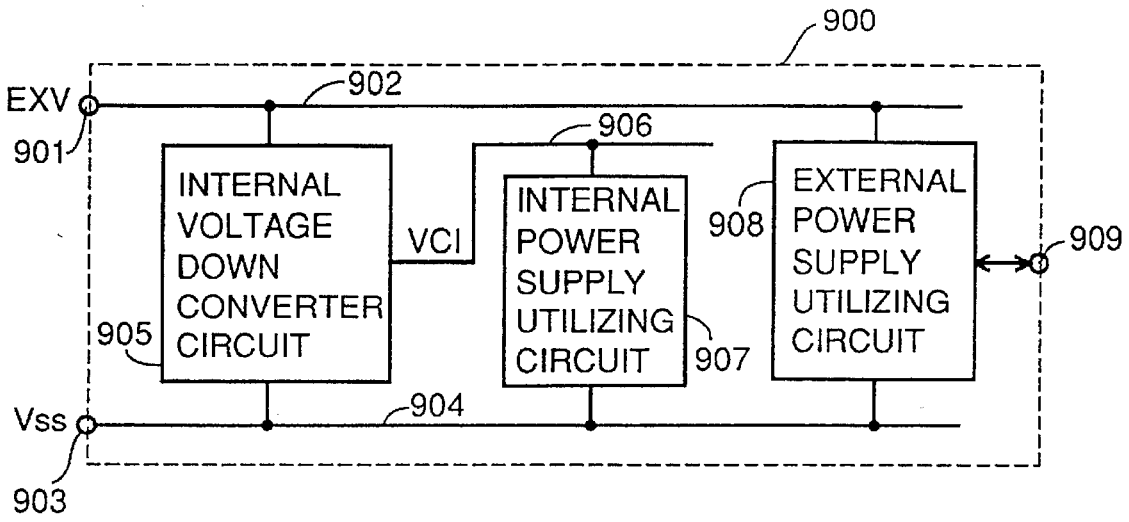
FIG. 40 is a schematic diagram showing the entire structure of a semiconductor device including an internal voltage down converter circuit.
Figure 41:
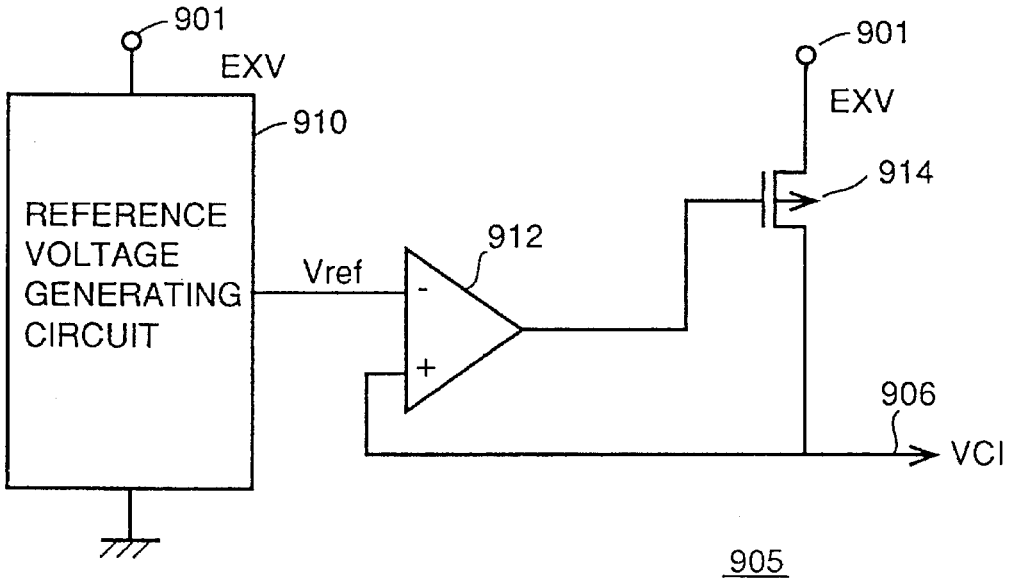
FIG. 41 is a diagram showing an example of a structure of the internal voltage down converter circuit in FIG. 40.

FIG. 25 is a schematic diagram of a structure of an internal power supply utilizing circuit 907 shown in FIG. 40. Referring to FIG. 25, internal power supply utilizing circuit 907 includes a memory cell array MA having a plurality of memory cells arranged in a matrix of rows and columns, an address buffer AB for buffering an externally provided external address signal to produce an internal address signal, an X decoder ADX for decoding the internal address signal from this address buffer AB and for selecting a corresponding row in the memory cell array MA, and a Y decoder ADY for decoding the internal address signal from address buffer AB and for generating a column selecting signal for selecting a corresponding column in memory cell array MA.

Internal power supply utilizing circuit 907 further includes a sense amplifier for detecting and amplifying the data of memory cells connected to the row (word line) selected in this memory cell array MA, and an I/O gate for connecting the corresponding column in memory cell array MA to an output buffer OB according to the column selecting signal from Y decoder ADY. In FIG. 25, the sense amplifier and the I/O gate are represented by one single block SI.

Output buffer OB buffers the internal readout data from this block SI and produces an external readout data Dout. The final output stage of this output buffer OB (i.e., the portion of the circuit which is connected to an external output terminal) employs the external power supply voltage to provide an interface with external devices. In FIG. 25, output buffer OB is shown utilizing internal power supply voltage VCI, since this internal power supply voltage VCI is employed by the portions of the circuit other than the final output stage included in output buffer OB.

In addition, control signal generating circuitry CG which generates control signals for controlling the various operation timings of this internal power supply utilizing circuit 907 is provided as a peripheral circuit. Address buffer AB, X decoder ADX, Y decoder ADY and block SI may also be included as peripheral circuits.

Control signal generating circuitry CG generates a word line driving signal Rn transmitted on a selected row (that is, a word line which will be described later) in memory cell array MA as well as a precharge instructing signal $\phi p$ for precharging internal nodes to a prescribed potential VB during a stand-by cycle. Furthermore, this control signal generating circuitry CG is shown generating a precharging potential VB for precharging internal nodes during the precharging cycle (stand-by cycle).

Figure 26:
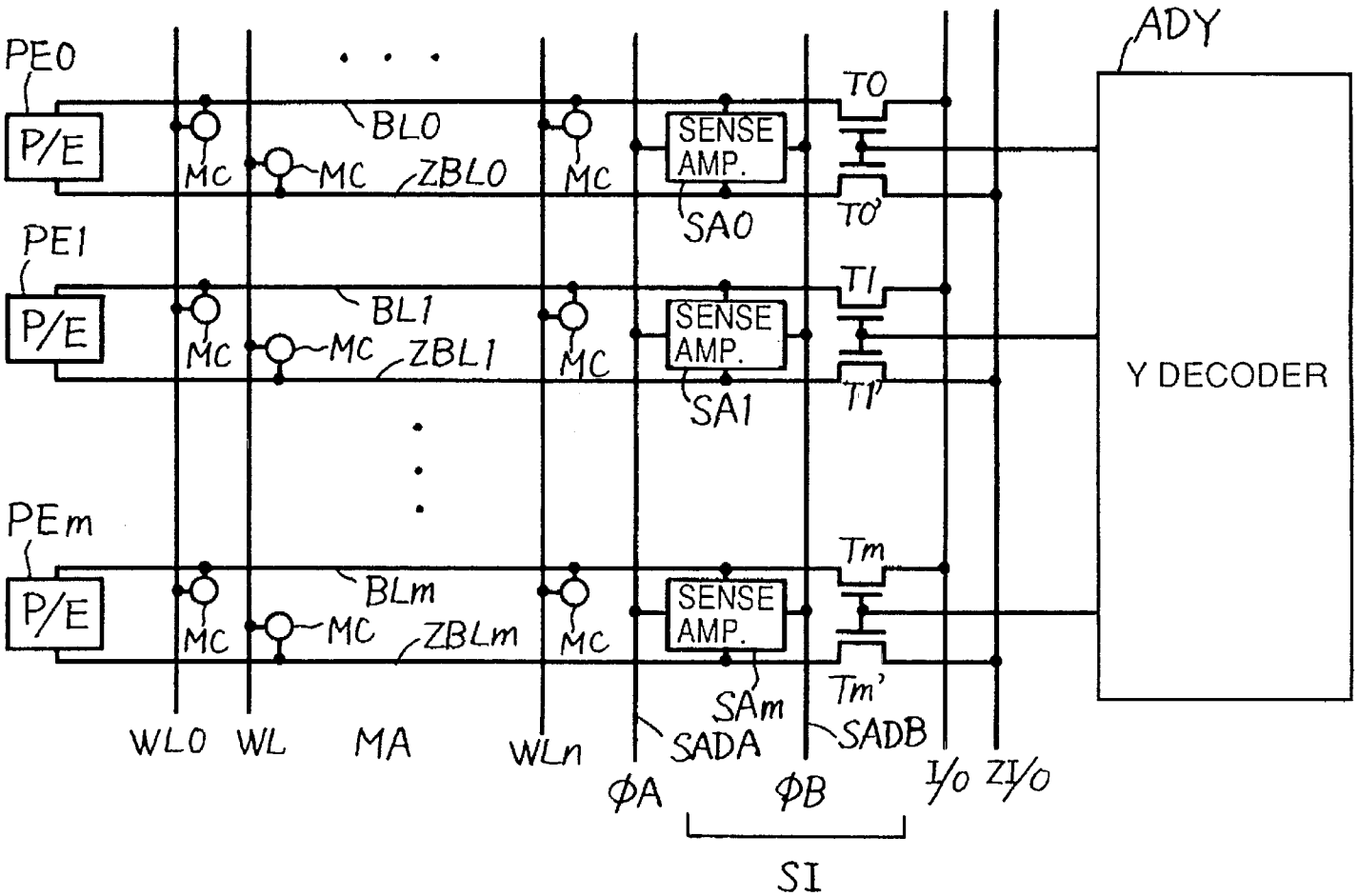
FIG. 26 is a schematic diagram showing a structure of a memory cell array shown in FIG. 25.

FIG. 26 schematically shows a structure of the memory cell array portion of FIG. 25. Referring to FIG. 26, memory cell array MA includes a plurality of memory cells MC arranged in a matrix of rows and columns, a plurality of word lines WL (WL0–WLn) having the memory cells MC of corresponding rows connected thereto, and a plurality of bit line pairs BL, ZBL (BL0, ZBL0–BLm, ZBLm) located corresponding to each respective column of the memory cells and each of which is in connection with memory cells of a corresponding column. Bit lines BL and ZBL are disposed to constitute a pair and data signals which are complementary to one another are transmitted to the respective bit line BL and ZBL. Memory cell MC is positioned at an intersection of a single word line WL and a pair of bit lines BL and ZBL. For example, memory cells MC are arranged corresponding to an intersection of word line WL0 and bit line BL0, and to an intersection of word line WL1 and bit line ZBL0.

Corresponding to the respective bit line pairs BL0, ZBL0 to BLm, ZBLm, precharging/equalizing circuits (P/E) PE0 to PEm are positioned for precharging and equalizing a corresponding bit line pair BL, ZBL to a prescribed potential VB during the stand-by cycle (precharging).

Block SI is positioned corresponding respective to bit line pairs BL0, ZBL0 to BLm, ZBLm, and includes sense amplifiers SA0 to SAm each for differentially amplifying the signal potentials of a corresponding bit line pair BL, ZBL when activated, and IO gates which are provided corresponding to respective bit line pairs BL0, ZBL0 to BLm, ZBLm, are rendered conductive in response to a column selecting signal from Y decoder ADY and connects the corresponding bit line pair BL, ZBL to internal data lines I/O, ZI/O. IO gate includes transfer gates Ti, Ti' positioned corresponding to bit line pair BLi, ZBLi (i=0 to m).

Sense amplifiers SA0 to SAm are activated in response to sense amplifier activation control signals ϕA and ϕB transferred via sense amplifier activation signal lines SADA and SADB, respectively.

Figure 27:
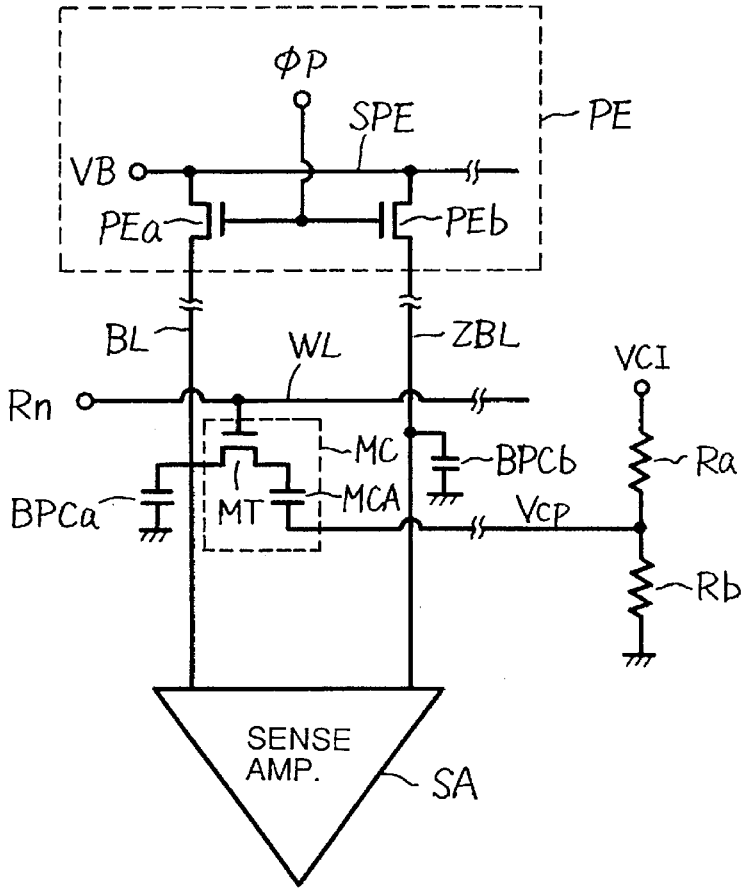
FIG. 27 is a diagram showing a structure of the portion related to one column of memory cells shown in FIG. 26.

FIG. 27 is a detailed diagram of a structure of the memory cell and precharging/equalizing circuit in FIG. 26. FIG. 27 shows representatively a single word line WL and a single pair of bit lines BL, ZBL.

Precharging/equalizing circuit PE includes transfer gates PEa and PEb which are made conductive in response to precharge instructing signal ϕP, and precharging voltage VB on a precharging voltage transmission line SPE to bit lines BL and ZBL, respectively.

Memory cell MC includes a memory cell capacitor MCA which stores data in the form of electrical charges, and access transistor MT which is rendered conductive in response to the potential (word line driving signal Rn) on word line WL and connects memory capacitor MCA to bit line BL or ZBL. In FIG. 27, access transistor MT is shown connecting memory capacitor MCA to bit line BL. There are parasitic capacitances BPCa and BPCb, respectively, on bit lines BL and ZBL. Memory cell capacitor MCA has its one electrode connected to one conduction terminal of access transistor MT and its other electrode connected to receive a constant reference voltage Vcp. One electrode of memory cell capacitor MCA serves as a storage node for storing information. Voltage Vcp (cell plate voltage) applied to the other electrode (cell plate) of this memory capacitor MCA is produced by a voltage generating circuit including serially connected resistance elements Ra and Rb, for example. Resistance elements Ra and Rb of this cell plate voltage generating circuit are connected in series between an internal power supply voltage supplying node and a ground line, and resistance divide internal power supply voltage VCI to produce the cell plate voltage Vcp. The reference voltage generating circuit described previously may also be employed as this cell plate potential generating circuit.

Usually, precharging voltage VB and cell plate voltage Vcp are set to have the voltage level of ½ of the internal power supply voltage VCI, respectively. The operation of the circuit will now be described in brief.

In precharging (during the stand-by cycle), precharging signal ϕp is at high level, transfer gates PEa and PEb are both in conductive state, and bit lines BL, ZBL are charged to attain a precharging voltage VB at the intermediate potential level. When an active cycle is initiated, this precharging signal ϕp attains a low level and transfer gates PEa and PEb both enter a non-conductive state. When the word line WL is designated by the address signal, the word line driving signal Rn is transmitted to this word line WL to raise its potential, and access transistor MT included in memory cell MC is rendered conductive. Thus, memory capacitor MCA is connected to bit line BL and the potential of bit line BL is changed from its precharging voltage VB according to the data stored in memory capacitor MCA. The amount of potential change is determined by the capacitance value of memory capacitor MCA and the capacitance value of parasitic capacitance VPCa connected to bit line BL. Since the memory cell is not connected to bit line ZBL, precharging voltage VB is maintained on the bit line ZBL. Subsequently, sense amplifier SA is activated to detect, amplify, and latch the potential difference appearing at these bit lines BL and ZBL. Thereafter, selected memory cell is selected in accordance with the column selecting signal from Y decoder (see FIG. 26) and data writing or reading (access) is performed to this selected memory cell.

In the structure as described above, the internal signals shown in this FIG. 27 are all changed between the levels of internal power supply voltage VCI and ground voltage Vss (GND). When a memory cycle (active cycle) is completed, word line driving signal Rn on word line WL is lowered to the level of ground potential GND. This renders memory access transistor MT non-conductive.

As internal power supply voltage VCI lowers, the MOS transistor included in the circuit has to be scaled down so as to maintain its operation characteristics. When this scaling down is to be made, the threshold voltage Vth is not scaled down according to the scaling rule for the following reasons.

In general, an MOS transistor is non-conductive when the potentials of its gate and source are equal to each other. However, all the current flowing through the MOS transistor at non-conductive state are not cut off completely. Current called "tail current (subthreshold current)" flows through this MOS transistor. Generally, threshold voltage Vth is defined as a gate-source voltage causing a drain current of a certain current value to flow through the MOS transistor having a prescribed gate width.

Figure 28:
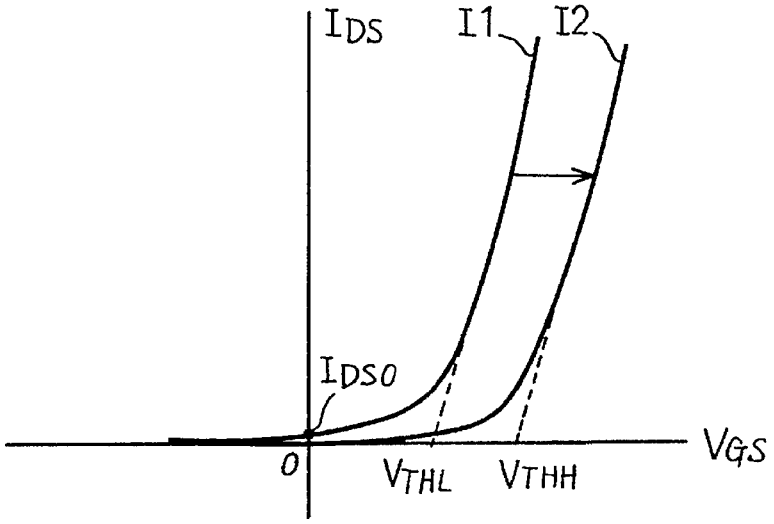
FIG. 28 shows current characteristics of an MOS transistor.

FIG. 28 is a diagram showing the tail current characteristics of the MOS transistor in which drain current IDS flowing through the MOS transistor is represented along an axis of ordinates and gate-source voltage VGS is represented along an axis of abscissas. As can be seen from curve I1, when threshold voltage is VTHL, drain current IDS0 flows even when the gate-source voltage VGS is 0 V. In order to reduce this current IDS0 to a substantially negligible extent, the threshold voltage must be made higher to attain a value of VTHH, as shown in curve I2. Here, in FIG. 28, tail current characteristics of an n channel MOS transistor is shown. In the case of p channel MOS transistor, its tail current characteristics is shown by curves which are symmetrical with respect to the axis of ordinates.

As can be seen from FIG. 28, when gate-source voltage VGS exceeds threshold voltages VTHL and VTHH, a large drain current IDS flows abruptly. Accordingly, in order to achieve a fast switching on MOS transistor, it is preferred that the threshold voltage of the MOS transistor is as low as possible. However, in the case of semiconductor memory device, employment of an MOS transistor having such a low threshold voltage as an access transistor of a memory cell would cause the following problems.

Figure 29:
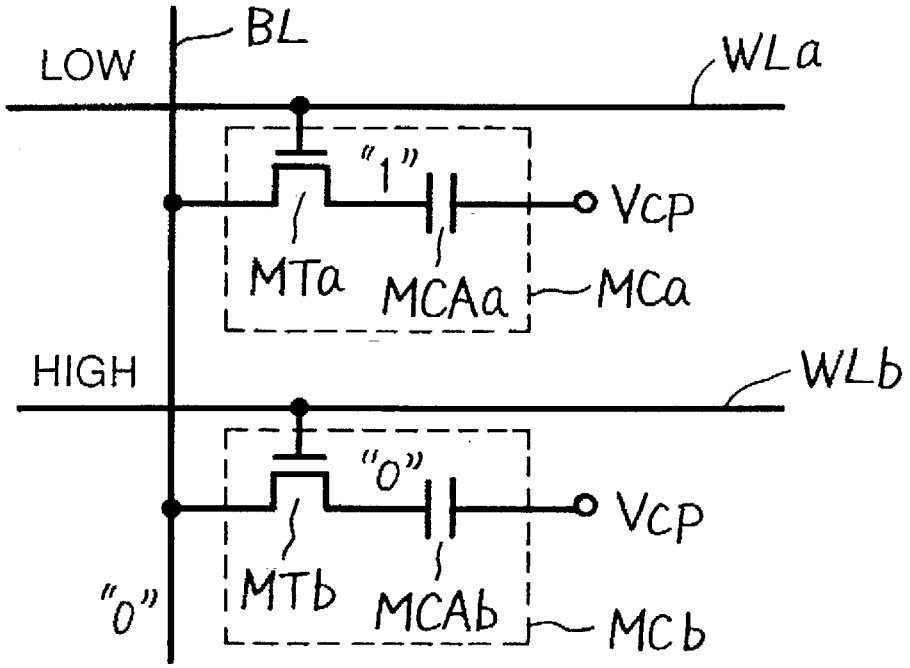
FIG. 29 is a diagram for illustrating a low threshold voltage MOS transistor in the internal power supply utilizing circuit shown in FIG. 25.

Consideration is now made on two memory cells MCa and MCb as shown in FIG. 29. Memory cell MCA includes a memory cell capacitor MCa and an access transistor MTa which is rendered conductive in response to the potential on a word line WLa and connects memory cell capacitor MCAa to bit line BL. Memory cell MCb includes a memory cell capacitor MCAb and an access transistor MTb which connects this memory cell capacitor MCAb to bit line BL in response to the signal potential on a word line WLb. Assuming that data of "1" (high level) is stored in memory cell MCa and data of "0" (low level) is to be written into memory cell MCb, the potential on word line WLa would be at the level of ground voltage GND, that is, low level, and the potential on word line WLb would be at high level (that is, usually a voltage higher than internal power supply voltage VCI so as to prevent the loss due to threshold voltage of access transistor).

When data "0" is written, the potential of bit line BL is set at the level of ground potential GND. At this time, access transistor MTa of memory cell MCa has its gate (word line WLa) and source (bit line BL) at the same potential. Accordingly, when an MOS transistor having a tail current characteristics as shown by curve I1 in FIG. 28 is used as this access transistor MTa, the tail current flows from memory cell capacitor MCA to bit line BL and the accumulated charge of memory capacitor MCAa is reduced. Accordingly, the charge retaining characteristics of the memory cell and thus the reliability of the semiconductor memory device are degraded. In addition, the data of "1" stored in this memory cell MCa may be changed into "0" owing to the flowing out of the electrical charge by this tail current, so such that implementation of a semiconductor memory device for correctly storing the data would be impossible and thus, reliability of the memory device is degraded.

Therefore, in this semiconductor memory device, the threshold voltage of access transistor MT of the memory cell is made as high as possible and its tail current as small as possible.

Meanwhile, the peripheral circuits such as address buffer AB, X decoder ADX, Y decoder ADY and peripheral circuit control circuitry CG need to operate as fast as possible. Accordingly, MOS transistors of a low threshold voltage having tail current characteristics as shown in the curve I1 in FIG. 28 are employed as components of the peripheral circuits. Here, "low threshold voltage" means "a threshold voltage having a small absolute value." Actually, the threshold voltage of the MOS transistors used for the peripheral circuits are set to an appropriate value, considering the power dissipation (that is, the power dissipation during the time of stand-by cycle).

Accordingly, in a usual semiconductor memory device, an MOS transistor of a low threshold voltage as well as an MOS transistor having a high threshold voltage (that is, a threshold voltage of a large absolute value) are employed. In a method of manufacturing these MOS transistors having different threshold voltages, first, MOS transistors having an identical threshold voltage, that is, low threshold voltage are formed at both of the peripheral circuits and of the memory cell array portion. Then, only the access transistor of the memory cell has its gate electrode subjected to ion implantation of P type impurity such as boron at the surface of channel region in order to increase the concentration of P type impurity at the surface of channel region of this access transistor. As a result, threshold voltage of the access transistor is made higher. Accordingly, a usual manufacturing process of a semiconductor memory device includes manufacturing steps for making difference between the threshold voltages of the access transistors in memory cell array portion and the MOS transistors included in the peripheral circuit. In the present embodiment, the threshold voltages of P channel MOS transistors Q1 and Q3 included in the reference voltage generating circuit is differed from one another by using these steps. A method of manufacturing the semiconductor device according to the eleventh embodiment of the present invention will be described in the following with reference to the figures.

Figure 30:
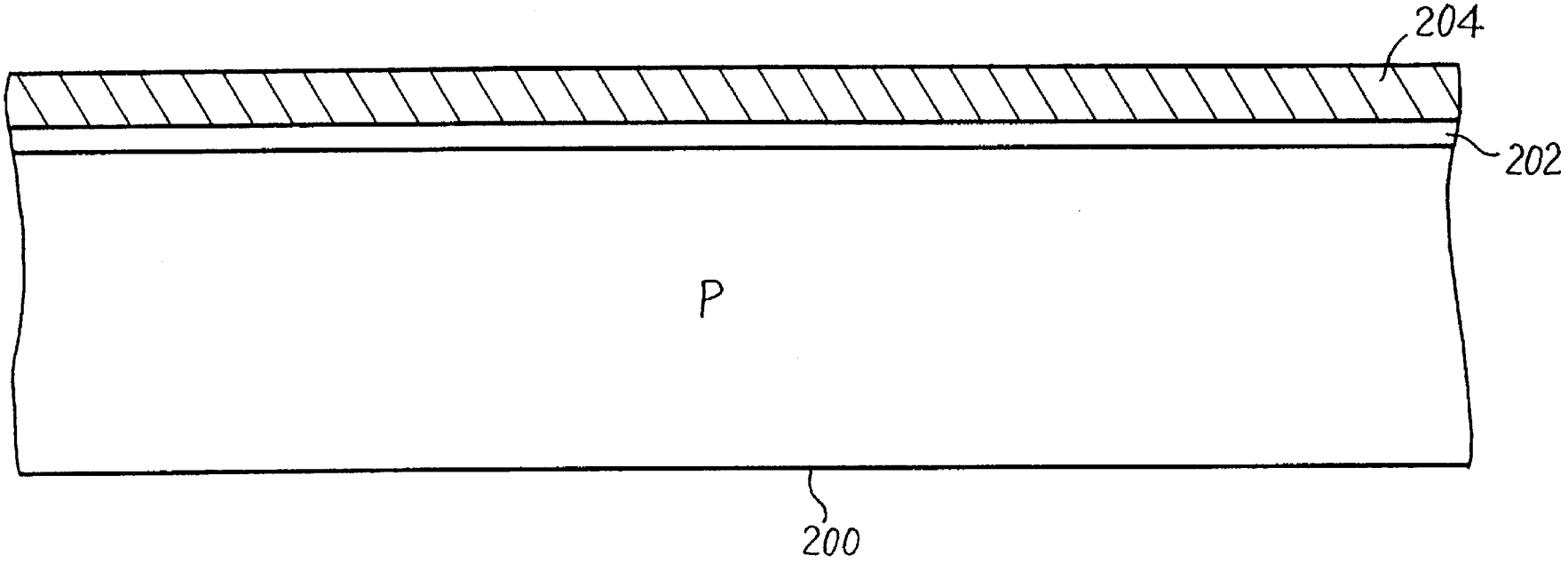
FIGS. 30 to 38 are diagrams showing successive steps in the method of manufacturing a semiconductor device according to an eleventh embodiment of the present invention.

First, as shown in FIG. 30, a thin thermal oxide film (pad oxide film) 202 is grown on a surface of a P type semiconductor substrate 200 according to the method of thermal oxidation. On this thermal oxide film 202, a silicon nitride film 204 is subsequently deposited by, for example, CVD (Chemical Vapor Deposition) method so as to form a two-layer insulating film.

Figure 31:
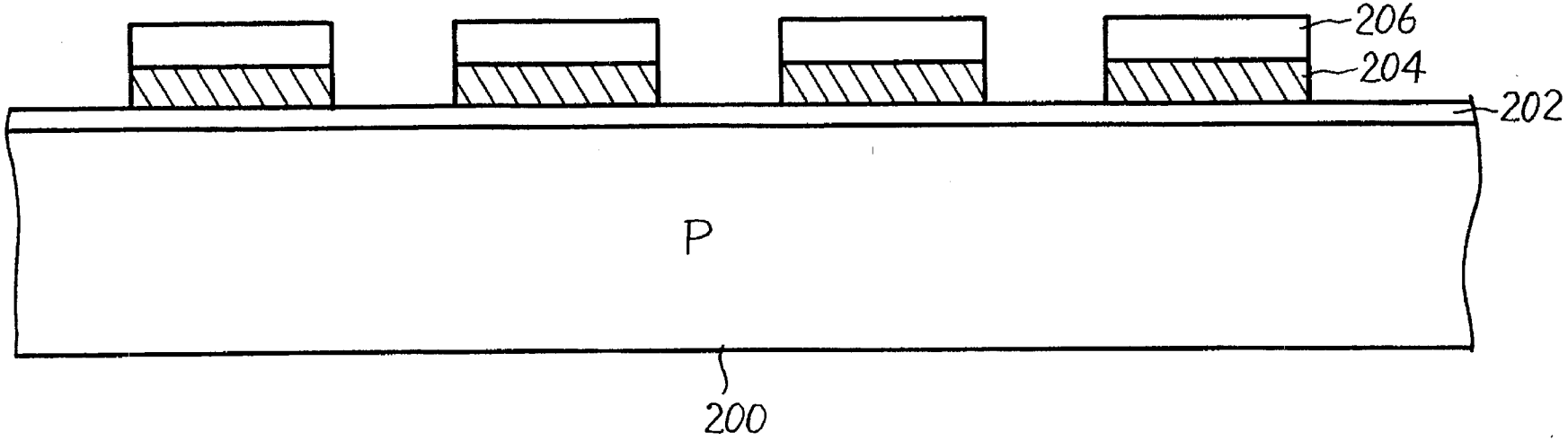

Thereafter, as shown in FIG. 31, a resist film is formed on silicon nitride film 204 and then is patterned in accordance with the method of photolithography and etching to form a resist pattern 206. Using this resist pattern 206 as a mask, silicon nitride film 202 is selectively etched away so that pad oxide film 204 is exposed at the portions which are to be element isolation regions.

Figure 32:
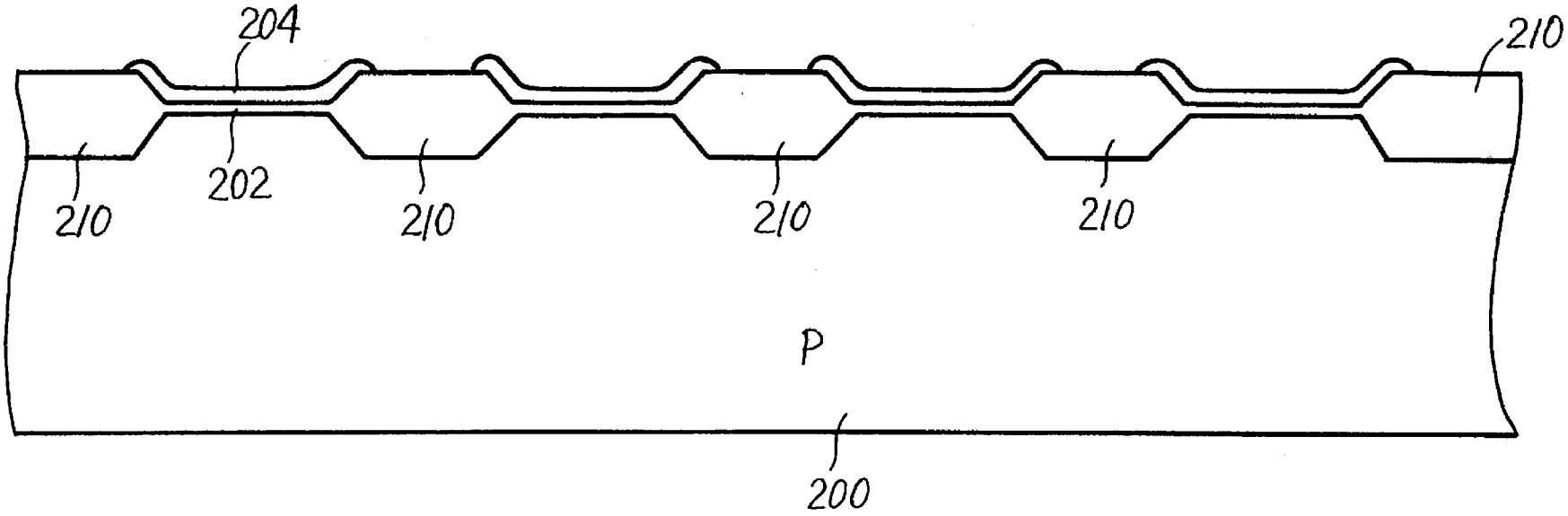

Next, as shown in FIG. 32, resist pattern 206 is removed and thermal oxidation is performed using silicon nitride film 204 as a mask, so as to deposit a thick silicon dioxide film (field oxide film 210) selectively at the element isolation regions. This formation of oxide film by the selective thermal oxidation is called LOCOS (Local Oxidation of Silicon) method. Field oxide film 210 also grows under nitride film 204 upon thermal growth thereof, so that a portion of silicon nitride film 204 is raised, as shown in FIG. 32. This field oxide film 210 determines the region where MOS transistor is formed.

In order to prevent formation of parasitic MOS transistor, ion implantation of P type impurity such as boron is performed under this thermal oxide film 210 before effecting LOCOS step. At the lower portion of this field oxide film 210, a channel stopper region is formed.

Figure 33:
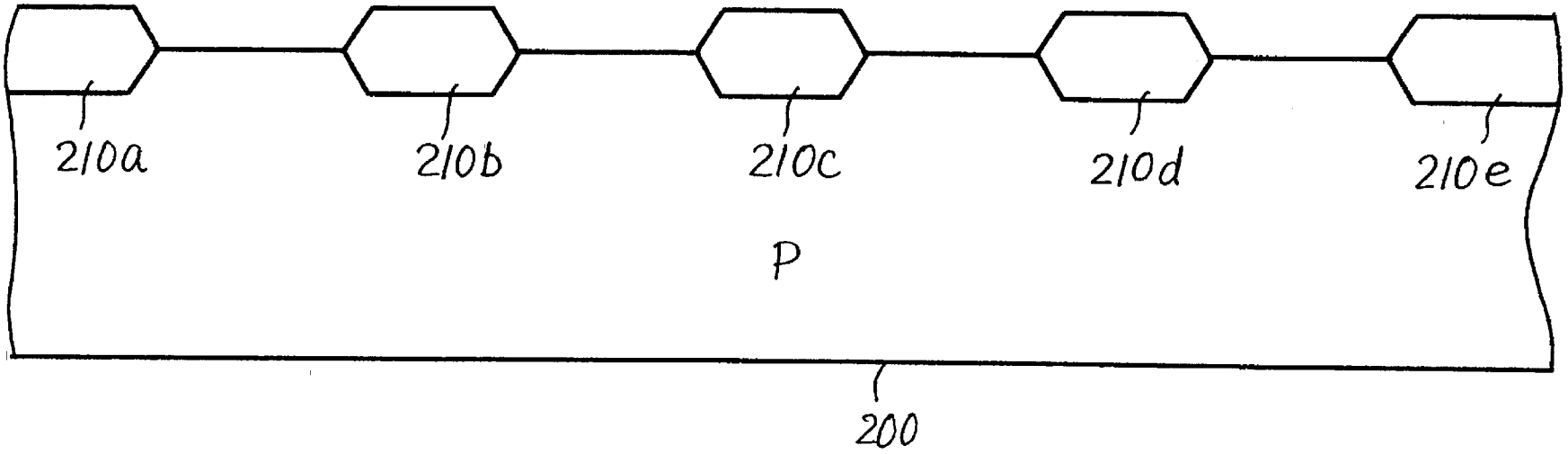

Then, as shown in FIG. 33, silicon nitride film 204 and pad oxide film 202 are etched away since they are no longer required and the surface of semiconductor substrate 200 is exposed.

Next, process of actually manufacturing the MOS transistors which are the components of the memory cell array, peripheral circuits, and reference voltage generating circuit will be described.

In the description set forth below, it is assumed that there exist regions as in the following. A region 300 between field oxide films 210*a* and 210*b* is utilized as an array region forming the memory cell. An access transistor (n channel MOS transistor) is formed in this region 300. At a region 302 between field oxide films 210b and 210c, an n channel MOS transistor which is a component of a peripheral circuit is formed. As described previously, the peripheral circuits are internal circuits for controlling an each access to the semiconductor memory device and include structures such as inverter, NAND gate, and NOR gate at the gate level. These peripheral circuits include both n channel and p channel MOS transistors.

A region 304 between field oxide films 210c and 210d is employed as a region for forming a p channel MOS transistor included in a peripheral circuit. A region 306 between field oxide films 210b and 210e is used for making a p channel MOS transistor included in the reference voltage generating circuit. In the present embodiment, the p channel MOS transistor Q1 of the output stage shown in FIG. 1 is formed at this region 306.

Figure 34:
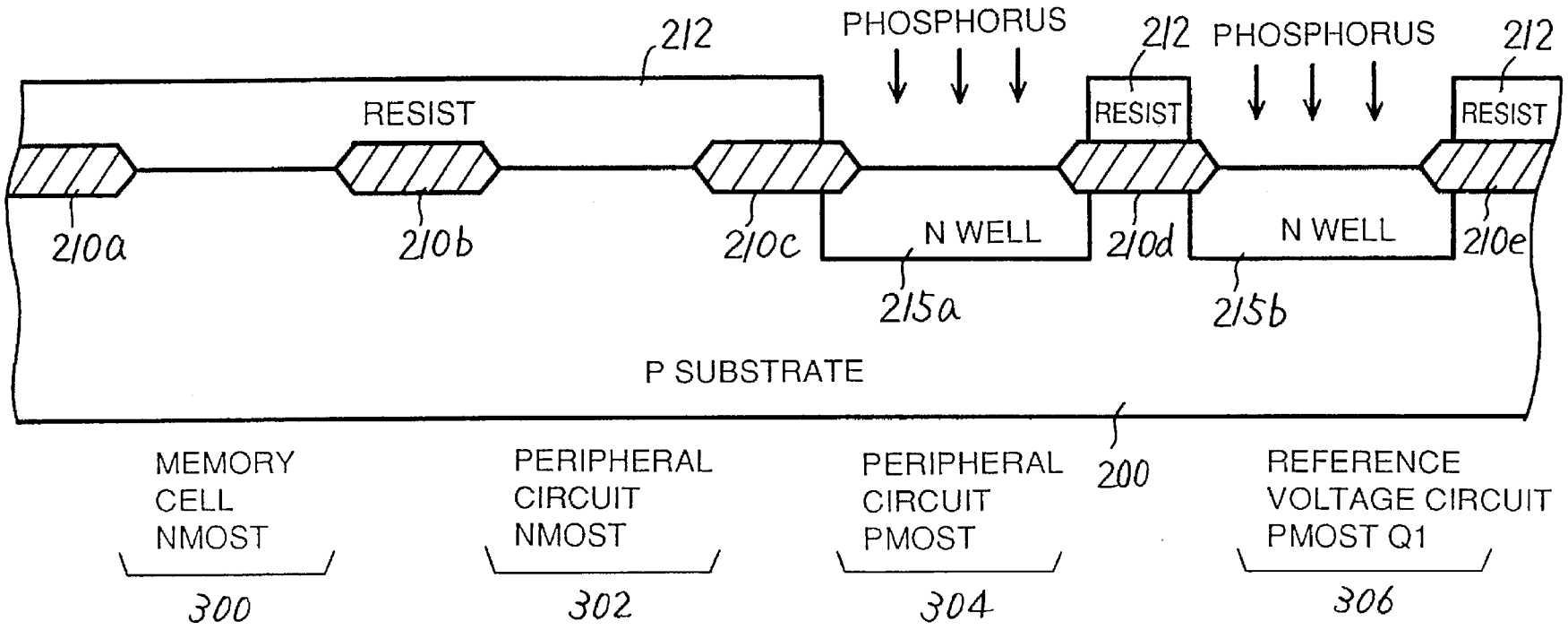

As shown in FIG. 34, a resist film 212 is formed first over the entire surface of a semiconductor substrate 200, for example, spin coating, and then a resist pattern is formed by photolitography and etching method. As a result, surfaces of region 304 where peripheral circuit is formed and region 306 where reference voltage generating circuit formed are exposed.

Then, ion implantation of N type impurity such as phosphorus is performed with an energy of about 1000 KeV and ion impurity concentration of $1\times10^{13}$ $cm^{-3}$, for example, to form N wells 215a and 215b of N type impurity region at the surface of P type semiconductor substrate 200. These N wells 215a and 215b function as substrate regions for MOS transistors of the peripheral circuit formation region 304 and the reference voltage generating circuit formation region 306, respectively.

Subsequently, after removing this resist pattern 212, a resist film is again formed and a resist pattern 214 is formed by photolithography and etching method. This resist pattern 214 covers the peripheral circuit formation regions while exposing access transistor formation region 300 of the memory array and the region where MOS transistor Q1 of the reference voltage generating circuit is formed. Then, ion implantation of P type impurity such as boron is performed with an energy of about 50 KeV and an ion concentration of about $1\times10^{12}$ $cm^{-3}$. In access transistor formation region 300 of the memory array, concentration of P type impurity at the surface of the substrate is made higher so that the threshold voltage of the access transistor is increased. Meanwhile, concentration of P type impurity at the surface of N well 215b in region 306 is made higher and the absolute value of its threshold voltage is made smaller. This ion implantation makes the threshold voltage of the access transistor formed at region 300 higher than the threshold voltage of n channel MOS transistor of the peripheral circuit formed at region 302 by about 0.3 V. Meanwhile, the absolute value of the threshold voltage of p channel MOS transistor Q1 formed at region 306 is made smaller than the absolute value of the threshold voltage of the p channel MOS transistor in the peripheral circuit formed at region 304 by about 0.3 V.

Resist pattern 214 is then removed. Thereafter, oxide film 216 having a thickness of approximately 150 Å is formed at the surface of semiconductor substrate 200 and on this oxide film 216, a low resistance polycrystalline silicon doped with impurity is deposited by a process such as CVD. Then, resist pattern is formed by photolithography on this polycrystalline silicon film. Using this resist pattern as a mask, the polycrystalline silicon and the oxide film are selectively etched away. Thus, a gate electrode structure of MOS transistor having gate oxide film 216 and gate electrode 218 is formed at regions 302, 304, 306 and 308, respectively.

Here, this oxide film 216 may be other insulating films (for example, silicon nitride oxide (oxinitride) film). In addition, polycrystalline silicon film 218 may be formed of a refractory metal silicide layer such as molybdenum silicide layer.

Figure 37:
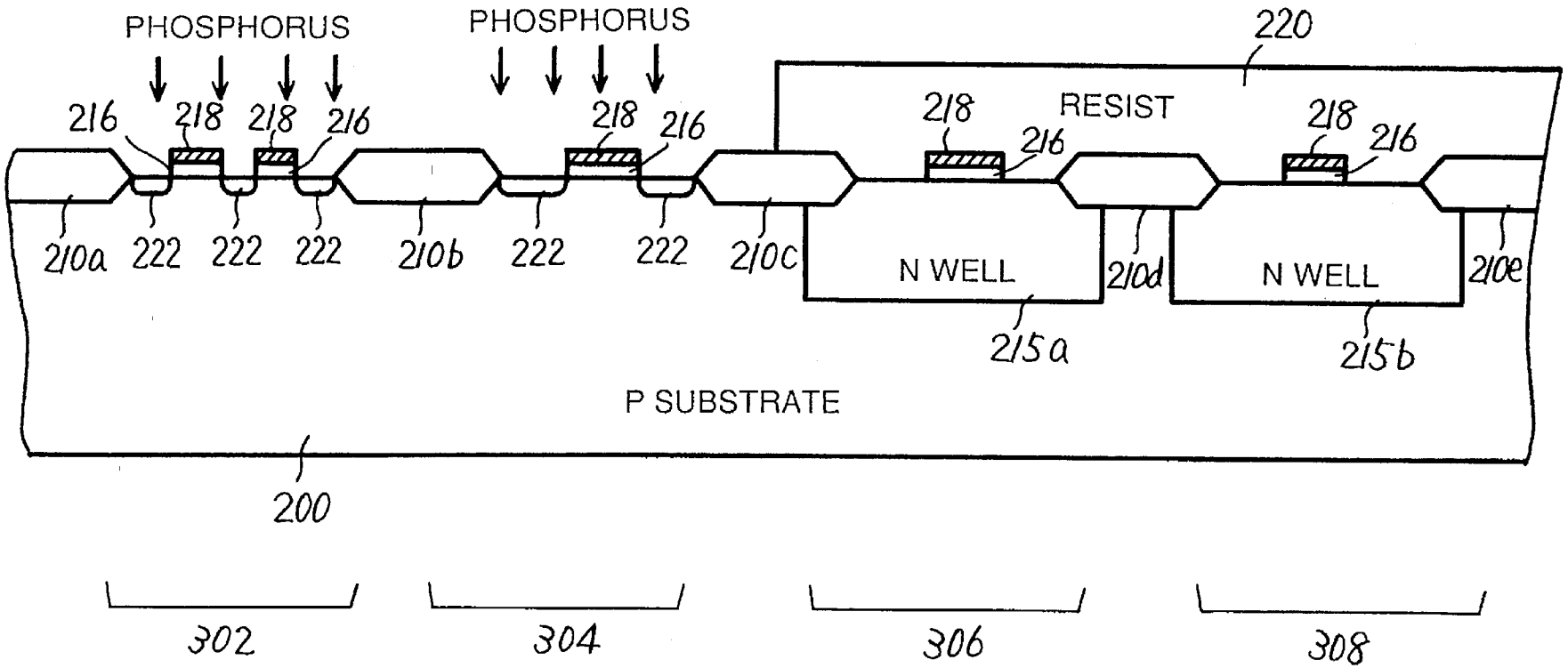

Next, as shown in FIG. 37, regions 306 and 308 at which p channel MOS transistors are formed are first covered by a resist pattern 220. Using this resist pattern 220 as a mask, an ion implantation of N type impurity such as phosphorus is performed. At regions 302 and 304, a low resistance N type impurity regions 222 of a high concentration are formed in a self-aligned manner, using gate electrode structures of oxide films 216 and polycrystalline silicon films 218 as masks, to form source/drain regions of the n channel MOS transistors.

Figure 38:
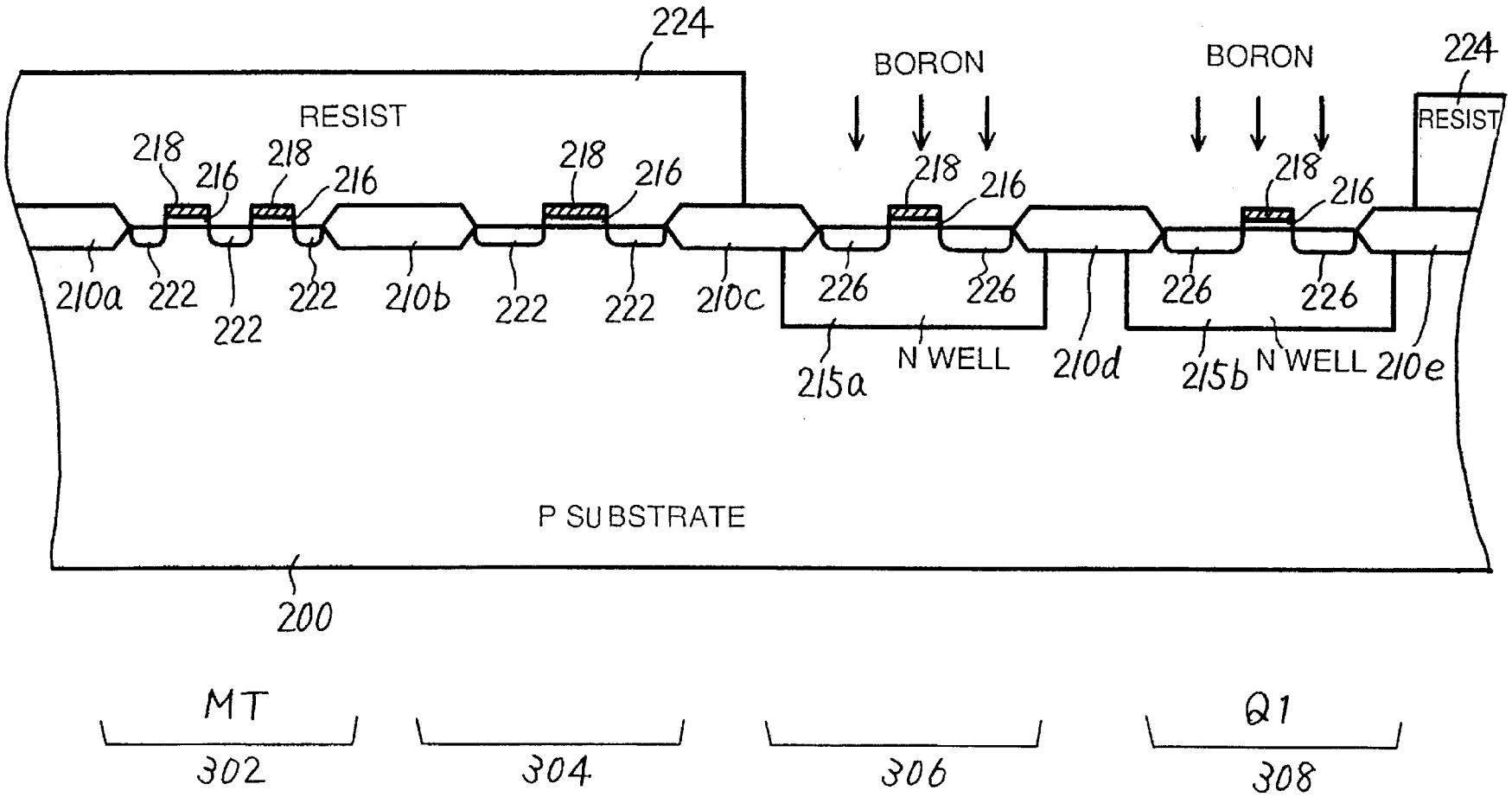

After removing resist pattern 220, a resist film is again formed. Subsequently, a resist pattern 224 is formed covering regions 302 and 304 at which n channel MOS transistors are formed, according to photolithography and etching method. At this time, as shown in FIG. 38, p channel MOS transistor formation region 306 of the peripheral circuit and p channel MOS transistor formation region 308 of the reference voltage generating circuit are exposed. An ion implantation of P type impurity such as boron is performed, and a low resistance P type impurity regions 226 of high concentration are formed in a self-aligned manner at N wells 215a and 215b. Thus, source/drain regions of p channel MOS transistors are formed at regions 306 and 308.

After removing resist pattern 224, electrode interconnections are formed as required so as to form the semiconductor device.

Figure 35:
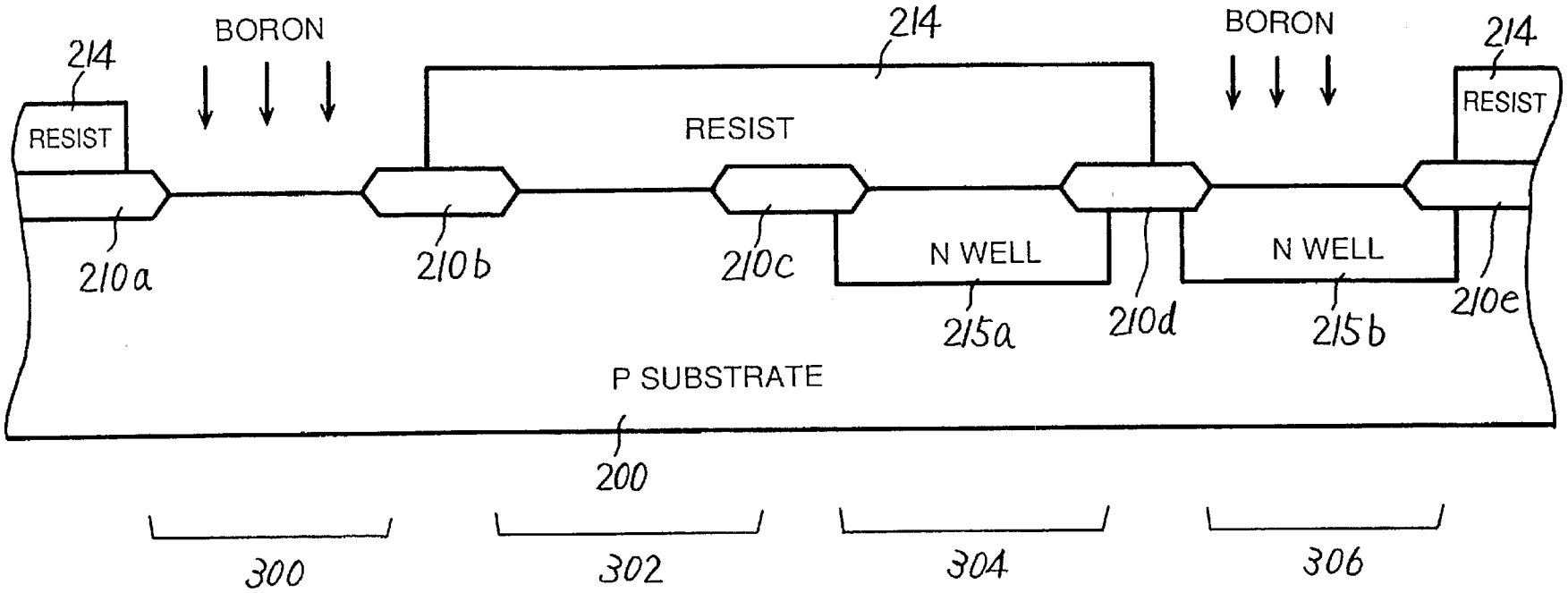

As described above, in this embodiment, ion implantation of P type impurity to the surface of the substrate directly under the gate electrode formation region to increase the threshold voltage of access transistor (n channel MOS transistor) included in the memory cell and ion implantation of P type impurity to the surface of the surface region of the substrate directly under gate electrode formation region of p channel MOS transistor at the reference voltage generating circuit are performed at the same time (see FIG. 35). Accordingly, a semiconductor device including p channel MOS transistors having at least two threshold voltages which differ from one another can be implemented without increasing any manufacturing steps in number.

This p channel MOS transistor formed at N well 215b shown in FIG. 38 is formed as p channel MOS transistor Q1 of the output stage for producing the reference voltage. The threshold voltages of other MOS transistors Q2 and Q3 are approximately at the same level as the threshold voltage of p channel MOS transistor formed at N well 215a surrounded by peripheral circuit formation region 306. In this way, a p channel MOS transistor having a threshold voltage required in the reference voltage generating circuit can be fabricated.

In addition, n channel MOS transistors are formed on the surface of P type semiconductor substrate at regions 302 and 304 in this embodiment. These n channel MOS transistors at regions 302 and 304 may also be formed in the P well formed at the surface of P type semiconductor substrate 200. Furthermore, a triple well structure may also be used in which a well region of a first conductivity type has a well region of a second conductivity type additionally formed therein and this well region of the second conductivity type has an MOS transistor formed therein.

Modification

Figure 39:
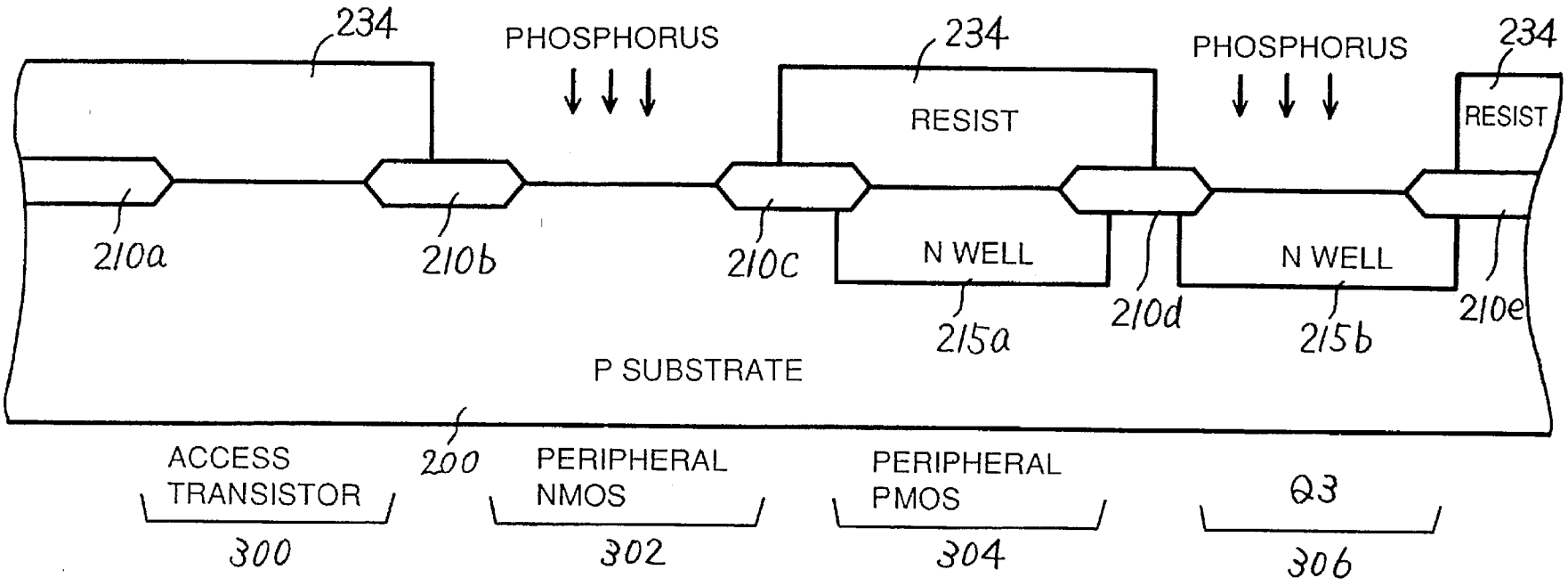
FIG. 39 shows a principal manufacturing process in a method of manufacturing a modification of the eleventh embodiment of the present invention.

FIG. 39 is a cross section of a structure of a semiconductor device showing the principal manufacturing process according to a modification of the eleventh embodiment of the present invention. This structure shown in FIG. 39 corresponds to the process shown in FIG. 35 which was described previously. In the process shown in this FIG. 39, the process which was described with reference to FIGS. 30 to 34 has been carried out, except for that the concentration of P type impurity at the surface of P type semiconductor substrate 200 is made higher than that of the previously described embodiment. More specifically, in the stage before the step is shown in FIG. 39, the concentrations of P type impurity at region 300 where access transistor of the memory cell is formed and region 302 where n channel MOS transistor of at the peripheral circuit is formed are relatively high, and the threshold voltages of the MOS transistors formed in these regions are increased. That is, the threshold voltage of n channel MOS transistor in the peripheral circuit is set as high as that of the access transistor in the memory cell.

The process of matching the threshold voltage of the peripheral n channel MOS transistor to the threshold voltage of the access transistor in the memory cell is implemented by implanting ions of P type impurity at an acceleration energy of about 50 KeV, for example, in the process before or after the formation of N wells 215*a* and 215*b* shown in FIG. 34 discussed previously. This P type impurity is implanted only to the surface portion of the channel formation region at semiconductor substrate 200 with a low acceleration energy.

After formation of these N wells 215*a* and 215*b*, or after setting the concentration of P type surface impurity at the surface of P type semiconductor substrate 200 higher, the process shown in FIG. 39 is performed. More specifically, after forming a resist pattern 234 so as to expose the surfaces of region 302 at which n channel MOS transistor of the peripheral circuit is formed and of region 306 at which p channel MOS transistor included in the reference voltage generating circuit is formed are formed, ion of N type impurity such as phosphorus is implanted with a relatively low acceleration energy and ion implantation of N type impurity is implanted on the surface regions of regions 302 and 306. In this case, since ions of N type impurity have been implanted to region 302, n channel MOS transistor formed at this region 302 would have a low threshold voltage, and a low threshold voltage MOS transistor is implemented. Meanwhile, since additional ions of N type impurity is implanted to N well 215*b* at region 306, the p channel MOS transistor formed at this N well 215*b* would have a threshold voltage of a greater absolute value.

Figure 36:
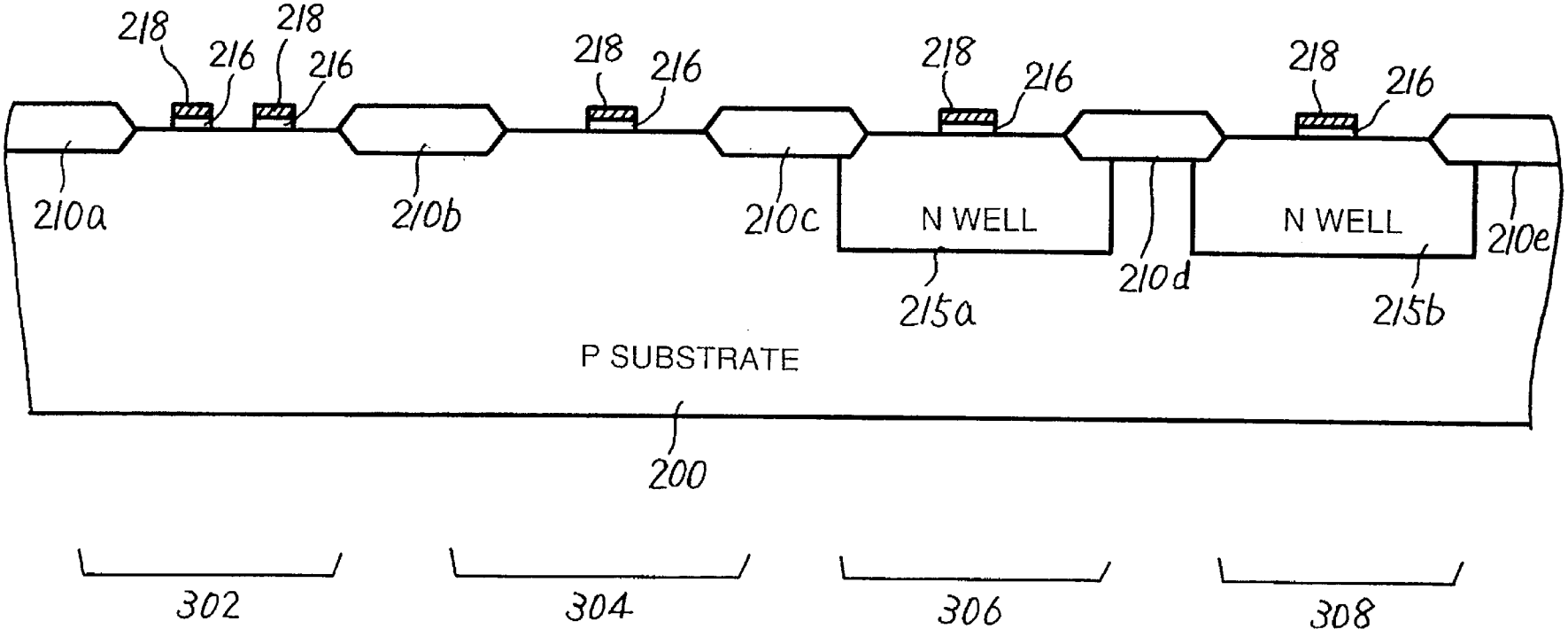

After increasing the absolute value of the threshold voltage of p channel MOS transistor required in this region 306, the process shown in FIG. 36 discussed previously is performed to form the MOS transistors required in each region.

In accordance with the manufacturing method of this modification, a high threshold voltage p channel MOS transistor is implemented which has a greater absolute value of the threshold voltage. Accordingly, since the absolute value of the threshold voltage of the MOS transistor formed at this region 306 is made greater than the absolute value of the threshold voltage of the other p channel MOS transistor in the reference voltage generating circuit, the MOS transistor formed at this region 306 is utilized as the p channel MOS transistor Q3 for setting the gate potential of the output MOS transistor Q1. In the structure of the reference voltage generating circuit described previously.

The manufacturing method of the semiconductor device shown in this embodiment 11 is not intended to be applied only to the structure of the reference voltage generating circuit shown in Embodiments 1 to 9 discussed previously but is to be applied to the implementations of the circuit in which at least two types of threshold voltages are required.

In accordance with the eleventh embodiment of the present invention, since ion implantation of impurity of the first conductivity type is performed to at least a portion of the substrate region of the first conductivity type and of the substrate region of the second conductivity type, a circuit having two types of threshold voltages required to generate a desired internal voltage, e.g., the reference voltage can be implemented without requiring any extra process.

Based upon the foregoing, in accordance with the present invention, a circuit which employs MOS transistors is formed so as to generate the reference voltage with the dependency upon temperature characteristic of MOS transistors being all canceled, so that a stable reference voltage can be generated with significantly reduced dependency upon power temperature and no dependency upon supply voltage.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A reference voltage generating circuit, comprising:

current supplying means including an insulated gate type field effect transistor and coupled to a first potential node, for supplying current from said first potential node;

current setting means including an insulated gate type field effect transistor, for setting the current supplied by said current supplying means to a constant value with no dependency upon the voltage at said first potential node; and voltage generating means including a current discharging means including an insulated gate type field effect transistor for discharging the current supplied by said current supplying means for generating a constant reference voltage with no dependency upon the voltage at said first potential node to an output node, said voltage generating means including means for canceling the dependency upon temperature of said reference voltage owing to the dependency upon temperature of a threshold voltage of respective said insulated gate type field effect transistors.

2. A reference voltage generating circuit, comprising:

a first insulated gate type field effect transistor coupled to a first reference potential node and having a first threshold voltage, for generating a voltage lower by an absolute value of said first threshold voltage than said first reference potential;

a second insulated gate type field effect transistor coupled to said first reference potential node for supplying a current to an output node according to the voltage generated by said first insulated gate type field effect transistor;

a third insulated gate type field effect transistor coupled to a second reference potential node, and having a second threshold voltage for generating a voltage lower than said second reference potential by an absolute value of said second threshold voltage; and a fourth insulated gate type field effect transistor for sinking out current from said output node according to the voltage generated by said third insulated gate type field effect transistor.

3. The reference voltage generating circuit according to claim 2, wherein said second reference potential node receives a ground potential, and said third insulated gate type field effect transistor is coupled between said second reference potential node and a node receiving a negative potential.

4. The reference voltage generating circuit according to claim 2, wherein said first and third insulated gate type field effect transistors each are connected to operate in a diode mode.

5. The reference voltage generating circuit according to claim 2, wherein said third insulated gate type field effect transistor is an n channel MOS transistor.

6. The reference voltage generating circuit according to claim 2, wherein said third insulated gate type field effect transistor is a p channel MOS transistor.

7. A reference voltage generating circuit, comprising:

a first insulated gate type field effect transistor coupled to a first reference potential node and having a first threshold voltage for generating a voltage lower than said first reference potential by an absolute value of said first threshold voltage;

a second insulated gate type field effect transistor coupled to said first reference potential node for supplying a current to an internal node according to the voltage generated by said first insulated gate type field effect transistor;

a third insulated gate type field effect transistor connected between said internal node and a second reference potential node for discharging the current supplied from said second insulated gate type field effect transistor to said second reference potential node according to the difference between the voltages of said internal node and a gate thereof; and a fourth insulated gate type field effect transistor connected between said internal node and an output node and having a second threshold voltage for lowering the voltage on said internal node by an absolute value of said second threshold voltage and outputting the lowered voltage.

8. The reference voltage generating circuit according to claim 7, wherein said third insulated gate type field effect transistor has a gate connected to receive a fixed potential.

9. The reference voltage generating circuit according to claim 7, wherein said first through third insulated gate type field effect transistors each comprises a p channel MOS transistor.

10. The reference voltage generating circuit according to claim 7, further comprising a resistance element coupled between said output node and said second reference potential node, for causing said fourth insulated gate type field effect transistor to operate in a diode mode.

11. A reference voltage generating circuit, comprising: p1 a first element means including at least one first insulated gate type field effect transistor for lowering a first reference potential by an absolute value of a threshold voltage of said at least one first insulated gate type field effect transistor for outputting;

a second element means including at least one second insulated gate type field effect transistor, for supplying current from said first reference voltage applying node to an output node according to a voltage output by said first element means;

a third element means including at least one third insulated gate type field effect transistor, for lowering a second reference potential by an absolute value of a threshold voltage of the at least one third insulting gate type field effect transistor for outputting; and a fourth element means including at least one fourth insulated gate type field effect transistor for discharging a current at said output node according to the voltage output from said third element means.

12. The reference voltage generating circuit according to claim 11, wherein said first element means includes a first MOS transistor coupled to receive said first reference potential and operating in a diode mode, and a second MOS transistor coupled to receive a voltage transferred from to said first MOS transistor for generating the voltage to said second element means, and said second element means includes a third MOS transistor coupled to receive said first reference potential and operating in a diode node and a fourth MOS transistor coupled between said output node and said third MOS transistor and receiving the voltage from said second MOS transistor at a gate thereof.

13. The reference voltage generating circuit according to claim 11, wherein said element means includes one MOS transistor operating in a diode mode to generate from said second reference voltage applied to said fourth element means.

14. The reference voltage generating circuit according to claim 11, wherein said first element means includes a first MOS transistor coupled through a resistance element to a node receiving a voltage higher in absolute value than said first reference potential and to a node receiving said first reference potential node and operating in a diode mode, a second MOS transistor having a gate connected to said resistance element, one conduction node coupled to receive said first reference potential, and another conduction node, and a third MOS transistor coupled to receive a voltage at the other conduction node of said second MOS transistor and operating in a diode node to generate the voltage to said second element means.

15. The reference voltage generating circuit according to claim 14, wherein said second element means includes a fourth MOS transistor connected between a node receiving said first reference potential and said output node and receiving the voltage from said third MOS transistor at a gate thereof.

16. A reference voltage generating circuit, comprising:

a first insulated gate type field effect transistor having a first threshold voltage and provided between a first potential node and an output node;

a second insulated gate type field effect transistor having a second threshold voltage and provided between said output node and a second potential node;

a third insulated gate type field effect transistor having a third threshold voltage for lowering a voltage of said first potential node by an absolute value of said third threshold voltage for application to a gate of said first insulated gate type field effect transistor; and a fourth insulated .gate type field effect transistor having a fourth threshold voltage for lowering a voltage of said second potential node by an absolute value of said fourth threshold voltage for application to a gate of said second insulating gate type field effect transistor.

17. A reference voltage generating circuit, comprising:

a first insulated gate type field effect transistor having a first threshold voltage and connected between a first potential node and an internal node;

a second insulated gate type field effect transistor having a second threshold voltage and connected between said internal node and a second potential node, and receiving a potential of said second potential node at a gate thereof;

a third insulated gate type field effect transistor having a third threshold voltage for lowering a voltage at said first potential node by an absolute value of said third threshold voltage for application to a gate of said first insulating gate type field effect transistor; and a fourth insulated gate type field effect transistor having a fourth threshold voltage for lowering a voltage at said internal node by an absolute value of said fourth threshold voltage for transmission to an output node.

18. A reference voltage generating circuit, comprising:

a first insulated gate type field effect transistor having a first threshold value and connected between a first node and an output node;

a second insulated gate type field effect transistor having a second threshold voltage and connected between said output node and a first power supply node;

a third insulated gate type field effect transistor having a third threshold voltage for lowering a voltage at a second node by an absolute value of said third threshold voltage for application to a gate of said first insulated gate type field effect transistor;

a fourth insulated gate type field effect transistor having a fourth threshold voltage for lowering a voltage at a second power supply node by an absolute value of said fourth threshold voltage for transmission to said first node;

a fifth insulated gate type field effect transistor having a fifth threshold voltage for lowering the voltage at said second power supply node by an absolute value of said fifth threshold voltage for transmission to said second node; and a sixth insulated gate type field effect transistor having a sixth threshold voltage for lowering a voltage at said first power supply node by an absolute value of said sixth threshold voltage for application to a gate of said second insulated type field effect transistor.

19. A reference voltage generating circuit, comprising;

a first insulated gate type field effect transistor having a first threshold voltage and connected between a first power supply node and an output node;

a second insulated gate type field effect transistor having a second threshold voltage and connected between said output node and a second power supply node;

a third insulated gate type field effect transistor having a third threshold voltage for applying a voltage obtained by lowering a voltage at a first node by an absolute value of said third threshold voltage to a gate of said first insulated gate type field effect transistor;

a fourth insulated gate type field effect transistor having a fourth threshold voltage connected between a second node and said first power supply node, for clamping said second node to a voltage level higher than a voltage at said first power supply node by an absolute value of said fourth threshold voltage;

a fifth insulated gate type field effect transistor having a fifth threshold voltage for transmitting a voltage obtained by lowering a voltage at said second node by an absolute value of said fifth threshold voltage to said first node; and a sixth insulated gate type field effect transistor having a sixth threshold voltage for lowering a voltage at said second power supply node by an absolute value of said sixth threshold voltage for application to a gate of said second insulating gate type field effect transistor.

20. A reference voltage generating circuit, comprising:

a first insulated gate type field effect transistor having a first threshold voltage and connected between a first power supply node and an internal node;

a second insulated gate type field effect transistor having a second threshold voltage and connected between said internal node and a second power supply node, receiving a voltage of said second power supply node at a gate thereof;

a third insulated gate type field effect transistor having a third threshold voltage, for lowering a voltage at a first node by an absolute value of said third threshold voltage for application to a gate of said first insulated gate type field effect transistor;

a fourth insulated ,gate type field effect transistor having a fourth threshold voltage, for clamping a second node to a level higher than a voltage at said first power supply node by an absolute value of said fourth threshold voltage;

a fifth insulated gate type field effect transistor having a fifth threshold voltage for transmitting a voltage lower than a voltage at said second node by an absolute value of said fifth threshold voltage to said first node; and a sixth insulated gate type field effect transistor having a sixth threshold voltage for lowering a voltage at said internal node by an absolute value of said sixth threshold voltage for application to a reference voltage output node.

21. The reference voltage generating circuit according to claim 20, wherein said fifth insulated gate type field effect transistor is connected between said first node and the first power supply node and has a gate coupled to said second node.

* * * * *